US007556690B2

(12) United States Patent
Goto

(10) Patent No.: US 7,556,690 B2
(45) Date of Patent: Jul. 7, 2009

(54) NOZZLE HEAD, NOZZLE HEAD HOLDER, AND DROPLET JET PATTERNING DEVICE

(75) Inventor: Makoto Goto, Toki (JP)

(73) Assignee: Brother Kogyo Kabushiki Kaisha, Aichi (JP)

( * ) Notice: Subject to any disclaimer, the term of this patent is extended or adjusted under 35 U.S.C. 154(b) by 383 days.

(21) Appl. No.: 11/300,800

(22) Filed: Dec. 15, 2005

(65) Prior Publication Data

US 2006/0107895 A1 May 25, 2006

Related U.S. Application Data

(62) Division of application No. 10/491,123, filed on Mar. 26, 2004, now Pat. No. 7,008,428.

(51) Int. Cl.

| | |
|---|---|
| ***B05B 3/00*** | (2006.01) |
| ***B05B 13/04*** | (2006.01) |
| ***B41J 23/00*** | (2006.01) |
| ***B05C 11/00*** | (2006.01) |

(52) U.S. Cl. ..... 118/323; 118/305; 118/313; 118/681; 118/712; 347/38; 347/40; 347/19

(58) Field of Classification Search ..... 118/300, 118/313, 305, 500, 46, 323, 314–315, 679–681, 118/712, 713; 347/38, 40, 47, 20, 49, 37, 347/19

See application file for complete search history.

(56) References Cited

FOREIGN PATENT DOCUMENTS

| | | |
|---|---|---|
| JP | 58-188661 | 11/1983 |
| JP | 9-300664 | 11/1997 |
| JP | 11-334049 | 12/1999 |
| JP | 2000-123975 | 4/2000 |
| JP | 3121226 | 10/2000 |
| JP | 2002-113849 | 4/2002 |
| WO | WO99/12395 | 3/1999 |

*Primary Examiner*—Yewebdar T Tadesse

(74) *Attorney, Agent, or Firm*—Day Pitney LLP

(57) ABSTRACT

First link members (56A and 56B), a pair of second link members (57A and 57B), and three head holders (51R, 51G, and 51B) are installed rotatably. Rotational pivots (50A and 50B) provided at intermediate portions of the second link members (57A and 57B) and a reference nozzle of the reference head holder (51R) are positioned on the same line in a main scanning direction. The reference head holder (51R) is rotated about the reference nozzle, and the other head holders (51G and 51B) are also rotated simultaneously. The head holders (51G and 51B) are formed to be movable parallel to a sub scanning direction, irrespective of the rotation angles thereof.

9 Claims, 36 Drawing Sheets

7 : NOZZLE HEAD HOLDER

9 : INSPECTION/ADJUSTMENT DEVICE
12 : LIQUID SUPPLY DEVICE

| RANK | NOZZLE PITCH ERROR (μm) | CENTRAL ERROR (μm) |
|---|---|---|
| 1 | +7.5 ~ +12.5 | +10 |
| 2 | +2.5 ~ + 7.5 | + 5 |
| 3 | -2.5 ~ + 2.5 | 0 |
| 4 | -2.5 ~ - 7.5 | - 5 |
| 5 | -7.5 ~ -12.5 | -10 |

NOZZLE HEAD, NOZZLE HEAD HOLDER, AND DROPLET JET PATTERNING DEVICE

This application is a division of Ser. No. 10/491,123 filed Mar. 26, 2004 now U.S. Pat. No. 7,008,428, which is herein incorporated by reference.

TECHNICAL FIELD

The present invention relates to a nozzle head holder and, in particular, to a nozzle head holder in which the nozzle pitch can be adjusted in a sub scanning direction and also the nozzle head position can be adjusted minutely in the sub scanning direction, and a droplet jet patterning device provided with the same.

BACKGROUND OF ART

Recently, as the use of inkjet printers of various configurations has spread widely, color inkjet printers that are capable of high-resolution color printing at substantially photographic quality have become popular. In an inkjet printer, a plurality of nozzle heads, each of which having a number (such as 128) of minute nozzles formed in one or a plurality of rows in the sub scanning direction, are mounted in a carriage. A dot pattern is formed on a discharge-target medium by discharging ink droplets from each nozzle, thus recording a desired image. Japanese Patent Application Laid-Open No. 11-334049 discloses a technique of varying the nozzle pitch by causing a movable link to move with respect to a fixed link, to rotate the nozzle heads partly.

In recent years, liquid-crystal displays have become common in personal computers, wordprocessors, copiers, fax machines, mobile phones, and various types of portable terminal. In addition, liquid-crystal displays that are capable of color display have recently been widely adopted. A color filter is used in the color display of a liquid-crystal display. A color filter is formed of a regular dot pattern of fine filter pixels in the three primary colors of light (red (R), green (G), and blue (B)) on a transparent film. The color filter can be formed by a droplet jet patterning device having a configuration similar to that of the above inkjet printer.

A droplet jet patterning device for manufacturing such a color filter is disclosed in Japanese Patent No. 3,121,226. This device is designed to discharge droplets of the three colors R, G, and B from a plurality of nozzles formed in a nozzle head, to record R, G, and B dot patterns on a glass substrate. The nozzle pitch can be adjusted to be suitably smaller than the actual nozzle pitch in the sub scanning direction by inclining the nozzle head with respect to the sub scanning direction. When the nozzle head is inclined, the discharge timing of each nozzle is made different to align the positions of the recording start edge on the glass substrate. Deviations of each nozzle from the center line of the nozzle array are corrected by controlling the discharge timing.

A droplet jet patterning device for manufacturing a color filter is disclosed in Japanese Patent Application Laid-Open No. 9-300664. In this case, the nozzle head is inclined and also the nozzle head is moved in the sub scanning direction. This device is provided with nozzle heads for the three colors R, G, and B that are formed in a plate. Each nozzle head is held in a state perpendicular to the discharge-target medium. The two ends of each nozzle head are supported in holders, with the holder at one end being connected rotatably to a head mount and the holder at the other end being connected rotatably to a slide member. Each nozzle head is urged toward the head mount side by a coil spring, so that the relative position of each nozzle head with respect to the head mount can be adjusted by using screws. If fine screws for slide members are used to move the slide members in the sub scanning direction, the inclination angle of the nozzle heads with respect to the sub scanning direction can be changed so that the dot pitch can be adjusted in the sub scanning direction.

Organic electroluminescent (EL) displays are gradually becoming practicable as the next generation of displays instead of liquid-crystal displays. An EL substrate for an organic EL display has an anode layer, a hole transport layer, a light-emitting layer, and a cathode layer formed on the surface of a glass substrate, by way of example. Various light-emitting organic compounds corresponding to light-emission colors are used in the light-emitting layer. An organic EL display has a simple configuration and can be made thinner, lighter, and less expensive, and it also has advantage such as little dependency on the angle of viewing and a lower power consumption.

The method of manufacturing an EL substrate for a color organic EL display will be briefly described here. Above an anode layer formed on a glass substrate, droplets for forming a hole transport layer are discharged and are then fixed by heating in a vacuum or an inert gas. Three different types of droplet corresponding to R, G, and B for an EL light-emitting layer are then discharged onto the hole transport layer to form a regular dot pattern of three colors of light-emitting pixels. After the dot pattern has been heated in a vacuum, a cathode layer is formed over the EL light-emitting layer.

However, the above-described prior art has problems, as described below. First of all, since the inkjet printer of Japanese Patent Application Laid-Open No. 11-334049 has a configuration in which movable links are moved with respect to fixed links to incline the nozzle head itself, it is necessary to combine at least the fixed links, the movable links, and the nozzle head into a head mount to maintain the inclination angle. This configuration is complicated because the movable links move in an arc shape with respect to the fixed links. Therefore, it is difficult to manufacture a nozzle head unit with nozzle heads.

Japanese Patent No. 3,121,226 does not disclose any mechanism for supporting the nozzle head in an inclinable manner with respect to the sub scanning direction and the actuator for causing the rotation of the nozzle head. Japanese Patent No. 3,121,226 does not propose a technique for enabling removal of a plurality of nozzle heads as a nozzle head unit. The center of rotation during the inclination of the nozzle head is also not clear.

Since the droplet jet patterning device of Japanese Patent Application Laid-Open No. 9-300664 is provided with a plate-shaped nozzle head that stands vertically, there are large limitations on the shape of the nozzle head. During maintenance or replacement of the nozzle heads, each nozzle head must be removed from the holders. However, it would be difficult to set the vertical position of the nozzle head precisely when the two ends of the nozzle head can be inserted and removed from above with respect to the holders. If each nozzle head cannot be inserted and removed from above the holders, it is difficult to remove the nozzle head and thus maintainability cannot be ensured.

Moreover, since the center of rotation of each nozzle head is the rotational axis for supporting the holders, if the nozzle heads are partly rotated, all of the nozzles will change positions in both the main scanning direction and the sub scanning direction Y. For that reason, the data processing load is increased during the calculation of the recording drive data and a rotational angle for causing relative movement of the glass substrate with respect to the nozzle heads in the main scanning direction and the sub scanning direction, making it difficult to increase the precision of the pattern formation.

In addition, since the movement of the slide members is done by manually operating fine screws, the maximum inclination angle of the nozzle heads cannot be made so large. Accordingly, the width of variation of the dot pitch is small.

It often happens in the droplet jet patterning device that dots of a specific color (such as R dots) are displaced by a small distance from each of other dots (such as G or B dots) in the sub scanning direction, as shown in FIG. 29(*c*). In such a case, it is useful if each nozzle head is moved by just a predetermined distance in the sub scanning direction. However, the configuration of Japanese Patent Application Laid-Open No. 9-300664 enables fine movements of each nozzle head only in the lengthwise direction (nozzle array direction) of the nozzle head, making it impossible to move the nozzle head parallel to the sub scanning direction when the nozzle head is inclined with respect to the sub scanning direction. Since the calculation of the amount of fine movement in the sub scanning direction must be based on both the amount of movement due to the tangent screws and the inclination angle of the nozzle heads, the data processing load is increased during the obtaining of the recording drive data and the inclination rotational angle, making it difficult to increase the precision of pattern formation.

Furthermore, since the nozzle heads are returned in a parallel posture to the sub scanning direction and then the positions of the nozzle heads in the sub scanning direction must be minutely adjusted, the operation of the tangent screws is complicated. Since the positions of the tangent screws and the inclination state will vary with the inclination angle of the nozzle heads, a configuration in which the tangent screws are driven automatically would be totally impossible.

Thus an objective of the present invention is to provide a nozzle head holder in which the insertion and removal of nozzle heads is simple, and which enables the simple insertion to and removal from the device itself with the nozzle heads still installed.

Another objective of the present invention is to provide a nozzle head holder in which the rotatable angle of the nozzle heads is large and in which the nozzle heads can be moved parallel to the sub scanning direction, irrespective of the rotation angle of the nozzle heads.

A further objective of the present invention is to provide a droplet jet patterning device in which the above nozzle head holder is installed and a nozzle head that can be installed to such a nozzle head holder.

DISCLOSURE OF INVENTION

In order to solve the above-described problems, a nozzle head holder according to the present invention is characterized by holding a plurality of nozzle heads having a plurality of nozzles. Each nozzle head is disposed at a predetermined spacing in a main scanning direction. The nozzle head holder includes a four-bar linkage having a pair of first link members that extend parallel to the main scanning direction and a pair of second link members that connect the pair of first link members; and movement means for causing at least one nozzle head of the plurality of nozzle heads to move parallel to a sub scanning direction that is perpendicular to the main scanning direction. The two end portions of each of the nozzle heads are connected to the pair of first link members, respectively. The movement means causes the at least one of the nozzle heads to move parallel in the sub scanning direction (Y), relative to the pair of first link members.

Since this configuration ensures that at least one nozzle head of the plurality of nozzle heads can move parallel to the sub scanning direction with respect to the pair of first link members, the nozzle heads can be moved minutely in the sub scanning direction to finely adjust the positions of the nozzle heads in the sub scanning direction, irrespective of the rotation angle of the nozzle heads. The above structure makes it possible to perform accurate and efficient fine adjustments of the nozzle heads when it is necessary to finely adjust the positions in the sub scanning direction of the nozzle head for G and the nozzle head for B with respect to the nozzle head for R, in accordance with the disposition of pixels formed of three recording dots in R, G, and B, by way of example.

In addition, since a plurality of nozzle heads are provided, it is possible to form a pattern by discharging droplets of a plurality of types, when a color filter or color EL substrate is manufactured, by way of example.

Since this nozzle head holder is provided with the four-bar linkage, the pair of rotational pivots, and the nozzle heads having two end portions that are connected rotatably to the pair of first link members, respectively. The configuration of the nozzle head holder can be made simple. The configuration for removing and attaching the nozzle heads for repair or replacement can also be simplified, making it possible to ensure maintainability.

Since the four-bar linkage itself can be configured of high-precision components and the nozzle heads can be mounted highly precisely in this four-bar linkage, it is possible to manufacture a highly precise nozzle head holder that minimizes manufacturing errors.

It is preferable that concavities having guide surfaces are formed in the pair of first link members, respectively. The movement means are provided with a pair of roller members that are installed rotatably on the two end portions of the at least one of the nozzle heads, and pressure members that press the roller members against the guide surfaces. And the pressure members are moved parallel to the sub scanning direction along the guide surfaces, while the roller members are pressed against the guide surfaces.

This configuration makes it possible to move the nozzle heads finely parallel to the sub scanning direction, through the guide surfaces and the pair of roller members, even when the nozzle heads are in a rotational posture. In addition, since the pair of roller members are each positioned at fixed positions with respect to the pair of first link members, irrespective of the magnitude of the rotational angle of the nozzle heads, the movement mechanisms can be mounted at fixed positions of the first link members, and actuators for moving these movement mechanisms can be provided externally, so that fine adjustment of the nozzle heads in the sub scanning direction can be automated.

Preferably, the plurality of nozzle heads can be installed removably on the pair of first link members. This structure simplifies repair or replacement of the nozzle heads, improving maintainability.

The two end portions of each of the nozzle heads may be urged by a resilient member so as to be in surface-contact with upper surfaces of the first link members. If the two end portions of each nozzle head are in surface-contact with the first link members, errors in the heightwise positions of the nozzle heads in the vertical direction are minimized, and the height of the nozzle heads with respect to the discharge-target medium can be set precisely. Therefore, the performance of the discharge recording is increased.

Preferably, each of the nozzle heads is provided with a nozzle portion having a plurality of nozzles formed therein, and a head holder for supporting the nozzle portion. The two end portions of the head holder are connected to the pair of first link members, respectively.

A nozzle head according to the present invention is characterized in being used in the above-described nozzle head holder. In this nozzle head, a plurality of fine-diameter nozzles are formed in a row in the sub scanning direction, by way of example. Preferably, the pitch between these nozzles can be set to a dimension such as 75 dpi or 150 dpi. A pair of roller members can be provided for connecting the two ends of this nozzle head to the first link members in a rotatable manner, respectively. Since the roller members can rotate with respect to the nozzle head, smooth movement can be obtained by the rotation of the roller members during the rotation of the nozzle head as well as during the parallel movement of the nozzle head to the sub scanning direction in the inclined state.

A droplet jet patterning device according to the present invention includes: the above-described nozzle head holder; a head assembly attachment stand for installing the nozzle head holder in a removable manner; a medium holder means for holding a discharge-target medium; a relative movement generation means for causing the discharge-target medium to move in a main scanning direction and a sub scanning direction relative to the nozzle head; pivoting means for causing the four-bar linkage to pivot; and rotational pivots provided at intermediate portions of the pair of second link members. The pair of second link members are capable of rotating about the rotational pivots. The two end portions of the nozzle head are connected rotatably to the pair of first link members, respectively. The pivoting means causes the pair of second link members to rotate about the rotational pivots to cause the four-bar linkage to pivot Since this droplet jet patterning device is provided with the nozzle head holder, the droplet jet patterning device has the similar effects to those of that nozzle head holder. Before pattern formation, when the pair of second link members is rotated about the rotational pivots at the intermediate portions thereof, the pair of second link members rotate, the pair of first link members move in the main scanning direction and also in opposite direction to each other. The two ends of each nozzle head connected to the pair of first link members are caused to move. The plurality of nozzle heads rotates with respect to the sub scanning direction. By rotating the nozzle heads with respect to the sub scanning direction, the discharge pitch in the sub scanning direction is adjusted finely, so that a desired discharge pitch is changed. And then, one pass of the discharge recording is done while the discharge-target medium is moved with respect to the nozzle head holder in the main scanning direction. After that, the next pass of discharge recording is done after a suitable relative movement of the discharge-target medium in the sub scanning direction. Thus, the discharge recording is done by repeating these operations sequentially.

Since the nozzle heads are rotated by causing the four-bar linkage to pivot, the rotation angle of the nozzle heads can be increased, so that it is possible to increase the width of variation of the discharge pitch in the sub scanning direction.

In this case, preferably, the droplet jet patterning device includes a movement drive means connected removably to the movement means for driving the movement means to cause at least one nozzle head to move parallel to the sub scanning direction. Accordingly, it is possible to use the movement drive means to cause the nozzle heads to move in the sub scanning direction through the movement mechanism, after the nozzle head holder is mounted into the head assembly attachment stand and the movement drive means is connected to the movement mechanism, thus enabling automation.

Furthermore, preferably, the droplet jet patterning device further includes rotational amount detection means for detecting the pivoting amount of the four-bar linkage, and rotational amount control means for controlling the pivoting means based on the detected amount of rotation. According to this configuration, it is possible to cause the four-bar linkage to pivot to any desired rotation angle, by detecting the rotation angle by the rotational amount control means, then using that rotational amount to control the pivoting means by the rotational amount control means.

Another nozzle head holder according to the present invention is a nozzle head holder for holding a nozzle head in which is formed a plurality of nozzles. The nozzle head holder includes: a four-bar linkage having a pair of first link members that extend parallel to a main scanning direction, and a pair of second link members that connect the pair of first link members; and rotational pivots provided at intermediate portions of the pair of second link members. The pair of second link members are capable of rotating about the rotational pivots. A tip end portion of the nozzle head is connected rotatably to one first link member, and a base end portion of the nozzle head is connected rotatably to the other first link member.

When the pair of second link members of the above configuration is rotated about the rotational pivots at intermediate portions thereof, the pair of second link members rotate, the pair of first link members move in the main scanning direction and in the opposite directions to each other. The two ends of each nozzle head connected to the pair of first link members to rotate the plurality of nozzle heads with respect to the sub scanning direction. Since the nozzle heads are rotated by pivoting the four-bar linkage, the rotational angle of the nozzle heads can be increased, and the width of variation of the discharge pitch in the sub scanning direction can be increased.

Since the above nozzle head holder is provided with the four-bar linkage, the pair of rotational pivots, and the nozzle heads having two end portions that are connected rotatably to the pair of first link members, the configuration of the nozzle head holder can be made simple. The configuration required for removing and attaching the nozzle heads for repair or replacement can also be simplified, thereby ensuring maintainability.

Since the four-bar linkage itself can be configured with high precision and the nozzle heads can be mounted precisely in this four-bar linkage, it is possible to provide a precise nozzle head holder that minimizes manufacturing errors.

The pair of rotational pivots is provided in intermediate portions of the pair of second link members and rotationally supported. Accordingly, the reference nozzle of the nozzle head (such as the No. 1 nozzle) can be positioned on the line linking the pair of rotational pivots. Since this configuration ensures that the position of the reference nozzle (the position in the main scanning direction and the sub scanning direction) does not change even if the nozzle heads rotate, data processing can be simplified to generate the drive data, for relative motion between the discharge-target medium and the nozzle head, thereby increasing the precision of the pattern formation.

A plurality of nozzle heads can be disposed at a predetermined spacing in the main scanning direction on the pair of first link members. According to the above configuration, it is possible to rotate the plurality of nozzle heads with respect to the sub scanning direction to form the pattern, which is applicable to manufacture color filters and EL substrates for organic color EL displays.

Preferably, the plurality of nozzle heads discharges droplets of each of a predetermined plurality of colors for forming EL light-emitting layers of the plurality of colors. This makes it possible to reduce the steps for forming the EL light-emitting layer, enabling an increase in throughput and making it possible to manufacture EL substrates for full-color use.

Preferably, the nozzle head discharges droplets for forming a hole transport layer for transporting holes within an EL light-emitting layer to cause the EL light-emitting layer to emit light. According to the above configuration, it is possible to form a hole transport layer.

Preferably, a plurality of nozzles is formed in each of the nozzle heads. A reference nozzle which is the closest to the base of the nozzle head among the plurality of nozzles formed in at least one nozzle head can be positioned on a line linking the pair of rotational pivots.

Since the above structure ensures that the position of the reference nozzle in the sub scanning direction (the position in the main scanning direction and the sub scanning direction) does not change even if the nozzle heads rotate, data processing can be simplified to generate the drive data for causing relative motion between the discharge-target medium and the nozzle head, while increasing the precision of the pattern formation. In addition, since the nozzle heads are rotated by causing the four-bar linkage to pivot, the rotation angle of the nozzle heads can be increased, thereby increasing the width of variation of the discharge pitch in the sub scanning direction.

Preferably, the plurality of nozzle heads is installed removably on the pair of first link members. This simplifies the repair and replacement of the nozzle heads, improving maintainability.

Another nozzle head according to the present invention is characterized by being used in the above described nozzle head holder. If connection pins are provided for connecting the two ends of the nozzle head to the first link members in a rotatable manner, for example, the nozzle heads can be installed to and removed from the nozzle head holder with a simple configuration.

Another droplet jet patterning device according to the present invention includes a head assembly attachment stand for installing the above-described nozzle head holder in a removable manner; a medium holder means for holding a discharge-target medium; pivoting means for causing a four-bar linkage to pivot; and relative movement means for causing the discharge-target medium, which is held in the medium holder means, to move in a main scanning direction and a sub scanning direction relative to the nozzle head.

Since this configuration ensures that the nozzle head holder is installed removably in the head assembly attachment stand, the nozzle head holder can be attached and removed easily and repair or replacement of the nozzle heads can be done easily. Since the pivoting means is provided that acts on the pair of rotational pivots of the four-bar linkage to cause the four-bar linkage to pivot, the four-bar linkage can be pivoted rapidly, automatically, and precisely when the discharge pitch in the sub scanning direction is adjusted by a small distance. In addition, the discharge-target medium is supported by the medium holder means and the pattern formation can be done while relative movement is implemented in both the main scanning direction and the sub scanning direction between the discharge-target medium and the nozzle heads.

Preferably, the nozzle head holder is further provided with rotation angle detection means for detecting the pivoting amount of the four-bar linkage, and rotational amount control means for controlling the pivoting means based on the detected pivoting amount. Since the rotation angle detection means and the rotational amount control means are provided in this configuration, it is possible to perform the rotation of the four-bar linkage, when the one or plurality of nozzle heads and the pair of second link members of the four-bar linkage is rotated are pivoting.

Preferably, the rotation means includes a rotational actuator connected to one second link member, where the rotational actuator causes the one second link member to rotate about one of the rotational pivots. According to this configuration, the rotational actuator is provided with to cause the second link member about either one of the pair of rotational pivots, the second link members, or the four-bar linkage can pivoting with a simple configuration. It is therefore possible to rotate the nozzle head by means of the four-bar linkage rapidly, automatically, and precisely when the discharge pitch in the sub scanning direction is to be adjusted by a small amount.

Another droplet jet patterning device according to the present invention is provided with a nozzle head having a plurality of nozzles formed along a sub scanning direction perpendicular to a main scanning direction, for discharging droplets from the plurality of nozzles to form a pattern on a discharge-target medium. The droplet jet patterning device includes a holder member for rotatably supporting the nozzle head; rotational drive means for causing the nozzle head supported on the holder member to rotate within a range of 0 to 60 degrees with respect to the sub scanning direction about an axis of the reference nozzle, or an axis in the vicinity thereof; and rotation control means for controlling the rotational angle of the nozzle head by the rotational drive means, based on a discharge resolution.

Since this configuration causes rotation of the nozzle head about the axis of the reference nozzle or an axis in the vicinity thereof when the nozzle head is rotated, and thus position of the reference nozzle in the sub scanning direction and the main scanning direction does not change or may change by a small amount, the data processing for creating the drive data for recording can be simplified, the control for discharge recording can be simplified, and the pattern formation can be done more precisely.

Since the nozzle heads can be rotated within the range of 0 to 60 degrees, if the nozzle pitch is P and the inclination rotational angle is $\theta$, the discharge pitch in the sub scanning direction ($P \times \cos\theta$) can be varied between P and 0.5P, making it possible to increase the width of variation of the discharge pitch in the sub scanning direction and set the resolution in the sub scanning direction continuously within the range of P to 0.5P. Moreover, the provision of the rotational mechanism, the rotational drive means, and the rotation control means cause the nozzle heads to rotate automatically, without any manual operation, thereby setting the rotational angle of the nozzle heads rapidly and precisely.

Preferably, the droplet jet patterning device further includes relative movement means for causing the discharge-target medium to move in the sub scanning direction relative to the nozzle head and feed amount control means for controlling the relative movement means on the basis of the discharge resolution so as to perform relative motion of the discharge-target medium in the sub scanning direction by an interlace method.

Since the droplet jet patterning device is provided with the relative movement means for causing the discharge-target medium to move in the sub scanning direction relative to the nozzle head and the feed amount control means for controlling the relative movement means on the basis of the discharge resolution so as to perform relative motion in the sub scanning direction by an interlace method, it is possible to set the feed amount in the sub scanning direction automatically and relatively move the discharge-target medium and the nozzle head automatically, to ensure that the discharge pitch in the sub scanning direction is set to a pitch suitable for the discharge resolution. In addition, since the discharge pitch in the sub scanning direction of the droplets discharged onto the discharge-target medium can be varied over an even wider range, the discharge pitch can be adjusted dependently on the discharge position on the discharge-target medium (the discharge pattern) completely reliably.

Preferably, the holder member includes a pair of first link members that extend parallel to the main scanning direction and a pair of second link members that connect together the pair of first link members. The two end portions of the nozzle head are connected rotatably to the pair of first link members.

According to the above configuration, it is possible to cause the nozzle head to rotate reliably within the range of 0 to 60 degrees. Moreover, this configuration ensure that the four-bar linkage itself is highly precise with few manufacturing errors. Additionally, the rotatable connections of the two ends of the nozzle head to the pair of first link members ensures that the precision of the nozzle head assembly and of the positioning during rotation can be maintained at high levels, thus making it possible to maintain high levels of precision in the pattern formation.

Preferably, the holder member further includes rotational pivots for supporting the pair of second link members at intermediate portions thereof, wherein the pair of second link members are supported to rotate about the rotational pivots.

According to this configuration, a reference nozzle which is the closest to the base of the nozzle head among the plurality of nozzles of the nozzle head is positioned on a line linking the pair of rotational pivots. Since such a configuration ensures that the position of the reference nozzle (the position in the main scanning direction and the position in the sub scanning direction) does not change even when the nozzle head is rotated, the data processing for calculating the rotational angle and the data processing for the recording drive data is simplified, thereby increasing the precision of the pattern formation.

Preferably, the nozzle heads are disposed at a predetermined spacing in the main scanning direction. According to this configuration, it is possible to provide a droplet jet patterning device that is provided with R, G, and B nozzle heads, by way of example. The droplet jet patterning device can produce color filters or EL substrates for color organic EL displays.

BRIEF DESCRIPTION OF DRAWINGS

FIG. 27(*b*) is a view of the four-bar linkage and the nozzle heads in a rotating state;

FIG. 29(*b*) is an illustration of another example of the disposition of R, G, and B dots;

FIG. 29(*c*) is an illustration of a further example of the disposition of R, G, and B dots;

BEST MODE FOR CARRYING OUT THE INVENTION

An embodiment of the present invention is described below with reference to the accompanying drawings. Note that this embodiment relates to the application of the present invention to a droplet jet patterning device for manufacturing an EL substrate (a thin glass plate with light-emitting layers of three colors (R, G, and B) formed thereon) that is used in an organic EL (electro-luminescence) display.

Figure 1:
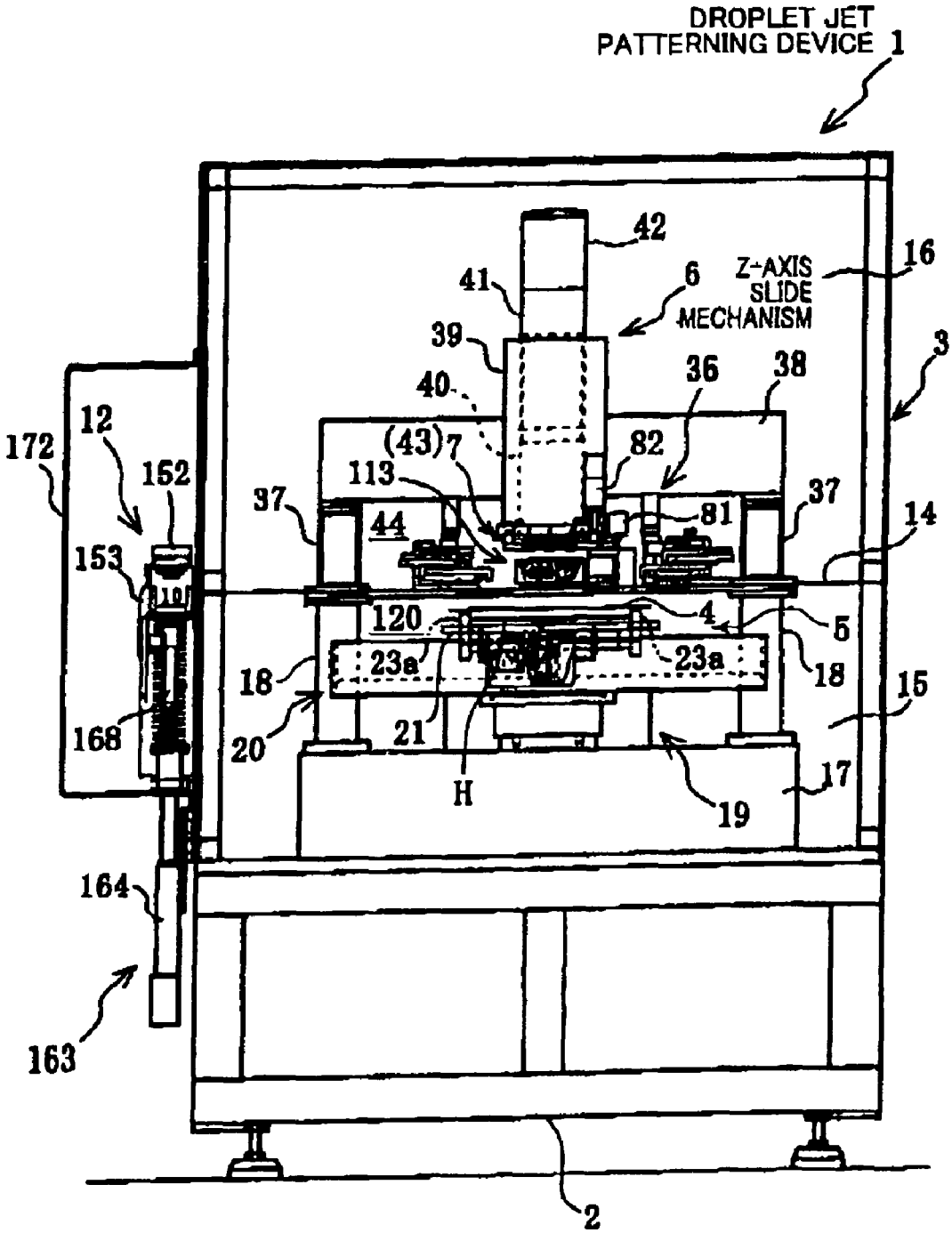
FIG. 1 is a front view of a droplet jet patterning device according to an embodiment of the present invention.
Figure 2:
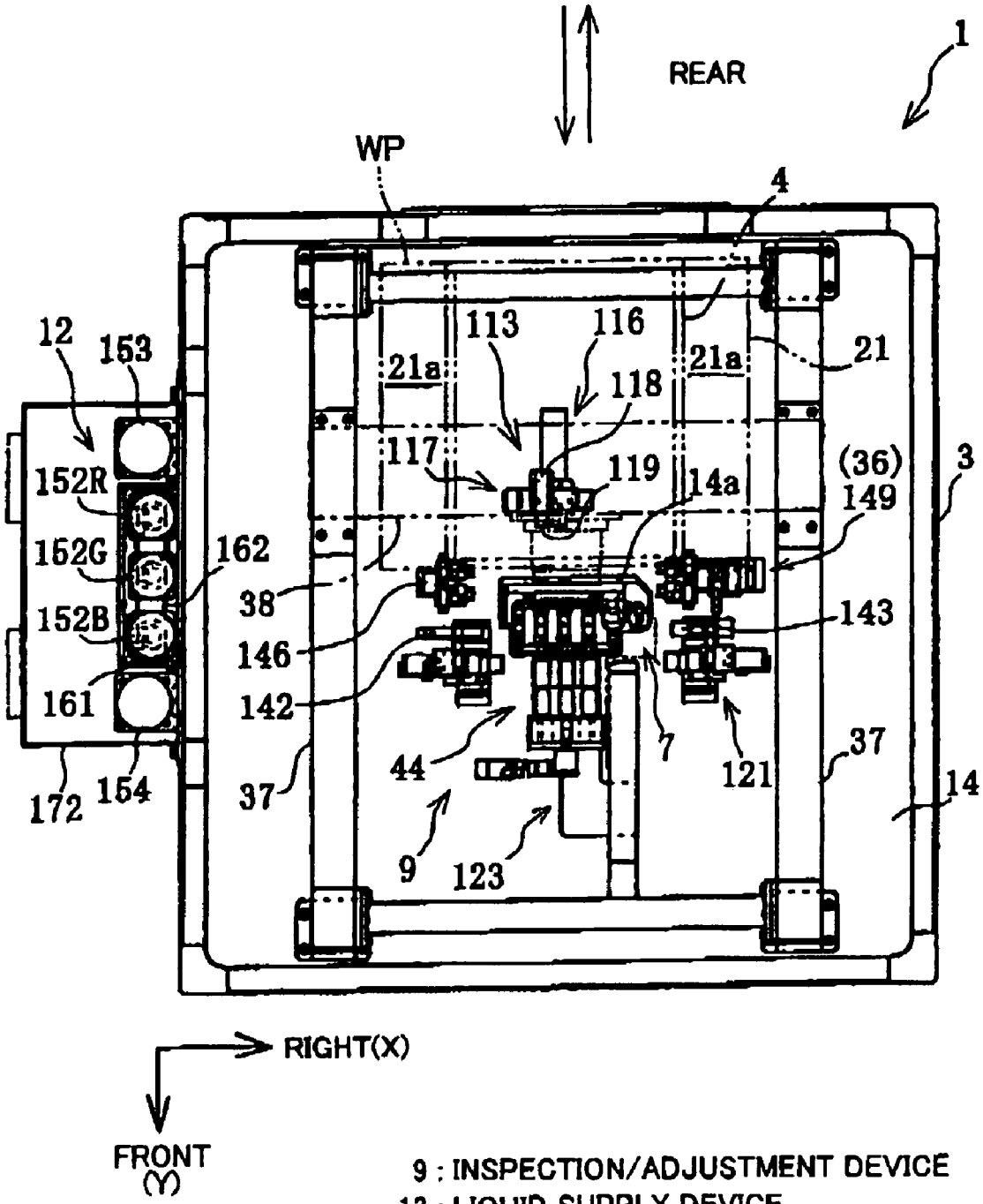
FIG. 2 is a plan view of the droplet jet patterning device.
Figure 6:
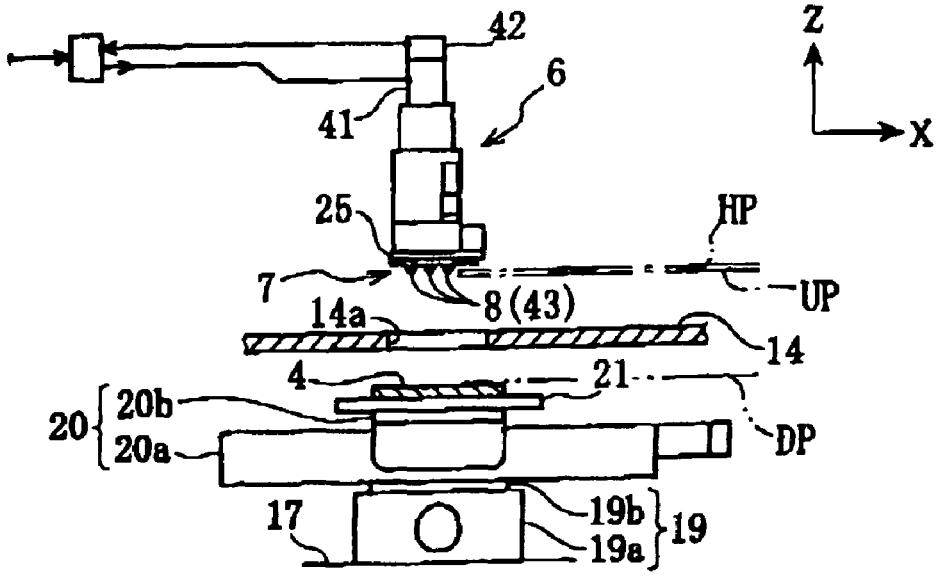
FIG. 6 is an illustration of the raised position of the head portion of the droplet jet patterning device.
Figure 38:
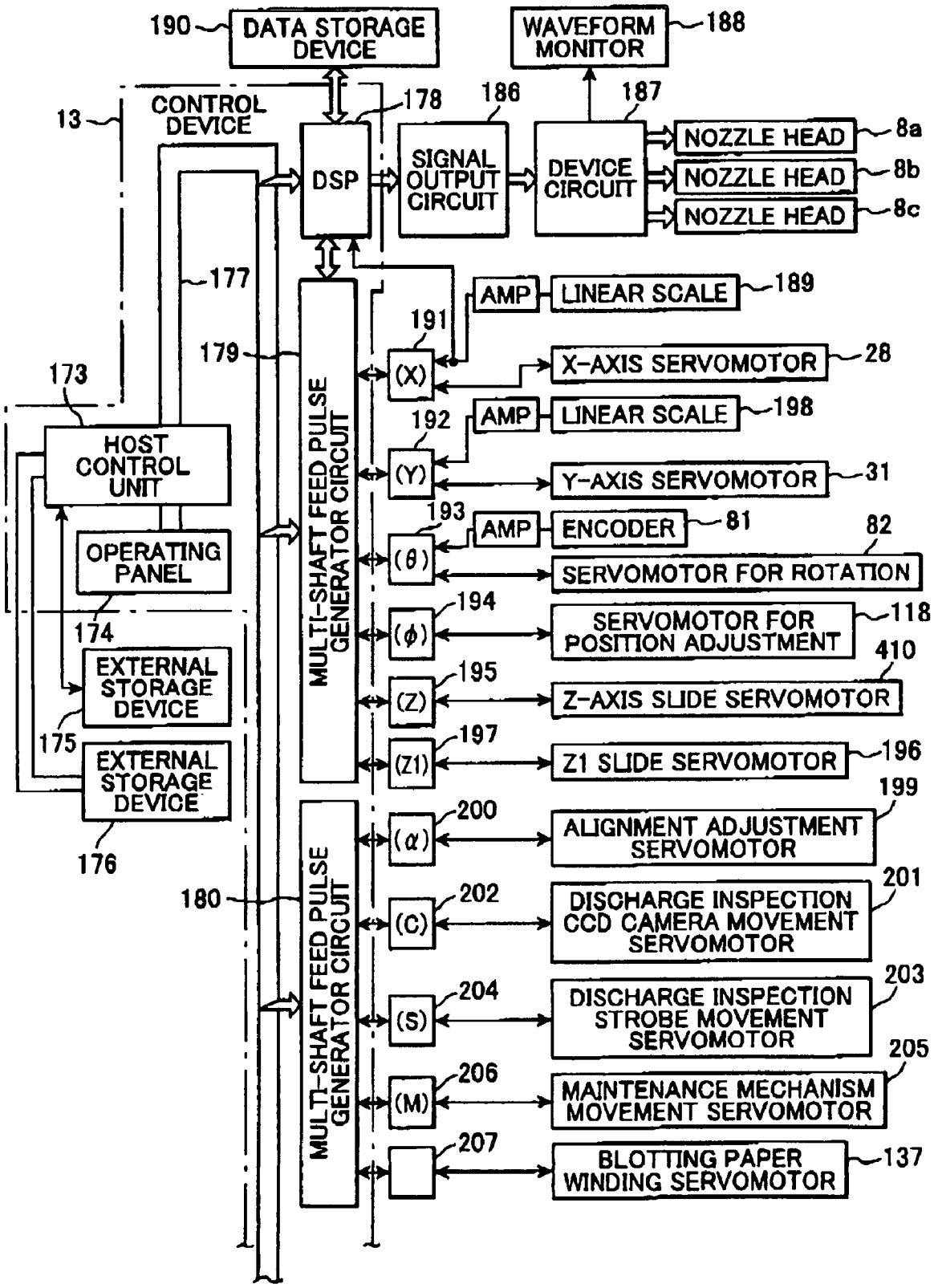
FIG. 38 is part of a block diagram of the control system of the droplet jet patterning device.

As shown in FIG. 1, a droplet jet patterning device 1 is provided with a base frame 2, a parallelepiped-shaped casing 3, a medium holder moving device 5, a Z-axis slide mechanism 6, a nozzle head holder 7, a liquid supply device 12, and a feed loader H. The droplet jet patterning device 1 is further provided with an inspection/adjustment device 9 as shown in FIG. 2 and a control device 13 as shown in FIG. 38. As shown in FIG. 6, the nozzle head holder 7 is provided with a head portion 43, and a plurality of nozzle heads 8 for discharge recording is provided in the head portion 43. The nozzle heads 8 discharge droplets of a plurality of colors to form a dot pattern on a glass substrate 4 that is a recording medium, thus forming EL light-emitting layers that emit light of a plurality of predetermined colors. The following description will be made for explaining the above elements in turn.

As shown in FIG. 1, the casing 3 is formed above the base frame 2 and the interior space of the casing 3 is partitioned by a horizontal partitioning plate 14 (partition member) at an intermediate position into a first-floor patterning room 15 and a second-floor maintenance room 16. A pattern processing stage 120 is provided in the patterning room 15 and an inspection processing stage 44 is provided in the maintenance room 16. An aperture portion 14*a* (see FIG. 6) is formed in the partitioning plate 14 to enable the passage of the nozzle head holder 7. The above-mentioned discharge recording is done within the first-floor patterning room 15. The air in the patterning room 15 is replaced with compressed nitrogen gas to achieve a state in which the moisture density and the oxygen density within the chamber are maintained below predetermined levels. In addition, inspection and adjustment of the nozzle heads 8 are done within the second-floor maintenance room 16. Note that the partitioning plate 14 need not necessarily be disposed horizontally, provided it separates the patterning room 15 and the maintenance room 16.

The patterning room 15 has dimensions such as 1500×1500×500 mm. A marble base stand 17 is disposed on an upper surface of the base frame 2 in the room 5. A support pillar 18 rises from each corner of the base stand 17.

As shown in FIGS. 1 and 2, a pair of box frames 37 that extend in the front-to-rear direction (a sub scanning direction Y) are supported on the support pillars 18 on the left and right sides above horizontal partitioning plate 14 of the maintenance room 16. A support frame 38 is bridged between the box frames 37.

The description now turns to the medium holder moving device 5. At a wait position WP denoted by dot-dot-dash lines in FIG. 2, the medium holder moving device 5 receives the glass substrate 4 that is supported on and transported by the feed loader H from the rear of the droplet jet patterning device 1, moves the substrate 4 to a predetermined automatic alignment start position, and then adjusts the alignment of the glass substrate 4 at an initial setting position. The medium holder moving device 5 also moves the glass substrate 4 in each of the X-axis and Y-axis directions (a main scanning direction X and a sub scanning direction Y) independently during discharge recording, and moves the glass substrate 4 to the wait position WP for transfer onto the feed loader H after the discharge recording.

Figure 5:
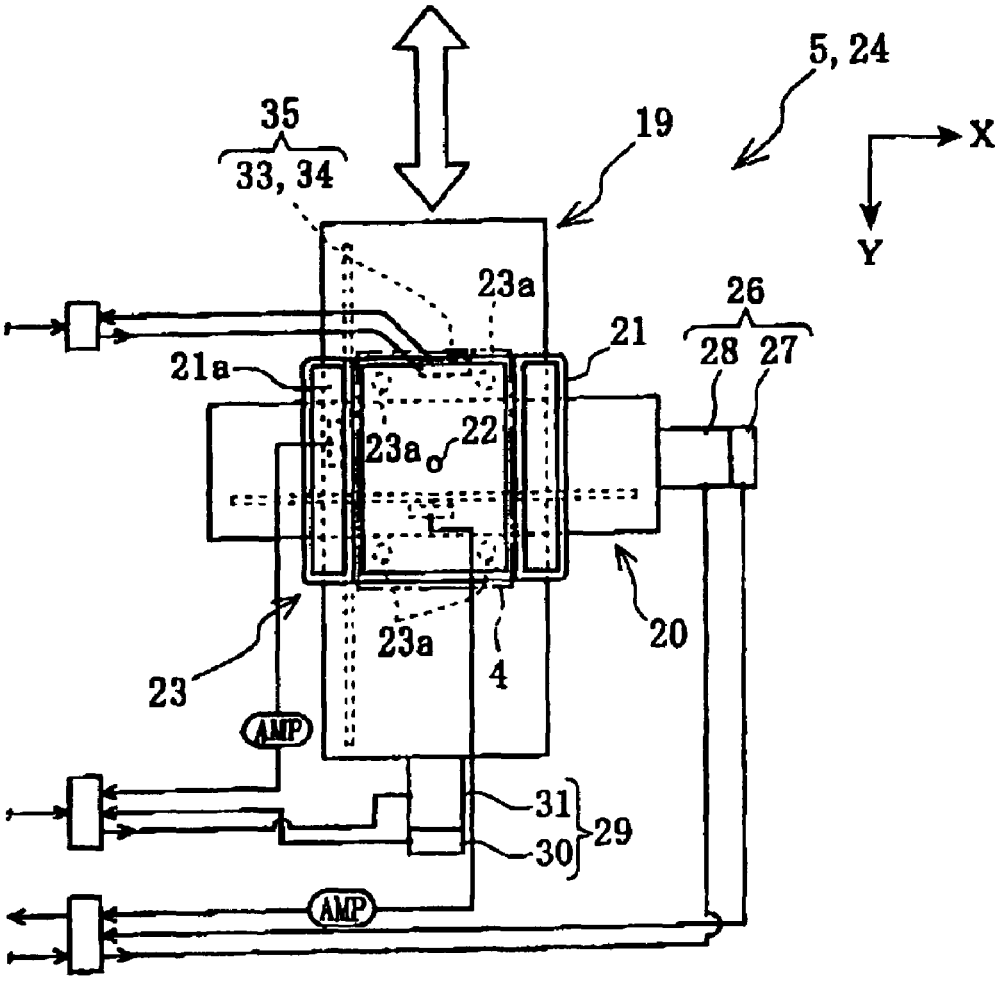
FIG. 5 is a plan view showing a glass substrate, the medium holder moving device, and the substrate receptacle of the droplet jet patterning device.

As shown in FIG. 5, the medium holder moving device 5 is provided with a medium transfer mechanism 24, a substrate receptacle 21, a substrate lift mechanism 23, and an angle adjustment device 35. The medium transfer mechanism 24 is a mechanism for moving the glass substrate 4 in each of the main scanning direction X and the sub scanning direction Y, independently. The medium transfer mechanism 24 is provided with an X-axis slide mechanism 20, a Y-axis slide mechanism 19, an X-direction drive portion 26, and a Y-direction drive portion 29.

As shown in FIG. 6, the Y-axis slide mechanism 19 is provided with a Y-direction guide member 19*a* mounted on the base stand 17 and an output member 19*b* which can move in the sub scanning direction Y along the Y-direction guide member 19*a*. In addition, the X-axis slide mechanism 20 is provided with an X-direction guide member 20*a* mounted on the base stand 17 and an output member 20*b* which can move in the main scanning direction X along the X-direction guide member 20*a*. The substrate receptacle 21 is provided on top of this output member 20*b*. The glass substrate 4 is mounted on the substrate receptacle 21. The substrate receptacle 21 is made capable of rotating about a pin 22 shown in FIG. 5.

As shown in FIG. 5, the Y-direction drive portion 29 is provided with a Y-axis encoder 30 and a servomotor 31, to cause the output member 19*b* to move along the Y-direction guide member 19*a*. Similarly, the X-direction drive portion 26 is provided with an X-axis encoder 27 and a servomotor 28, to move the output member 20*b* along the X-direction guide member 20*a*. This configuration enables the glass substrate 4 mounted on the substrate receptacle 21 to move in each of the main scanning direction X and the sub scanning direction Y, independently. The actual discharge recording is done while the glass substrate 4 is moved relative to the nozzle heads 8 in the main scanning direction X and the sub scanning direction Y.

As shown in FIG. 38, the Y-axis slide mechanism 19 is further provided with a Y-axis linear scale 198 that is capable of detecting an amount of movement of the output member 19*b* precisely. The X-axis slide mechanism 20 is further provided with an X-axis linear scale 189 that is capable of detecting an amount of movement of the output member 20*b* precisely.

The substrate receptacle 21 is configured of a multiply perforated member of a synthetic resin or sintered metal. A negative pressure is applied through the multiply perforated member to the glass substrate 4 mounted on the substrate receptacle 21 in order to attract the substrate 4 to the substrate receptacle 21. As shown in FIG. 5, the substrate receptacle 21 is formed to be wider than the glass substrate 4 in the left and right directions. A pair of trays 21*a* is integral with the receptacle 21 on the left and right sides to accommodate flushing liquid, as will be described later. The substrate lift mechanism 23 is designed to lift the glass substrate 4 a predetermined small distance from the substrate receptacle 21 during transport in and out. The substrate lift mechanism 23 is provided with four lift bars 23*a* and an air cylinder (not shown in the figures) for raising and lowering those lift bars 23*a*.

The angle adjustment device 35 is provided with a cam piece 33 and an electric cylinder 34. The cam piece 33 is frictionally engaged with the under surface of the substrate receptacle 21. The electric cylinder 34 is designed to move the cam piece 33 in the main scanning direction X by a small distance to rotate the substrate receptacle 21 about the pin 22. This configuration makes it possible to rotate the medium transfer mechanism 24 mounted on the substrate receptacle 21 by just a desired angle $\alpha$, to correct the orientation of the medium transfer mechanism 24.

Figure 33:
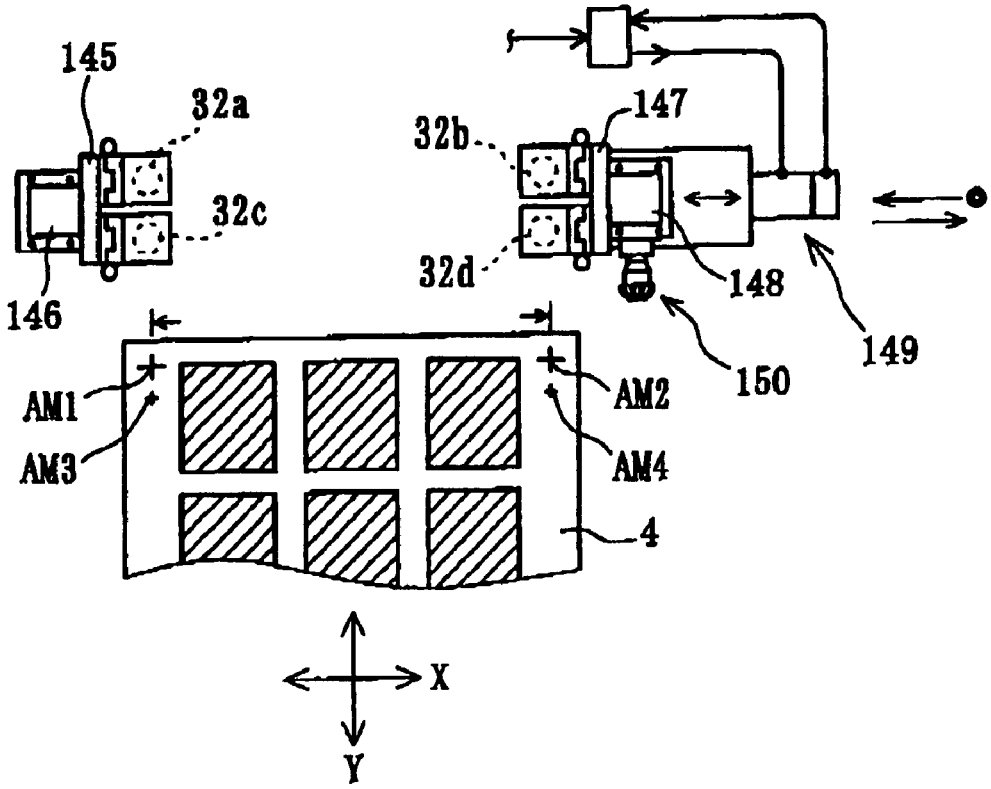
FIG. 33 is a diagram of the configuration of the glass substrate on the substrate receptacle and the automatic alignment adjustment mechanism.
Figure 35:
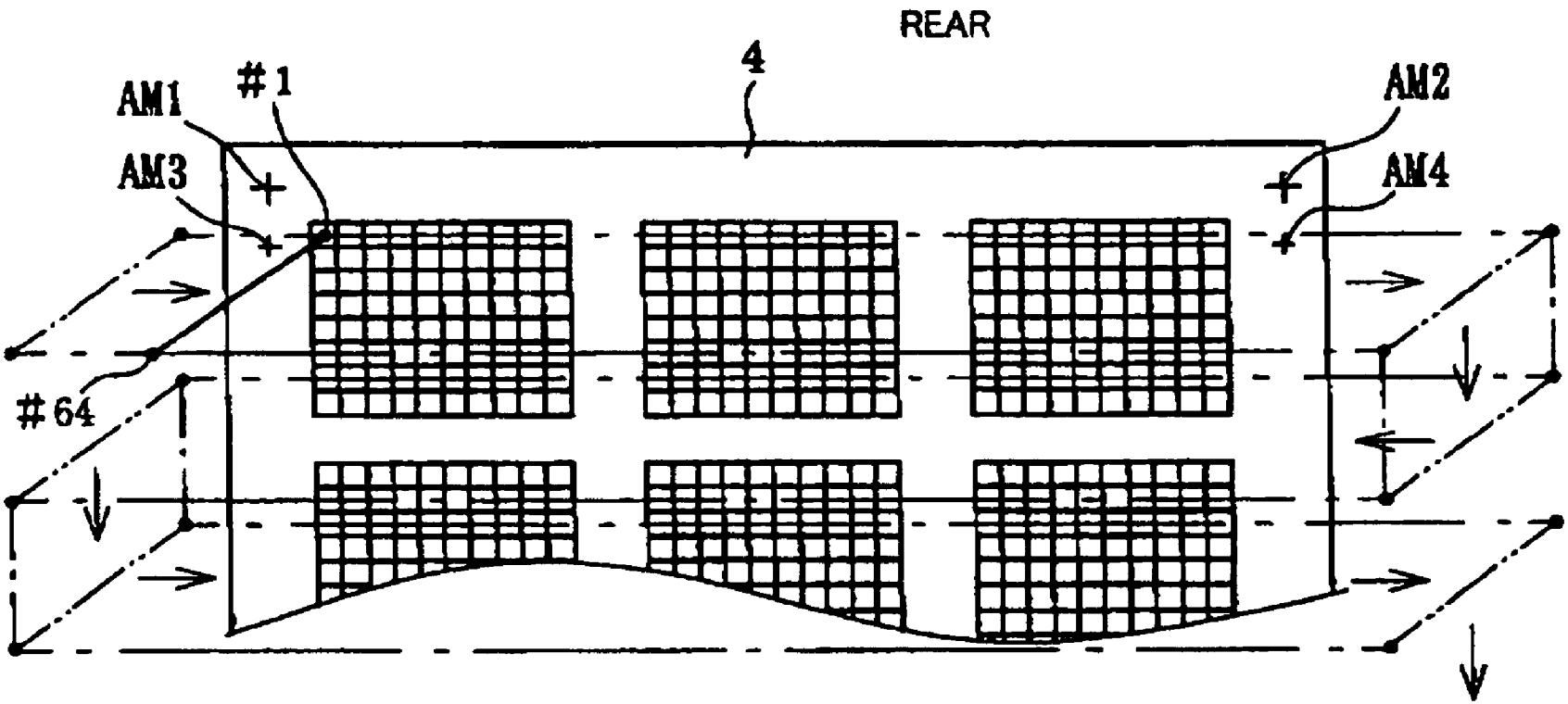
FIG. 35 is an illustration of relative movement between the glass substrate and the nozzle heads that form the discharge pattern of droplets in a plurality of pattern formation areas of a glass substrate.

The description now turns to an automatic alignment adjustment mechanism 36. The automatic alignment adjustment mechanism 36 is designed to move the glass substrate 4 automatically at an initial setting position. As shown in FIGS. 33, 35, and 38, large and small alignment marks AM1, AM2, AM3, and AM4 are printed in the left and right corners of the trailing-edge side of the glass substrate 4. The automatic alignment adjustment mechanism 36 uses these alignment marks AM1 to AM4 to obtain amounts of deviation from the initial setting position of the glass substrate 4, to ensure that the glass substrate 4 is placed at that initial setting position. The automatic alignment adjustment mechanism 36 is configured of the previously-described X-axis and Y-axis slide mechanisms 20 and 19, the angle adjustment device 35, the inspection/adjustment stage 44 shown in FIG. 1, and a control device 13 shown in FIG. 38. The X-axis and Y-axis slide mechanisms 20 and 19 and the angle adjustment device 35 have already been described so that further description thereof is omitted here, and the description now relates to the other components.

Figure 3:
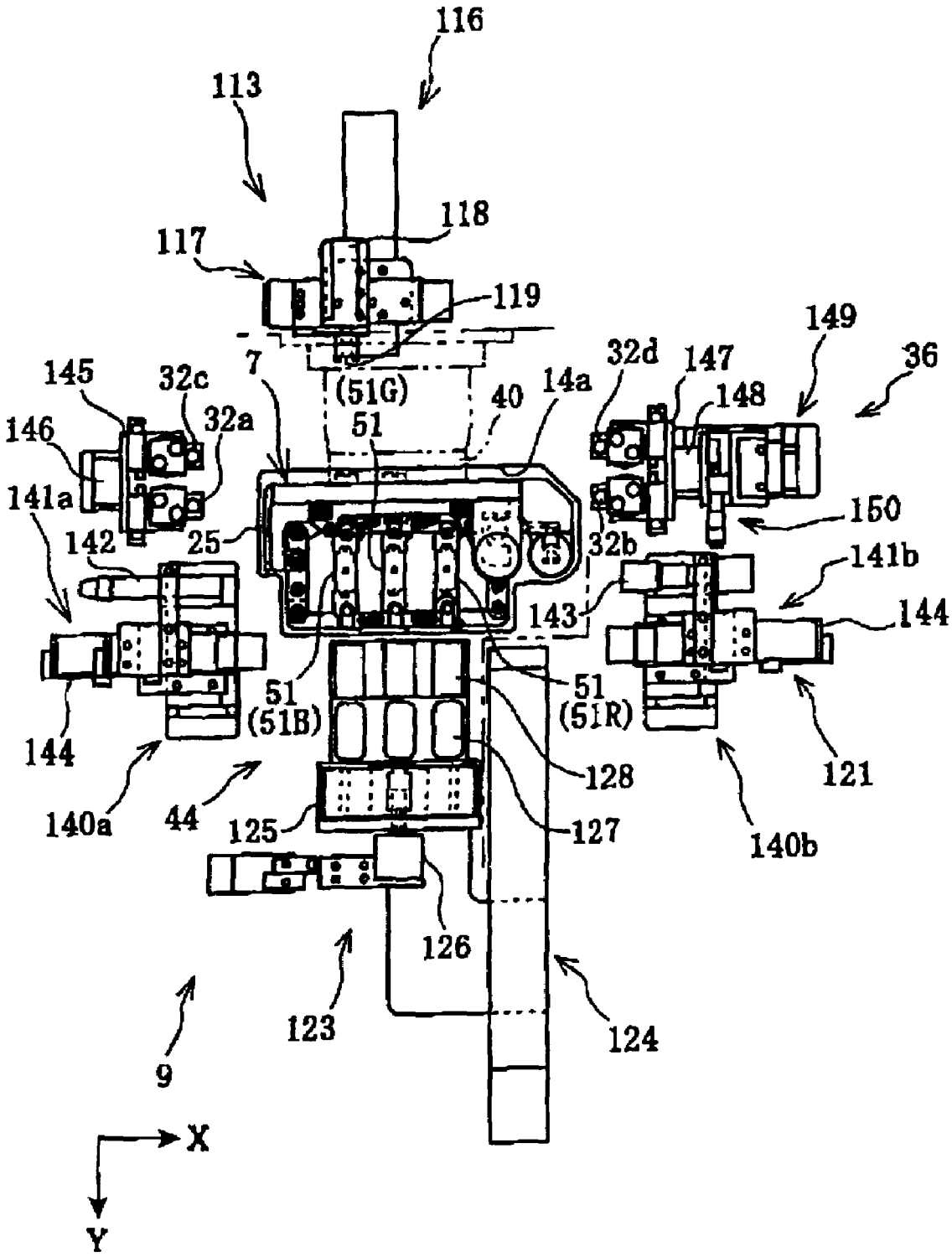
FIG. 3 is a partially enlarged plan view of the droplet jet patterning device.

The inspection/adjustment stage 44 is provided in the maintenance room 16 and is provided with low-magnification CCD cameras 32*a* and 32*b*, high-magnification cameras 32*c* and 32*d*, an X-direction movement drive mechanism 149, and a Y-direction movement drive mechanism 150, as shown in FIG. 3. The low-magnification CCD camera 32*a* and the high-magnification CCD camera 32*c* are attached to a common support plate 145 on the left side of the aperture portion 14*a*. These CCD cameras 32*a* and 32*c* are designed to image the alignment marks AM1 and AM3, respectively, that are positioned below a glass window (not shown in the figure) provided in the partitioning plate 14. The focus of the CCD cameras 32*a* and 32*c* can be adjusted individually by manual operation. If the thickness of the glass substrate 4 changes, the vertical position of the CCD camera 32*a* and the CCD camera 32*c* can be adjusted by an air cylinder 146.

Similarly, the low-magnification CCD camera 32*b* and the high-magnification CCD camera 32*d* are attached to a common support plate 147 on the right side of the aperture portion 14*a*. These CCD cameras 32*b* and 32*d* are designed to image the alignment marks AM2 and AM4, respectively, that are positioned below a glass window (not shown in the figure) provided in the partitioning plate 14. The focus of the CCD cameras 32*b* and 32*d* can be adjusted individually by manual operation. If the thickness of the glass substrate 4 changes, the heightwise position of the CCD camera 32*b* and the CCD camera 32*d* can be adjusted by an air cylinder 148.

The X-direction movement drive mechanism 149 and the Y-direction movement drive mechanism 150 are designed to move the support plate 147 together with the CCD cameras 32*b* and 32*d* by small amounts in each of the X and Y directions, individually. If the positional error of the glass substrate 4 is large or the size of the glass substrate 4 changes, the positions of the alignment marks AM2 and AM4 on the right side may change greatly in the X and Y directions. Even in such a case, the alignment marks AM2 and AM4 can be detected by moving the CCD cameras 32*b* and 32*d* by an appropriate amount in the X and Y directions.

The method of adjusting the alignment of the glass substrate 4 on the substrate receptacle 21 to the initial setting position, using the automatic alignment adjustment mechanism 36, will now be described in detail. First of all, the low-magnification CCD cameras 32*a* and 32*b* image the larger alignment marks AM1 and AM2 to input the obtained image information to the control device 13. The control device 13 processes and analyzes the input image information to analysis by a predetermined control program, to obtain displacement quantities $\Delta X$ and $\Delta Y$ in the main scanning direction X and the sub scanning direction Y from the initial setting position of the glass substrate 4, as well as an angular displacement quantity $\Delta\alpha$ about the pin 22. The control device 13 then controls the X-axis and Y-axis slide mechanisms 20 and 19 and the angle adjustment device 35 in such a manner as to cancel the displacement quantities $\Delta X$, $\Delta Y$, and $\Delta\alpha$, to achieve rough positioning of the glass substrate 4 at the initial setting position.

The left and right high-magnification CCD cameras 32*c* and 32*d* then image the smaller alignment marks AM3 and AM4 to input the obtained image information to the control device 13. In a similar manner to that described above, the image information is analyzed by the control device 13 to obtain displacement quantities $\Delta X$, $\Delta Y$, and $\Delta\alpha$ from the initial setting position of the glass substrate 4. The control device 13 then controls the X-axis and Y-axis slide mechanisms 20 and 19 and the angle adjustment device 35 to cancel the displacement quantities $\Delta X$, $\Delta Y$, and $\Delta\alpha$. This achieves precise positioning of the glass substrate 4 at the initial setting position.

Since the plurality of CCD cameras 32*a* to 32*d* is provided in this manner, it is possible to detect the position of the glass substrate 4 held on the substrate receptacle 21 and then place the glass substrate 4 at the origin position accurately, based on the detection results.

The description now turns to the Z-axis slide mechanism 6. The Z-axis slide mechanism 6 rises and lowers the nozzle head holder 7 so that the head portion 43 of the nozzle head holder 7 is positioned selectively among a discharge position (down position) DP, an inspection/adjustment position (up position) UP, and a home position HP that is slightly higher than the inspection/adjustment position UP, as shown in FIG. 6. Note that the discharge recording by the nozzle heads 8 is done at the discharge position DP. Inspection and adjustment for the head portion 43, which will be described later, is done at the inspection/adjustment position UP. The home position HP is a standby position for the nozzle head holder 7.

Figure 4:
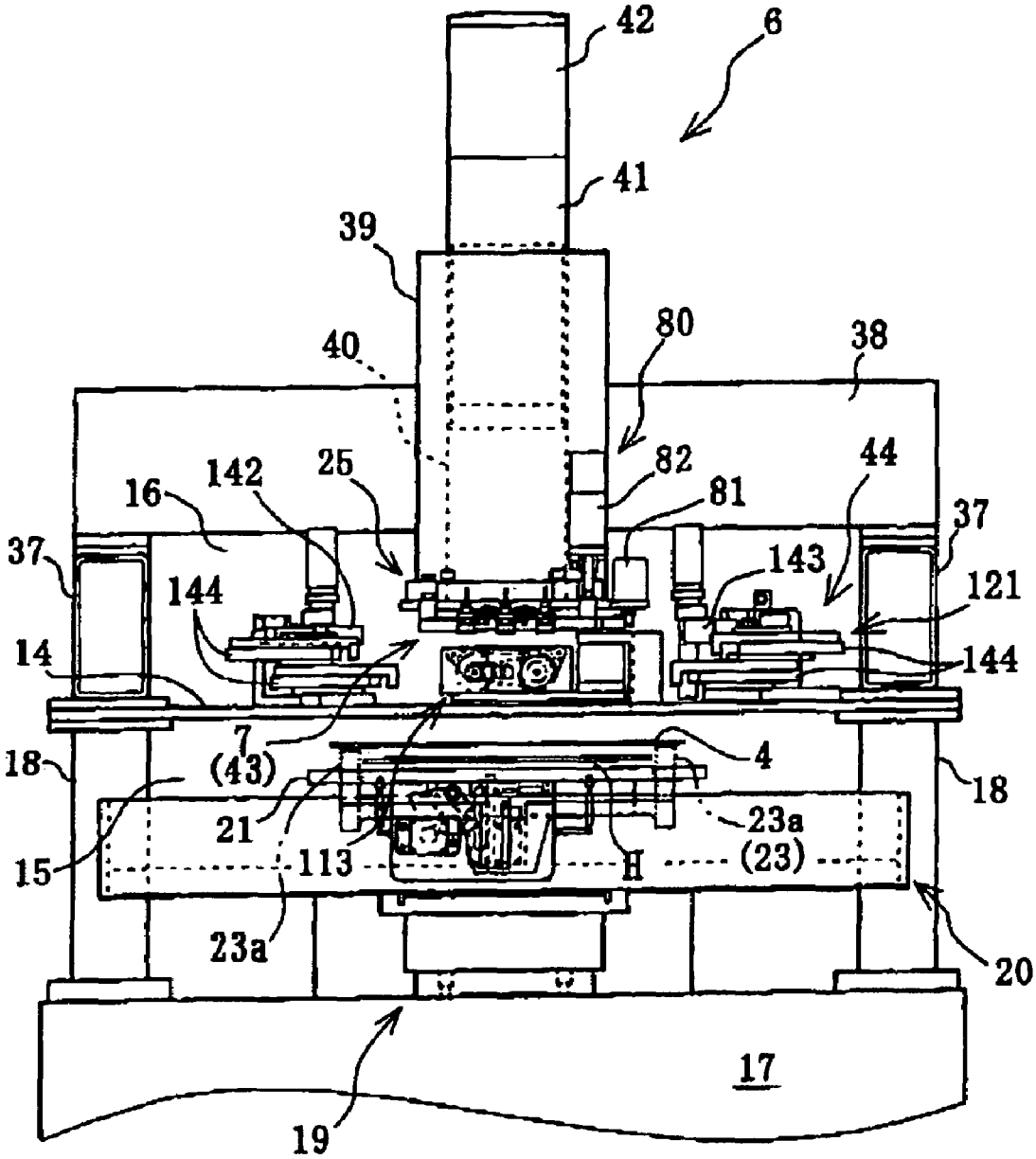
FIG. 4 is a partially enlarged front view of the droplet jet patterning device.
Figure 9:
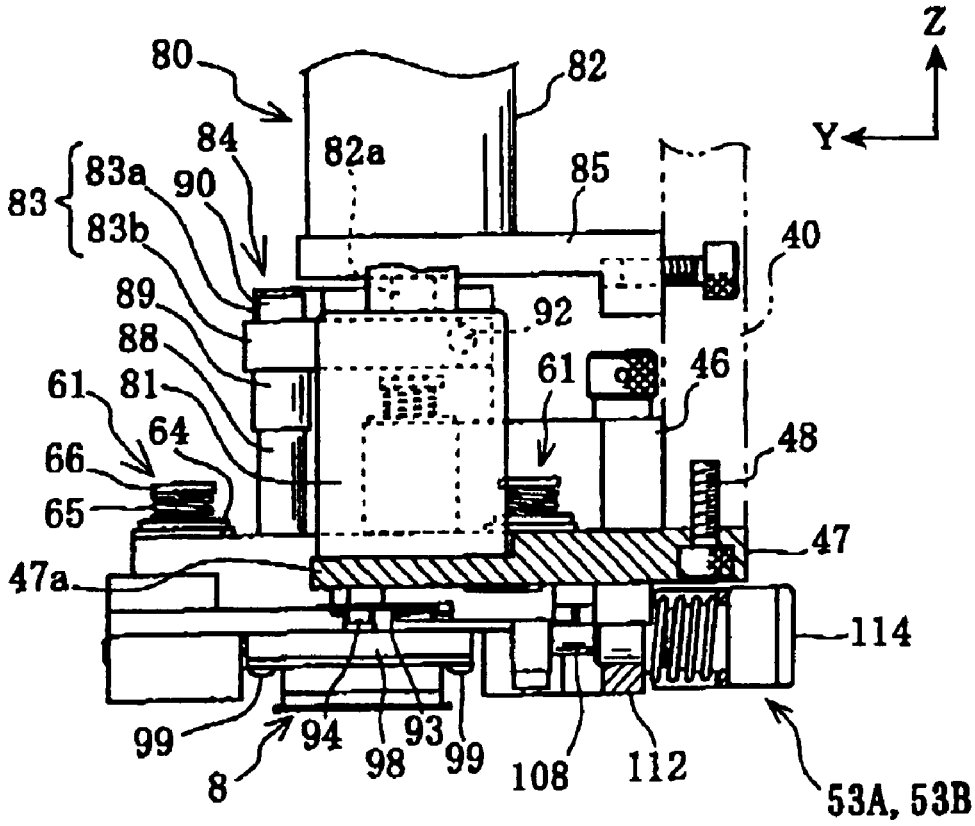
FIG. 9 is a partially cutaway longitudinal right side view of the nozzle head holder, the rotational drive mechanism, and the encoder.

As shown in FIG. 4, the Z-axis slide mechanism 6 is configured of a slide case 39, an output member 40 that can be guided into the slide case 39, an electric cylinder 41 that raises and lowers the output member 40, and a Z-axis encoder 42 for the electric cylinder 41. The slide case 39 is fixed to the previously mentioned support frame 38. A head assembly attachment stand 25 is fixed to the lower end of the output member 40. The nozzle head holder 7 is attached in a removable manner to the head assembly attachment stand 25. More specifically, as shown in FIG. 9, the head assembly attachment stand 25 has a support plate 47. The support plate 47 is fixed to the lower end of the output member 40 by a plurality of bolts 48. The nozzle head holder 7 is supported by this support plate 47, details of which will be described later.

Figure 14:
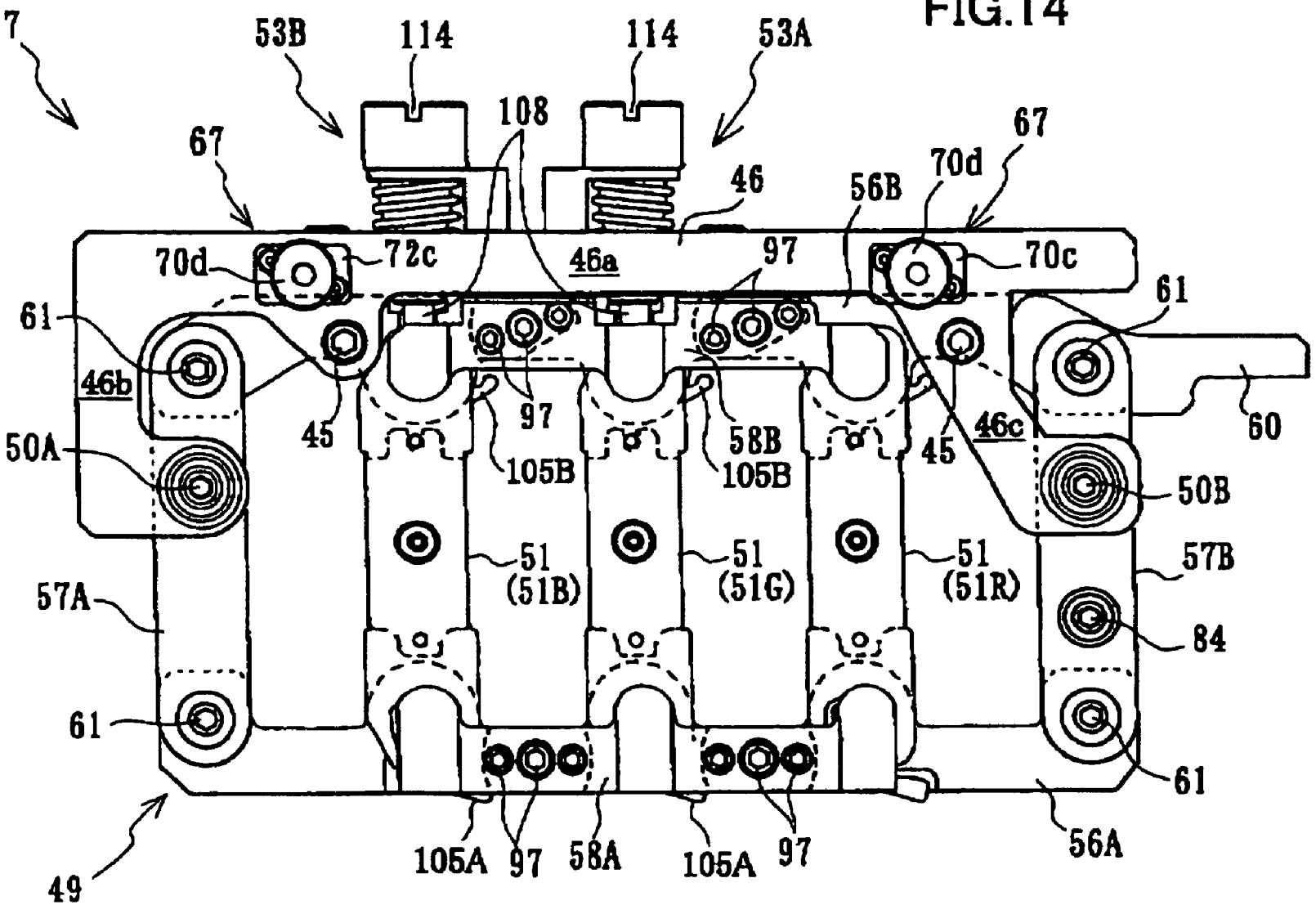
FIG. 14 is a partially cutaway transverse plan view of the nozzle head holder.
Figure 27A:
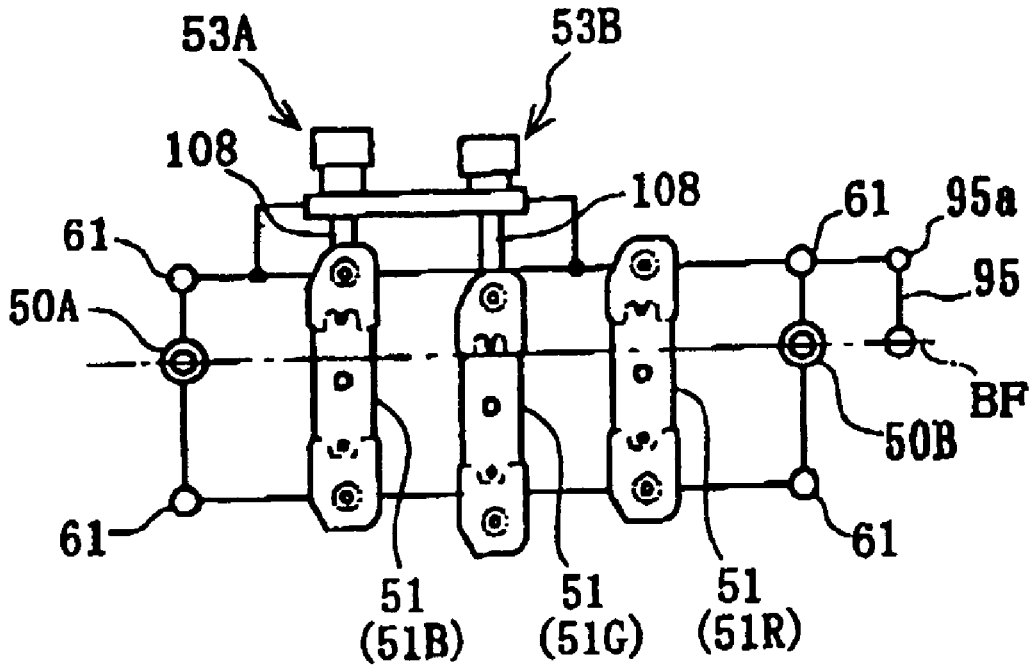
FIG. 27(*a*) is a view of the four-bar linkage and the nozzle heads in an initial position state.
Figure 27B:
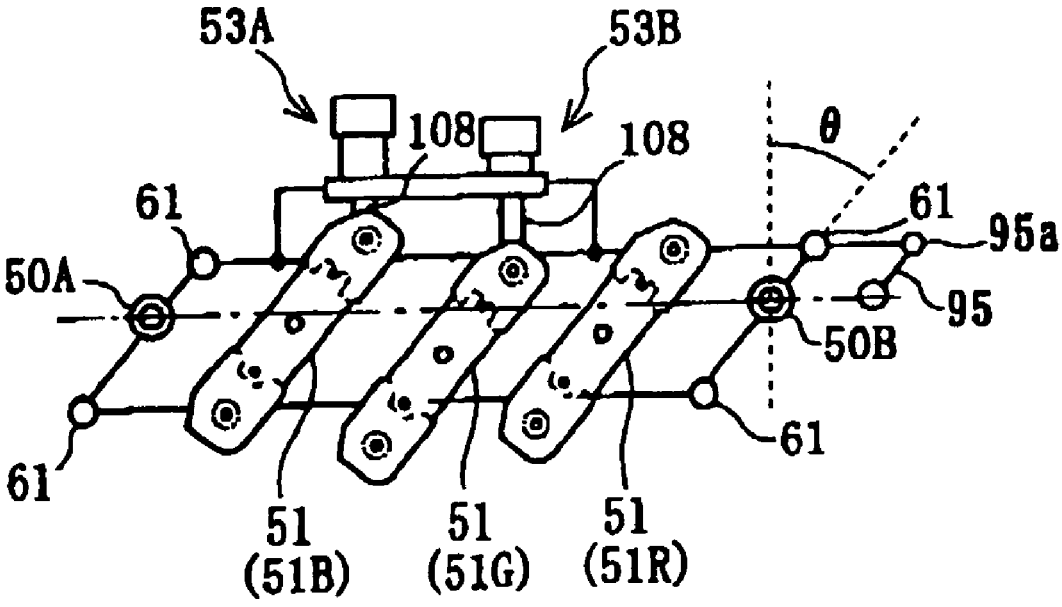

The description now turns to the nozzle head holder 7. The nozzle head holder 7 is provided with a frame member 46 as shown in FIG. 14, a four-bar linkage 49, a pair of rotational pivots 50A and 50B, three head holders 51R, 51G, and 51B, two sets of guide mechanisms 52A and 52B shown in FIG. 19, and movement mechanisms 53A and 53B. As shown in FIGS. 27(*a*) and 27(*b*), the four-bar linkage 49 is configured to be able to rotate about the centers of the rotational pivots 50A and 50B.

Figure 11:
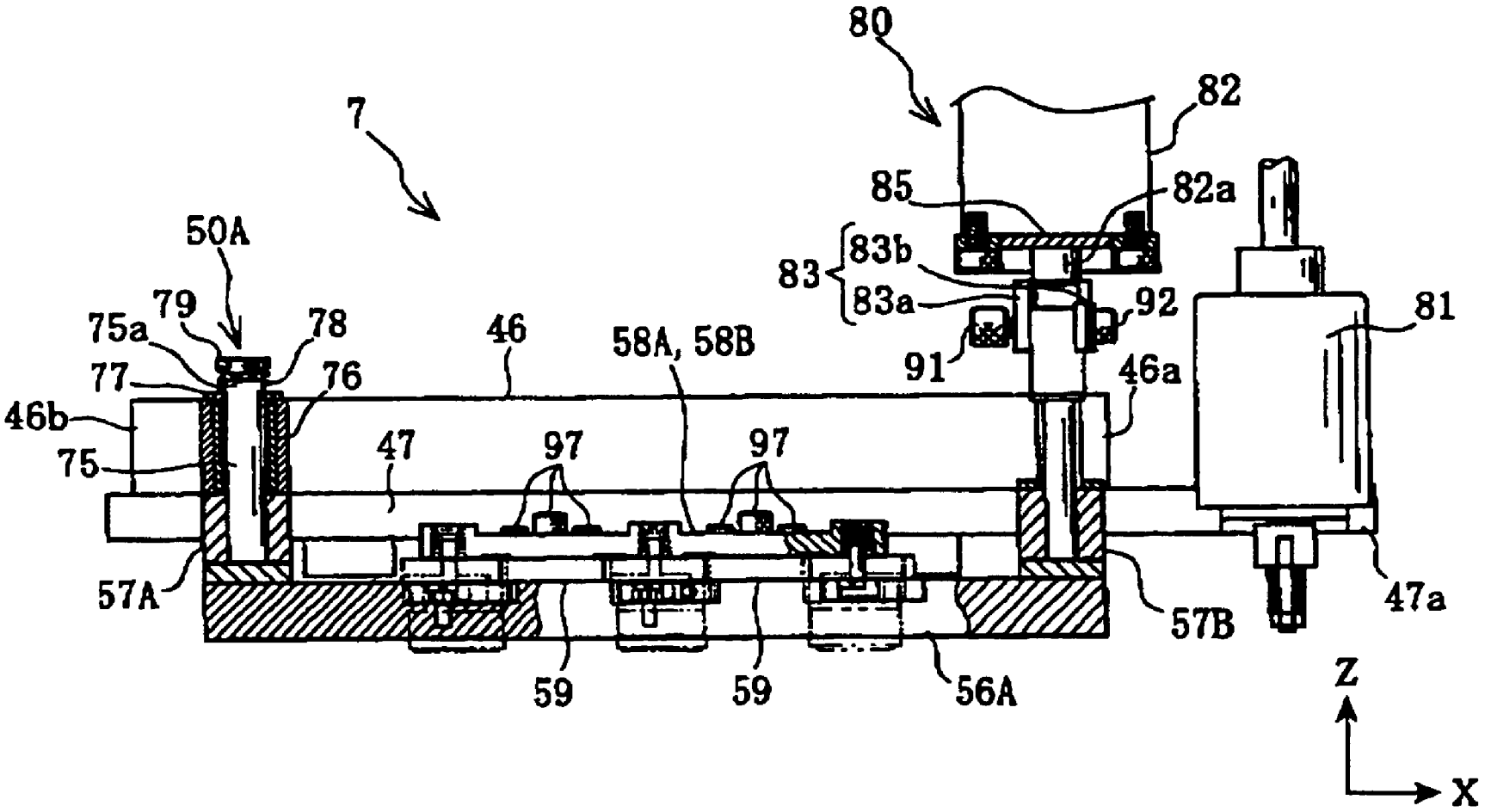
FIG. 11 is an end view (including a partially cutaway longitudinal portion) taken along the line XI-XI of FIG. 7.
Figure 12:
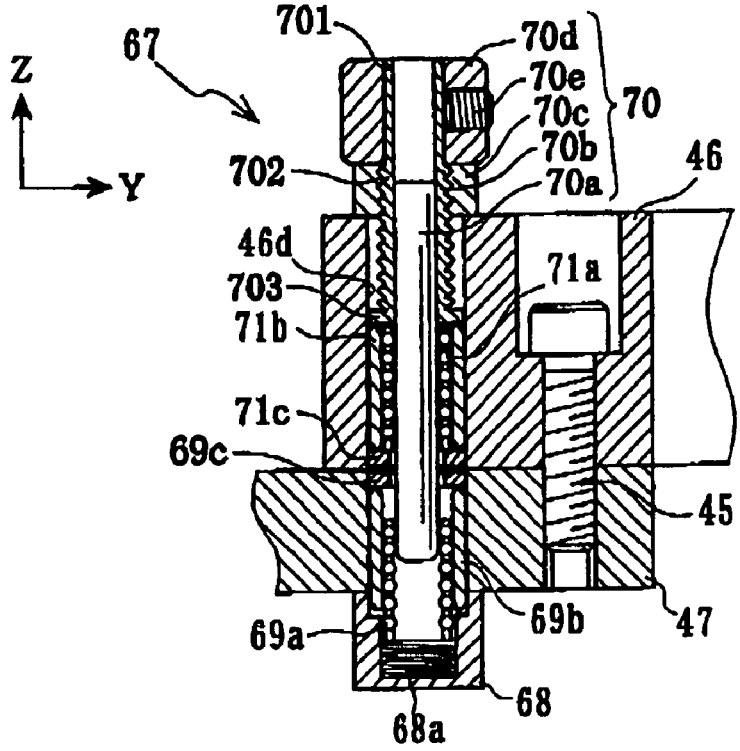
FIG. 12 is a longitudinal section through essential components in a state in which the nozzle head holder is installed on the supporting substrate.
Figure 13:
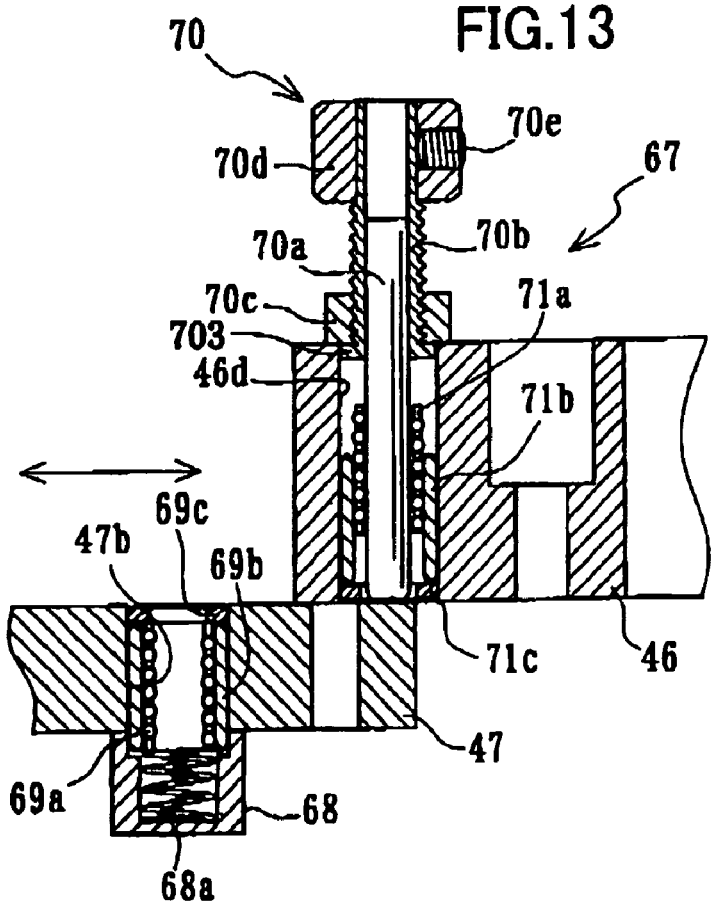
FIG. 13 is a longitudinal section through essential components in a state in which the nozzle head holder is removed from the supporting substrate.

FIGS. 7 to 12 show the state in which the nozzle head holder 7 is mounted on the support plate 47. FIGS. 13 and 14*a* show the state in which the nozzle head holder 7 has been removed from the support plate 47. FIGS. 15 to 18 show the state in which the nozzle head holder 7 has been removed from the support plate 47 and the frame member 46 is omitted.

The various members of the nozzle head holder 7 will now be described in sequence. The description first concerns the frame member 46. As shown in FIG. 14, the frame member 46 has a main portion 46*a* that extends in the lateral direction, a left arm portion 46*b* that extends forward from the left end of the main portion 46*a*, and a right arm portion 46*c* that extends diagonally forward from the right end of the main portion 46*a*. The rotational pivots 50A and 50B are supported on the left arm portion 46*b* and the arm portion 46*c*, respectively.

A pair of attachment linkage mechanisms 67 having a similar configuration are provided on the left and right of a rearward portion of the frame member 46. The attachment linkage mechanisms 67 attach the frame member 46 removably to the support plate 47 of the head assembly attachment stand 25. The configuration of the attachment linkage mechanisms 67 will now be described with reference to FIGS. 12 and 13. As shown in FIG. 12, a through hole 47*b* and a through hole 46*d* are formed in the support plate 47 and the frame member 46, respectively. A ball retainer 69*a*, a bearing bush 69*b*, and a retainer removal prevention ring 69*c* are installed within the through hole 47*b* so as to fit therein. A cylindrical bottomed metal fitting 68 is fixed by means of bolts to a lower end portion corresponding to the through hole 47*b* of the support plate 47. A ball retainer support spring 68*a* is installed to urge the ball retainer 69*a* upward. A ball retainer 71*a*, a bearing bush 71*b*, and a retainer removal prevention ring 71*c* are installed within the through hole 46*d* so as to fit therein.

A pin assembly 70 is configured of a pin member 70*a*, a cylindrical stopper member 70*b* including a male thread, a nut plate 70*c*, a knob 70*d*, and a retainer screw 70*e*. The stopper member 70*b* is attached to the outer periphery of the upper half of the pin member 70*a*. The stopper member 70*b* is provided with a small-diameter portion 701, a male thread portion 702, and a flange-shaped removal prevention portion 703, in that order from the top. The nut plate 70*c* is engaged with the male thread portion. The knob 70*d* is then mounted on the outside of the small-diameter portion, and is fixed thereto by the retainer screw 70*e*. The nut plate 70*c* is finally fixed to the frame member 46.

When the nozzle head holder 7 is to be attached to the support plate 47, the through hole 46*d* of the frame member 46 has been brought into approximate alignment with the through hole 47*b* of the support plate 47. And, the knob 70*d* of the pin assembly 70 is then rotated to insert the pin member 70*a* into the through hole 47*b*. The nozzle head holder 7 is positioned accurately with respect to the support plate 47. At this time, the ball retainer 69*a* moves slightly downward against the resilient force of the ball retainer support spring 68*a*. The nozzle head holder 7 is then fixed to the support plate 47 by a pair of bolts 45. When the nozzle head holder 7 is to be removed from the support plate 47, on the other hand, the pair of bolts 45 is removed, and then the knob 70 is rotated to extract the pin member 70*a* from the through hole 47*b*. Accordingly, the entire nozzle head holder 7 can be slid forward and detached from the support plate 47, as shown in FIG. 13. At this time, the pin assembly 70 is prevented from separating from the frame member 46 by the ball retainer 71 a moving upward and the removal prevention portion 703 coming into contact with the nut plate 70*c*.

Figure 7:
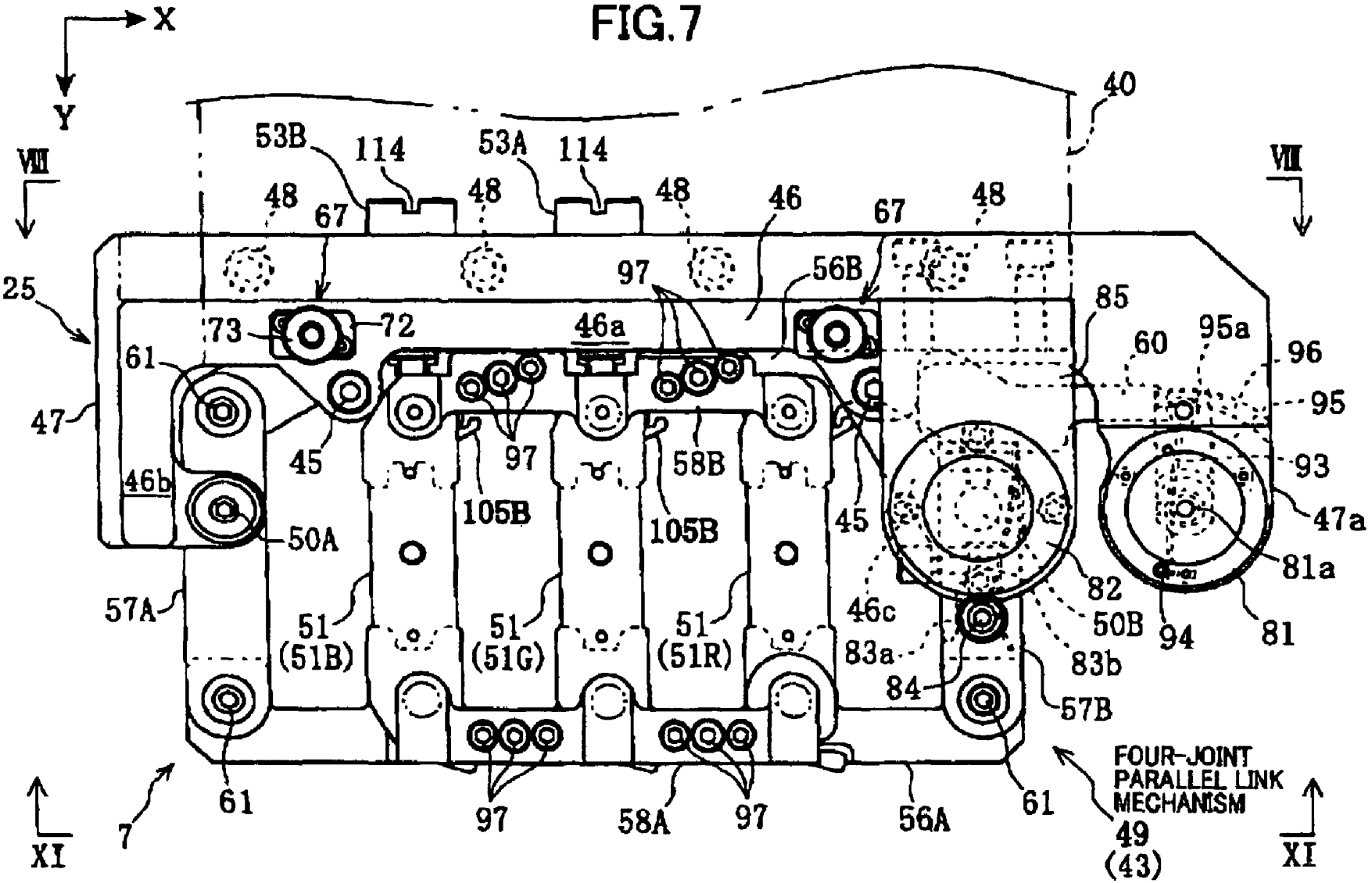
FIG. 7 is a plan view of part of the Z-axis slider, the nozzle head holder, the rotational drive mechanism, and the encoder of the droplet jet patterning device.
Figure 23:
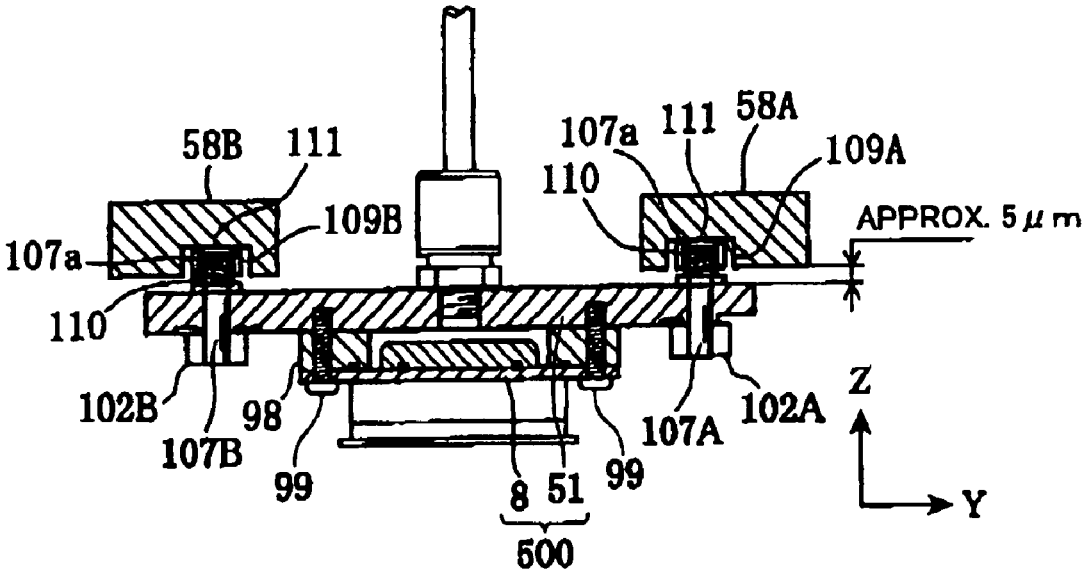
FIG. 23 is a longitudinal sectional side view of essential components of the nozzle head holder.

The description now turns to the head holders 51. As shown in FIG. 7, the head holders 51R, 51G, and 51B are formed to have an elongated shape, and are provided in parallel at a predetermined spacing in the main scanning direction X. The two ends of each of the head holders 51 are supported so as to be able to rotate about a vertical axis by a pair of first link members 56A and 56B. As shown in FIG. 23, corresponding nozzle heads 8 (8R, 8G, and 8B) are fixed by screws 99 through spacers 98 to under surfaces of the head holders 51. These head holders 51, the corresponding nozzle heads 8, and the spacers 98 together configure a head body 500. In an initial setting state, the head holders 51 are disposed parallel to the sub scanning direction Y.

Figures 24, 25:
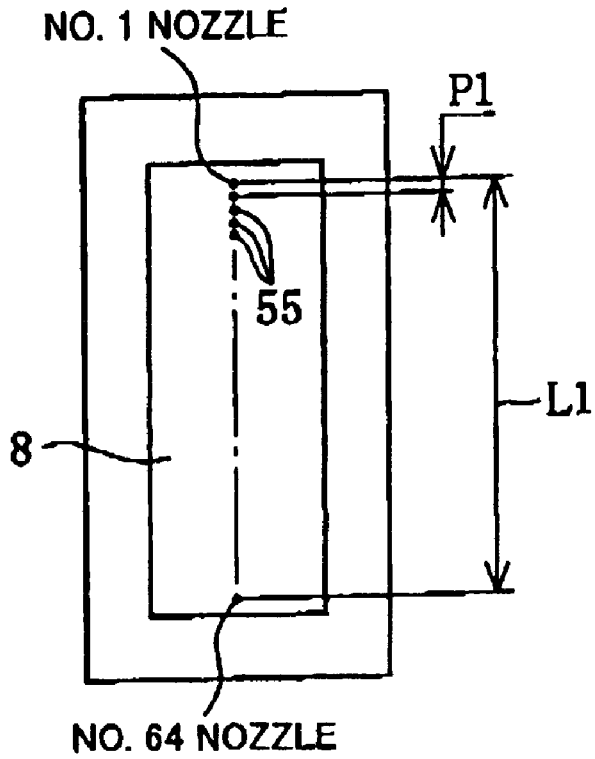
FIG. 24 is an illustration of inter-nozzle dimension errors in the nozzle head.
FIG. 25 is a table showing rankings of inter-nozzle dimension errors and central errors.

The nozzle heads 8R, 8G, and 8B are formed of a solvent-resistant material such as a ceramic material to discharge discharge-liquids for red (R), green (G), and blue (B), respectively. In this embodiment, a solution of an organic substance such as an EL light-emitting organic substance that is dissolved in a solvent is used as the discharge liquid. As shown in FIG. 24, each of the nozzle heads 8 is provided with a number (such as 64) of small-diameter nozzles 55 arrayed in a single row in the longitudinal direction at a predetermined nozzle pitch (such as at 75 dpi). The nozzles 55 of each nozzle head 8 are numbered 1, 2, . . . 64 in sequence from the furthermost end (a base end side). In this embodiment, the No. 1 nozzle 55 of each nozzle head 8 is assigned as a reference nozzle. The nozzle head 8R is assigned as a reference head.

The head holder 51R that acts as the reference head is provided so as to be unable to move in the sub scanning direction Y. The head holders 51B and 51G are each provided so as to be able to move in the sub scanning direction Y. The movement of the head holders 51B and 51G in the sub scanning direction Y is done by the guide mechanisms 52A and 52B and the movement mechanisms 53A and 53B, shown in FIG. 19. These guide mechanisms 52A and 52B and movement mechanisms 53A and 53B will be described later.

The description now turns to the four-bar linkage 49. The four-bar linkage 49 is a rotational mechanism for rotating the head holders 51, that is, the nozzle heads 8, about the reference nozzle of the reference nozzle 8, or a center in the vicinity thereof.

As shown in FIG. 14, the four-bar linkage 49 is provided with the pair of first link members 56A and 56B that extend in the main scanning direction X at the front and the rear at a predetermined spacing and a pair of second link members 57A and 57B that extend in the sub scanning direction Y. A protruding portion 60 is formed on the rear-side first link member 56B to protrude a predetermined length beyond the right-side second link member 57B. The first link members 56A and 56B and the second link members 57A and 57B are coupled together by four connective portions 61, so that the second link members 57A and 57B can rotate about the connective portions 61, vertical axes.

Figure 10:
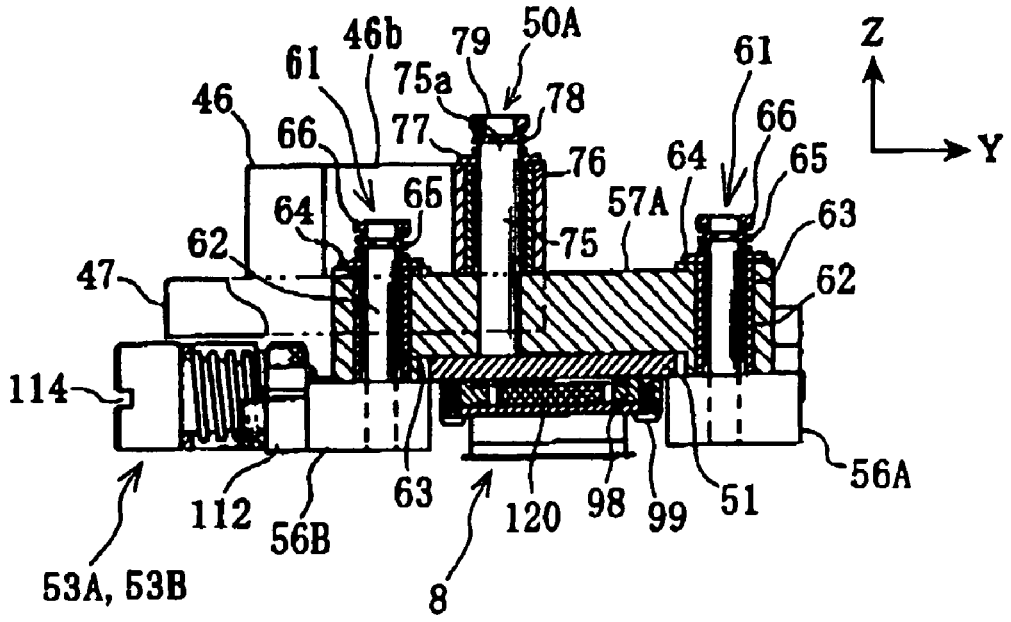
FIG. 10 is a partially cutaway longitudinal left side view of the nozzle head holder.
Figure 17:
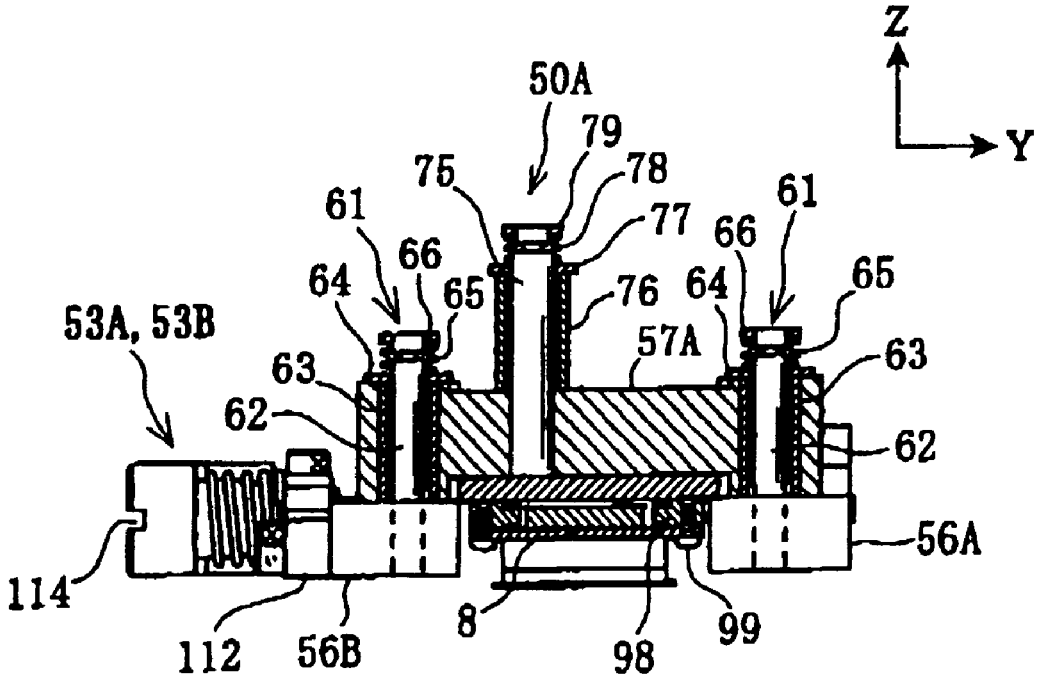
FIG. 17 is another longitudinal sectional side view of the nozzle head holder.

The description now turns to these connective portions 61. Since all four of the connective portions 61 have the same configuration, the description relates to the connective portion 61 that connects the first link member 56A and the second link member 57A. As shown in FIGS. 10 and 17, a pin member 62 is provided to stand on the upper surface of the link member 56A. A ball bearing bush 63 is provided vertically within a through hole formed in an end portion of the second link member 57A. The pin member 62 penetrates through the interior of the ball bearing bush 63 and is prevented from falling out by a washer 64, a coil spring 65, and a hollow bolt 66.

The description now turns to the pair of rotational pivots 50A and 50B. As shown in FIG. 7, the rotational pivots 50A and 50B are rotational pivots for rotating the four-bar linkage 49. Each of the rotational pivots 50A and 50B is positioned at an intermediate part of the second link members 57A and 57B. In this embodiment, the rotational pivots 50A and 50B are provided at positions that are at approximately one-third of the length from the rear end of the second link members 57A and 57B, respectively.

Figure 28:
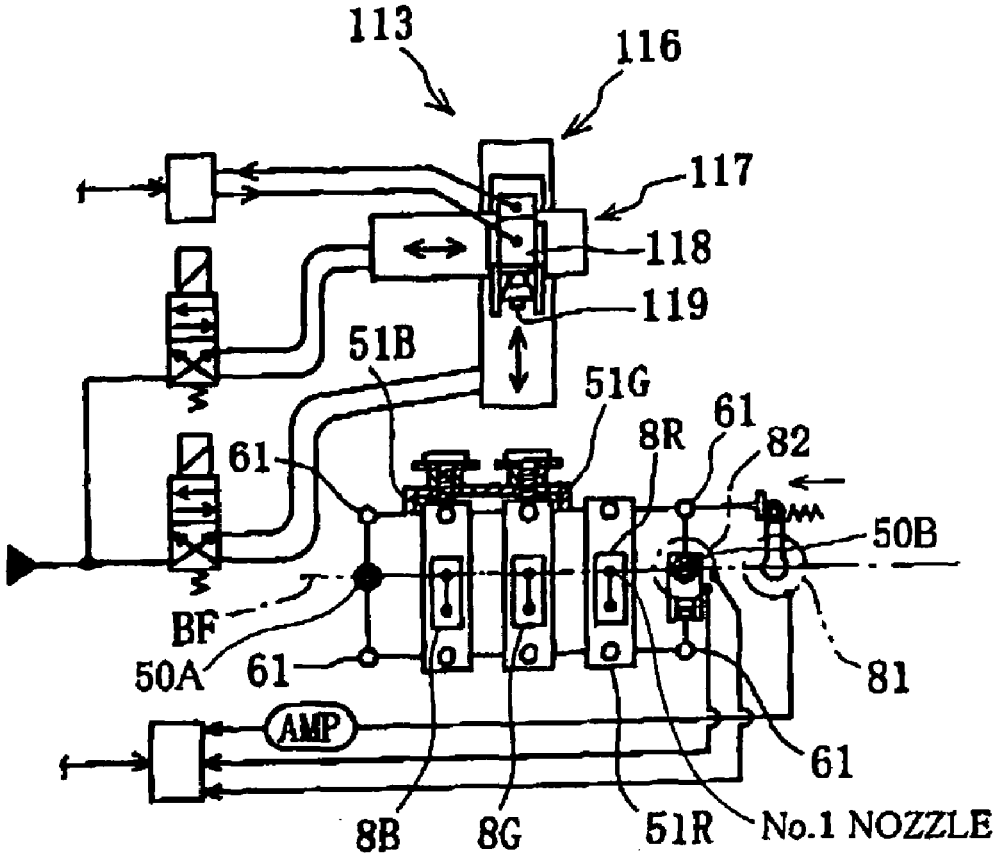
FIG. 28 is an illustration of the configuration of the rotational drive mechanism, the encoder, and the position adjustment drive mechanism.

The reference nozzle (No. 1 nozzle) of the nozzle head 8R is positioned on a line BF that extends in the main scanning direction X through the centers of the pair of rotational pivots 50A and 50B, as shown in FIG. 28. This ensures that the reference nozzle of the reference nozzle head 8R acts as the center of rotation of the reference nozzle 8R. Note that the reference nozzles of the nozzle heads 8G and 8B may be disposed on the line BF, or that they may be displaced a very small distance in the sub scanning direction Y, if necessary.

The description first deals with the rotational pivot 50A. As shown in FIG. 7, the left-side rotational pivot 50A links the second link member 57A to the left arm portion 46*b* of the frame member 46 rotatably. As shown in FIG. 10, a vertical pin member 75 is fixed to stand on the upper surface of the second link member 57A. A ball bearing bush 76 is installed vertically in a tip-end portion of the left arm portion 46*b* of the frame member 46. The pin member 75 penetrates through the ball bearing bush 76 in a tightly fitting state. A washer 77, a coil spring 78, and a hollow bolt 79 are installed on a protruding portion 75*a* of the pin member 75 protruding from the ball bearing bush 76 to prevent the ball bearing bush 76 from falling out from the pin member 75. When the four-bar linkage 49 is to be removed from the frame member 46, the pin member 75 can be removed from the ball bearing bush 76 by removing the hollow bolt 79, the coil spring 78, and the washer 77.

Figure 16:
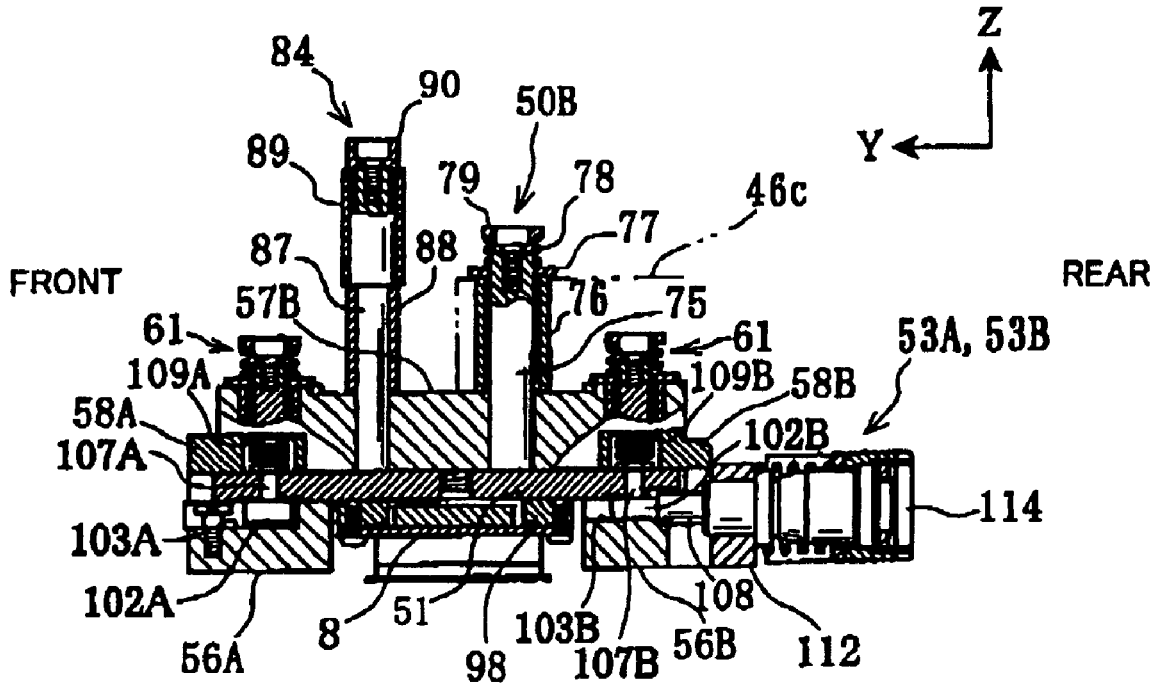
FIG. 16 is a longitudinal sectional side view of the nozzle head holder.

The rotational pivot 50B has the similar configuration to that of the rotational pivot 50A. The rotational pivot 50B links the second link member 57B to the arm portion 46*c* of the frame member 46. As shown in FIGS. 9 and 16, another vertical pin member 75 is fixed to stand on the second link member 57B. Another ball bearing bush 76 is attached to stand upright on a leading end portion of the arm portion 46*c*. The washer 77, coil spring 78, and hollow bolt 79 are installed on a protruding portion of the pin member 75 that penetrates the ball bearing bush 76 in a tightly fitting state.

The description now concerns a rotational drive mechanism 80 shown in FIG. 9. The rotational drive mechanism 80 is designed to exert a rotational moment on the rotational pivot 50B to rotate the four-bar linkage 49 about the rotational pivots 50A and 50B. The rotational drive mechanism 80 has a motor 82 with speed reducer, a lever member 83, a rotational force input shaft 84, and a motor support plate 85. The motor 82 with speed reducer rotates about the same center as the rotational pivot 50B (see FIG. 7). The motor support plate 85 is fixed to the output member 40 of the Z-axis slide mechanism 6. The motor 82 with speed reducer is attached to this motor support plate 85 in an upward-facing attitude.

Figure 8:
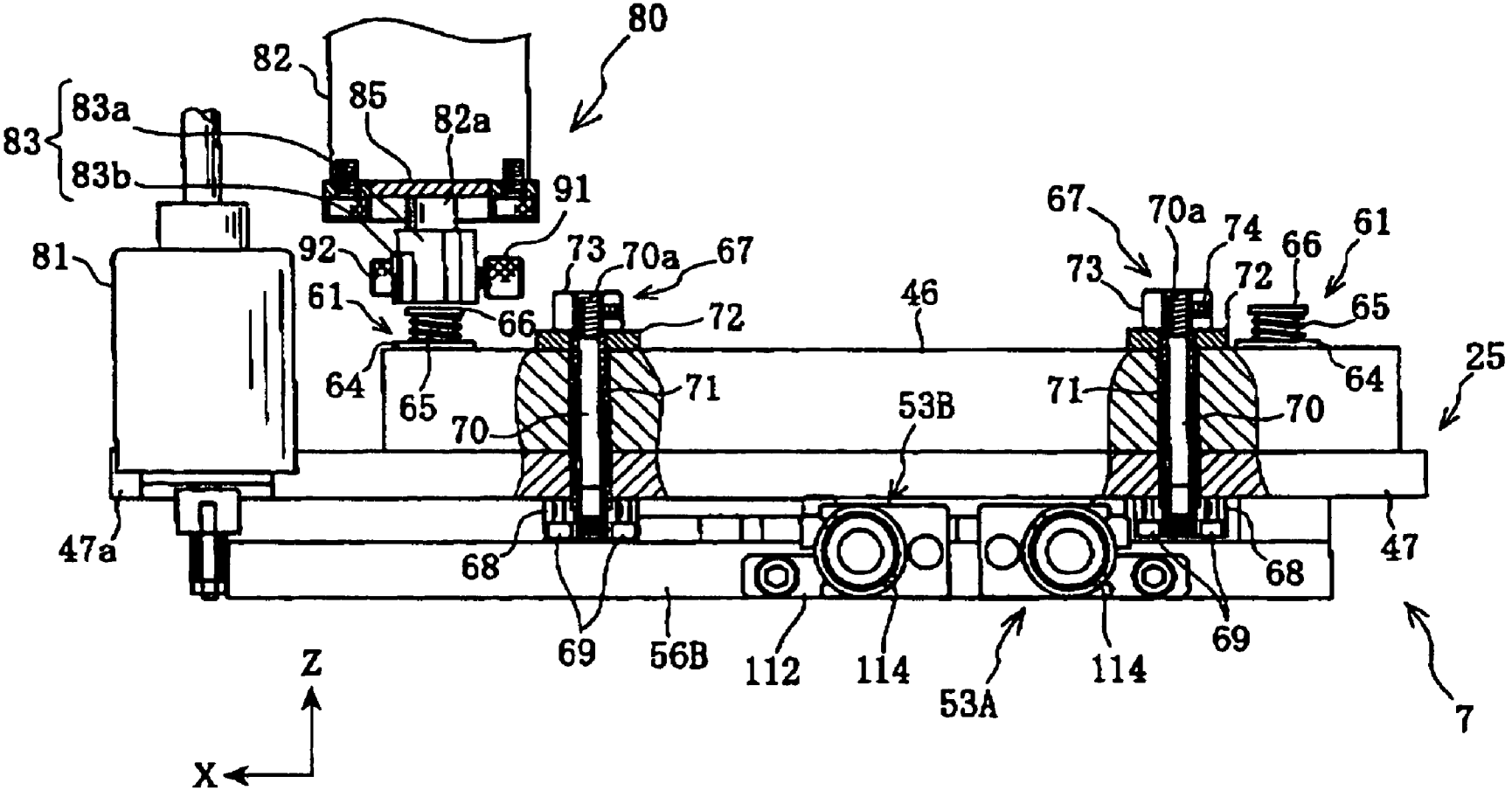
FIG. 8 is a section (partially cutaway) taken along the line VIII-VIII of FIG. 7.
Figure 20:
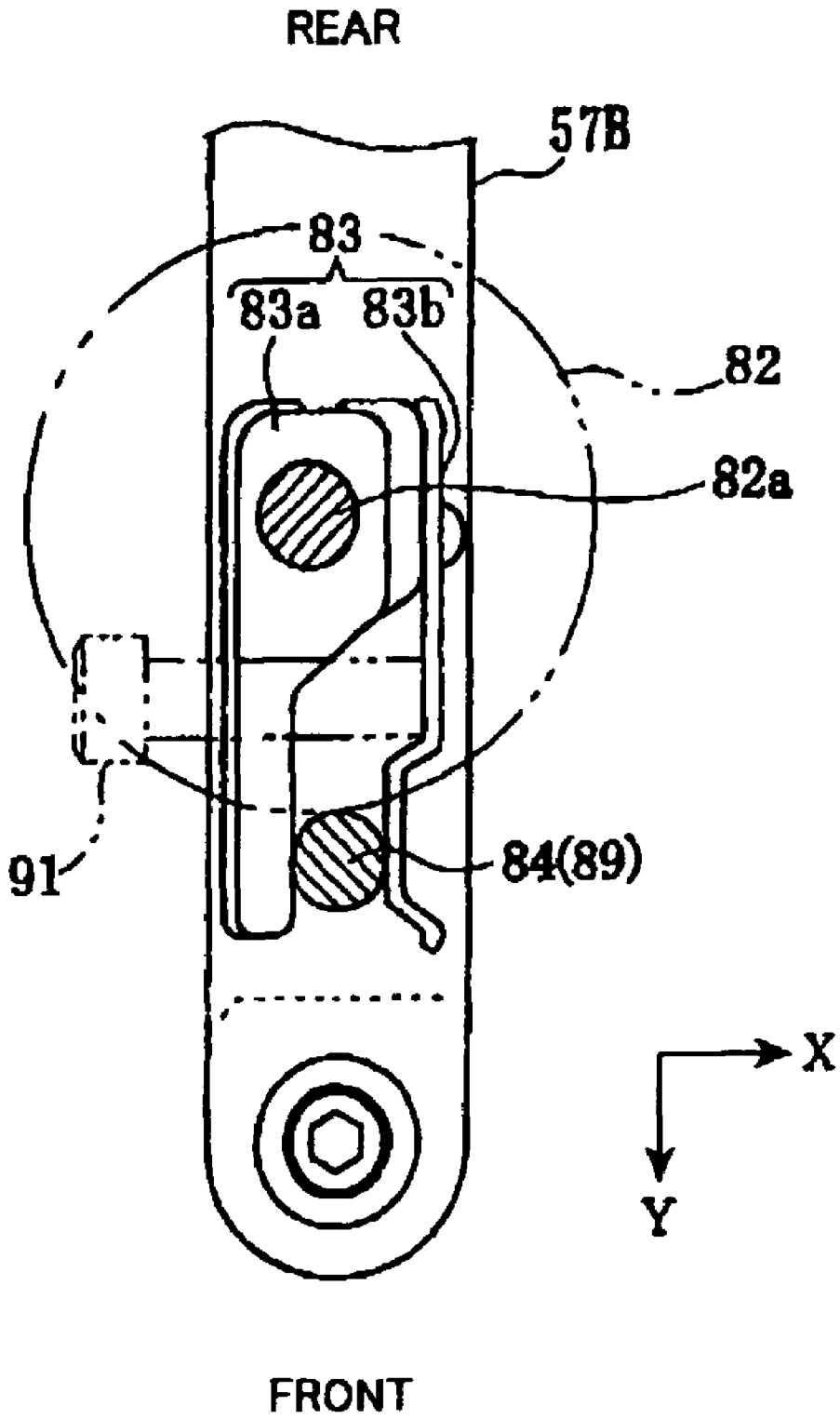
FIG. 20 is a plan view of essential components of the rotational drive mechanism for causing the second link members to rotate.

As shown in FIG. 16, the rotational force input shaft 84 has a pin member 87 that is provided vertically in front of the rotational pivot 50B on the second link member 57B, a spacer 88, a ball bearing bush 89, and a hollow bolt 90. As shown in FIG. 20, the lever member 83 has a main lever body 83*a* and a resilient plate 83*b* that support the ball bearing bush 89 from the left and right sides. As shown in FIGS. 8 and 11, a rear position of the main lever body 83*a is fixed to an output shaft* 82a of the motor 82 with speed reducer by a bolt 91. The resilient plate 83*b* is fixed to the rear portion of the main lever body 83*a* by a bolt 92.

As shown in FIG. 20, when the output shaft 82*a* of the motor 82 with speed reducer rotates, the lever member 83 rotates integrally with the rotational force input shaft 84 about the output shaft 82*a*. In this case, since the rotational force input shaft 84 is fixed to the second link member 57*B* as described previously, the second link member 57B rotates to an angle that is the same rotation angle of the output shaft 82*a* about the output shaft 82*a*. As a result, the second link members 57A and 57B and the three head holders 51 rotate by just the same angle. In this embodiment, the second link members 57A and 57B can be rotated at any desired angle with respect to the sub scanning direction Y, within the range of 0 to 60 degrees.

Figure 19:
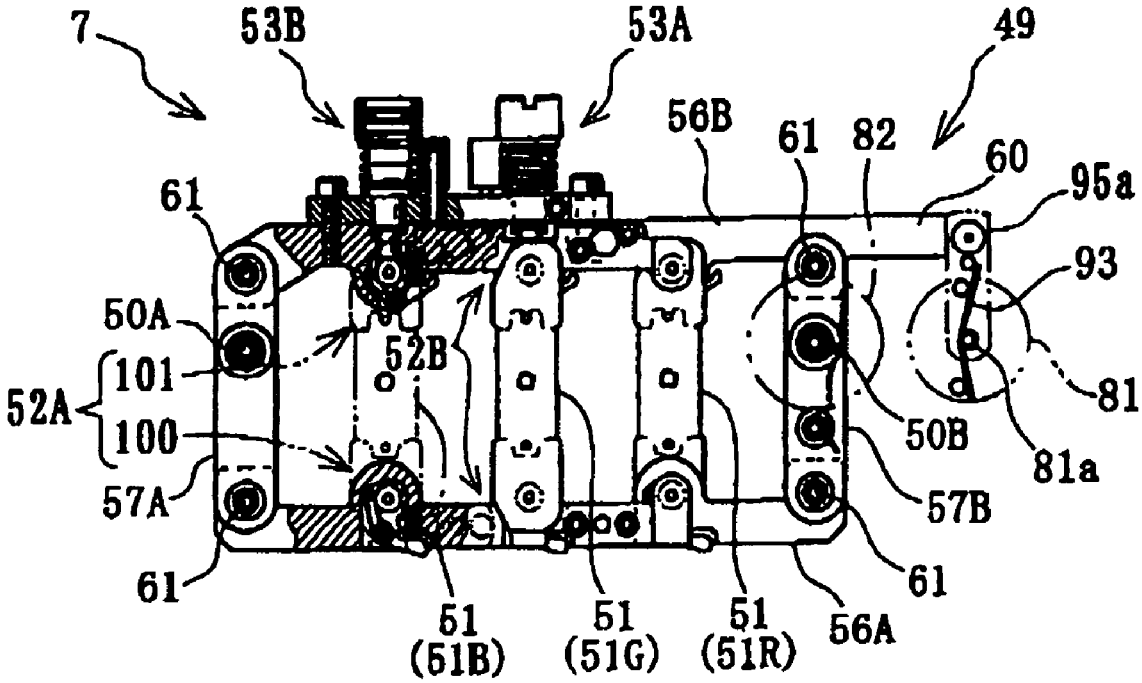
FIG. 19 is a schematic plan view of the nozzle head holder.

The description now turns to an inclination angle detection encoder 81 shown in FIG. 7. The inclination angle detection encoder 81 is a high-resolution rotary encoder to detect the rotational angle θ with respect to the sub scanning direction Y of the four-bar linkage 49 rotated by the rotational drive mechanism 80. As shown in FIG. 7, an input shaft 81*a* of the encoder 81 is fixed in an upward-facing attitude on an extension portion 47*a* of the support plate 47. The axial center of the input shaft 81*a* is positioned on the line BF that links the axial centers of the rotational pivots 50A and 50B. An arm 95 is fixed to the input shaft 81*a*. A roller 95*a* is pivoted about a leading end portion of the arm 95. The arm 95 is pressed resiliently in the counterclockwise direction in FIG. 7 by a resilient member 93 so that the roller 95*a* is resiliently in contact with a right end surface of the protruding portion 60 of the first link member 56B, as shown in FIG. 19. Note that a stopper groove 96 of the support plate 47, denoted by a dot line in FIG. 7, is a stopper groove for holding the arm 95 at a suitable position when the nozzle head holder 7 is removed. The stopper groove 96 is configured to prevent the nozzle head holder 7 from interfering with the arm 95 when the nozzle head holder 7 is attached to the support plate 47.

When the four-bar linkage 49 rotates in the clockwise direction of FIG. 27(*b*) about the rotational pivots 50A and 50B, the first link member 56B moves to the right. Therefore, the arm 95 that extends in the sub scanning direction Y shown in FIG. 27(*a*) in the initial setting state rotates in parallel to the second link members 57A and 57B, as shown in FIG. 27(*b*). This configuration makes it possible to precisely detect the rotational angle θ of the four-bar linkage 49 by using the encoder 81.

Thus, if the motor 82 with speed reducer is controlled by the control device 13 while the detected rotational angle θ is fed back thereto, any desired rotational angle θ can be obtained. The desired rotational angle θ is determined on the basis of a predetermined resolution R for pattern formation, as will be described later.

Figure 21:
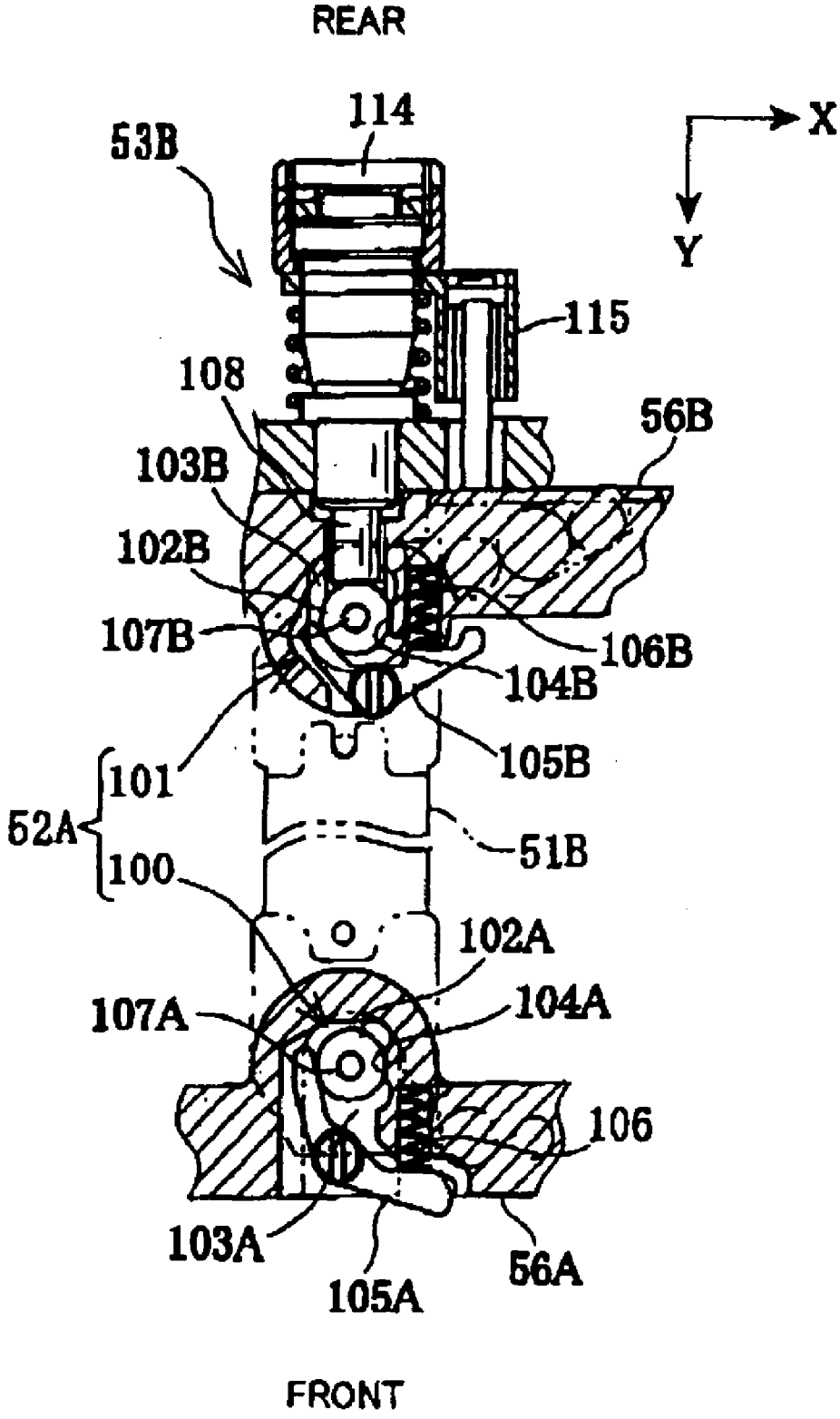
FIG. 21 is a transverse sectional side view of essential components of the guide mechanism and the moving mechanism of the nozzle head holder.

The description now turns to the guide mechanisms 52A and 52B that guide the head holders 51B and 51G in the sub scanning direction Y. It should be noted that since the guide mechanisms 52A and 52B have the same configuration, the description deals only with the guide mechanism 52A, with that of the guide mechanism 52B being omitted. The guide mechanism 52A is designed to support the head holder 51B (nozzle head 8B) to move it parallel to the sub scanning direction Y with respect to the first link members 56A and 56B. The guide mechanism 52A has a front-end guide mechanism 100 and a rear-end guide mechanism 101, as shown in FIG. 21.

The description first deals with the front-end guide mechanism 100. As shown in FIG. 23, a roller member 102A is attached to the lower surface of the head holder 51 so as to rotate about a vertical axis, a support shaft 107A. As shown in FIGS. 16 and 21, a concavity 103A is formed in an upper surface of the link member 56A, with the roller member 102A and a pressure member 105A being accommodated therein. As shown in FIG. 21, a right-side surface of the concavity 103A forms a guide surface 104A. The pressure member 105A is supported in the link member 56A so that the pressure member 105A is able to rotate about a rotational shaft 105*a*. One end of the pressure member 105A is urged by a pressure coil spring 106A to rotate clockwise. The other end of the pressure member 105A is in contact with the roller member 102A, pressing the roller member 102A against the guide surface 104A.

The description now deals with the rear-end guide mechanism 101. The rear-end guide mechanism 101 has a similar configuration to the front-end guide mechanism 100. The rear-end guide mechanism 101 is configured of a roller member 102B, a concavity 103B formed in the first link member 56B, a guide surface 104B of the concavity 103B, a pressure member 105B, and a pressure coil spring 106B, as shown in FIG. 21. The pressure member 105B that is supported rotatably is urged by the pressure coil spring 106B. This structure causes the roller member 102B to be pressed rearwardly and rightwardly against the guide surface 104B, thereby being in contact with the spindle 108.

A pair of roller members 102A and 102B provided at each end of the head holder 51R is engaged in guide holes of the first link members 56A and 56B, respectively, which prohibits the head holder 51R from moving in the sub scanning direction Y.

Figure 15:
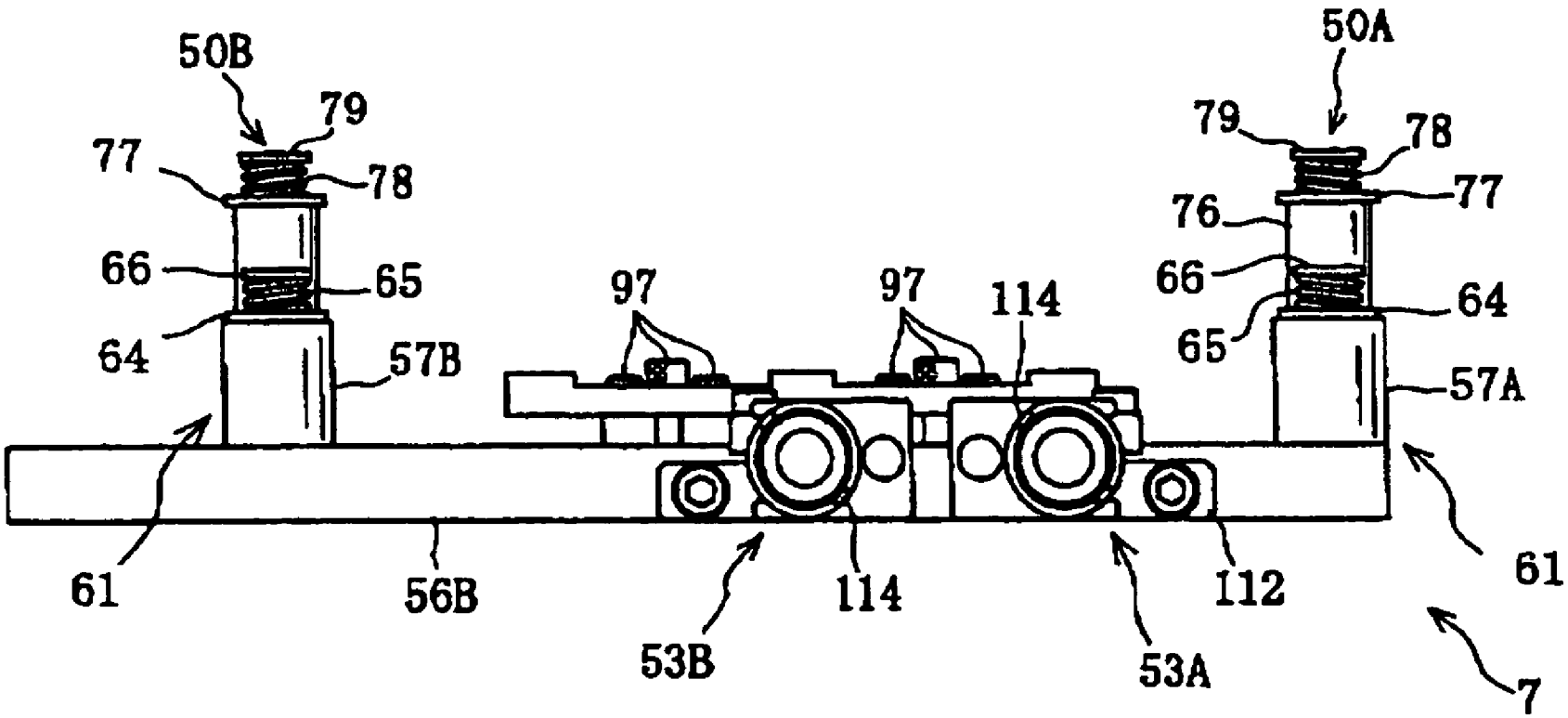
FIG. 15 is a back view of the nozzle head holder.

The description now turns to the movement mechanisms 53A and 53B. The movement mechanisms 53A and 53B are movement mechanisms for moving the head holders 51B and 51G by small distances in the sub scanning direction Y. Since the movement mechanisms 53A and 53B have the same configuration, the description here relates to the movement mechanism 53B alone. As shown in FIG. 15, a bracket 112 is fixed to a rear surface of the first link member 56B. The movement mechanism 53B is attached to the bracket 112. As shown in FIG. 21, the movement mechanism 53B is provided with a spindle 108 provided at a leading end portion thereof, an input portion 114 provided at a rear end portion thereof, and a rotation control portion 115. The spindle 108 protrudes partially into the concavity 103B. The leading end of the spindle 108 is in contact with a roller member 102 from the rear, as is previously described. The rotational force from a position adjustment drive mechanism 113, which will be described later, is received to the input portion 114 so that the input portion 114 rotates.

When the input portion 114 rotates in a predetermined direction, the spindle 108 moves forward. In this case, the roller member 102B moves forward against the pressure coil spring 106B. Simultaneously, the roller member 102A also moves forward in the concavity 103A. Accordingly, the entire head holder 51B moves forward. When the input portion 114 rotates in the opposite direction, on the other hand, the spindle 108 moves rearward so that the roller member 102B is moved rearward to follow the leading end of the spindle 108 by the pressure coil springs 106A and 106B. Thus, the whole of head holder 51B moves rearward. As described above, the spindle 108 can be moved forward and back by the small distance proportional to the rotational angle (ϕ) of the input portion 114 in a predetermined direction corresponding to the rotational direction, so that the position of the head holder 51B can be adjusted in the sub scanning direction Y.

In addition, since the roller members 102A and 102B move forward and rearward along the corresponding guide surfaces 104A and 104B, the head holder 51B can move parallel to the sub scanning direction Y regardless of the rotation of the four-bar linkage 49, as shown in FIGS. 27(*a*) and 27(*b*). Note that the rotation control portion 115 is controlled by friction on the input portion 114, to ensure that the spindle 108 does not rotate freely during printing.

Figure 18:
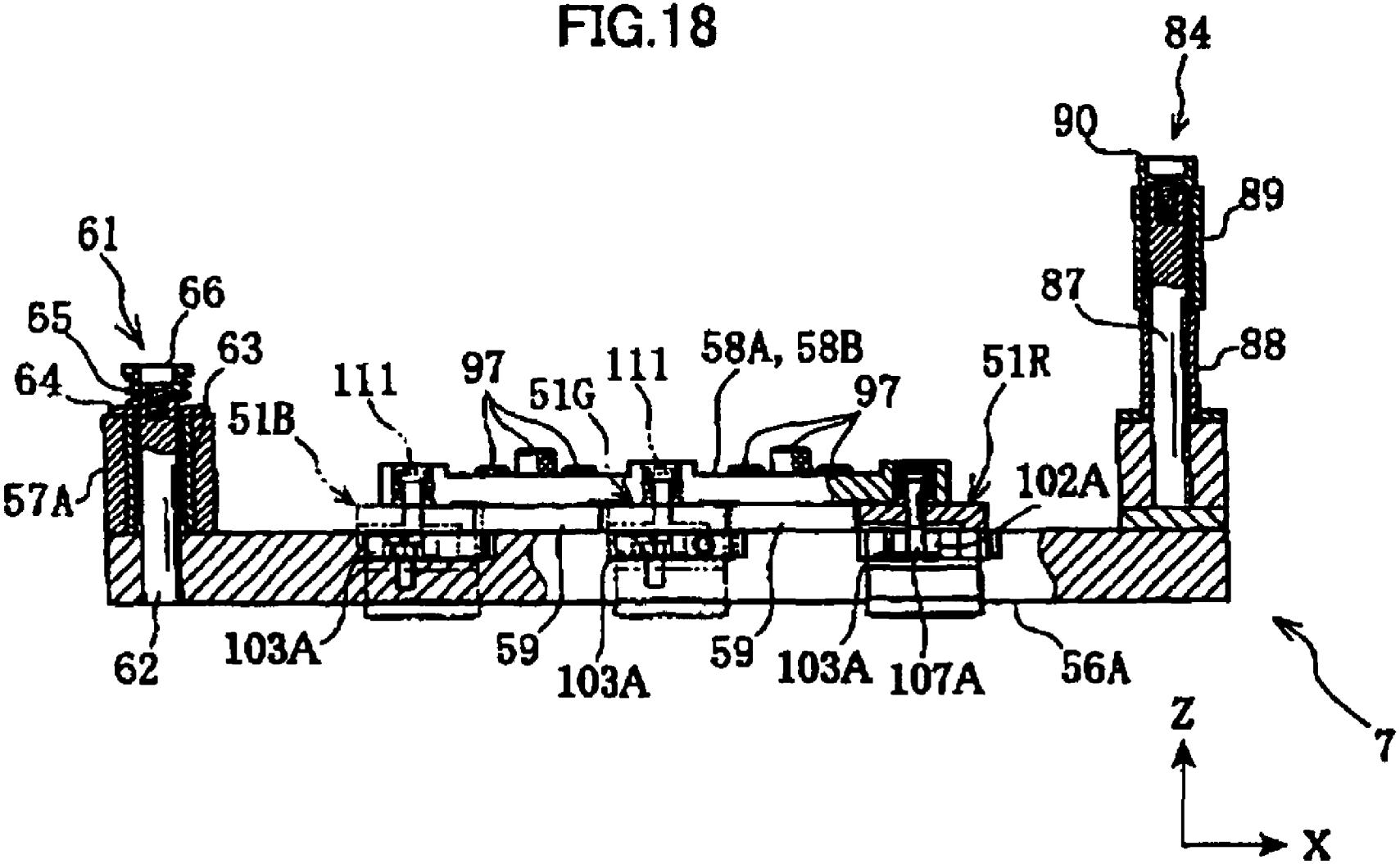
FIG. 18 is a partially cutaway longitudinal front view of the nozzle head holder.

The description now turns to the configuration including the head holder 51, with reference to FIGS. 7, 16, and 18. As shown in FIG. 7, pressing plates 58A and 58B are disposed on the upper surfaces of the three head holders 51, and attached in a removable manner to the first link members 56A and 56B by a plurality of bolts 97. As shown in FIG. 18, spacers 59 are disposed between the pressing plates 58A and 58B and the first link members 56A and 56B and between neighboring head holders 51. Each of the spacers 59 is fixed by a plurality of bolts 97. Since the spacers 59 are formed to be approximately 5 μm thicker than the head holders 51, a gap of approximately 5 μm is formed between the head holders 51 and the pressing plates 58A and 58B, as shown in FIG. 23. This gap allows the two end portions of each head holder 51 to rotate with respect to the pair of first link members 56A and 56B, thereby moving each head holder 51 in the sub scanning direction Y as described above.

Figure 22A:
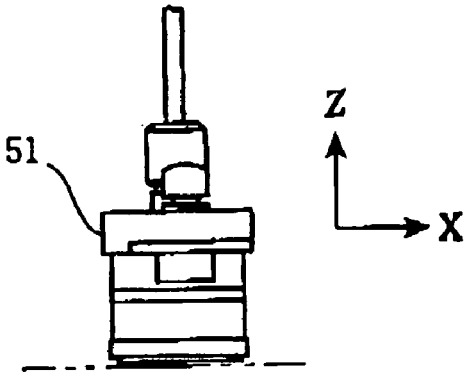
FIG. 22 is a plan view of the head holder.
Figure 22B:
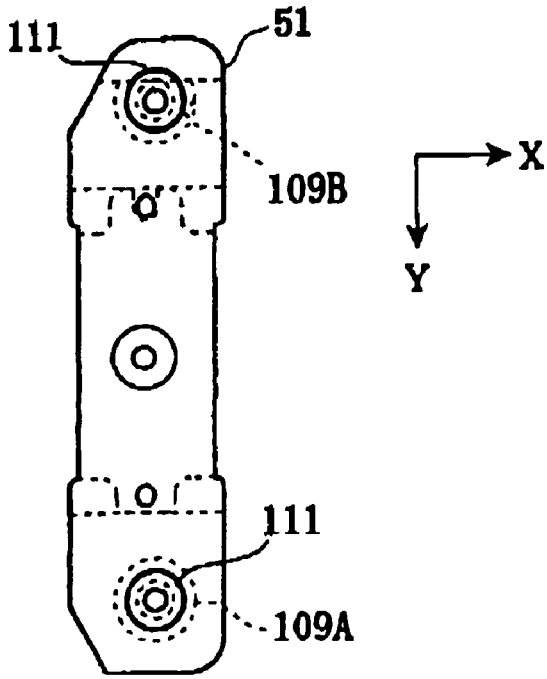

In this case, as shown in FIG. 23, the support shafts 107A and 107B are formed to protrude upward from the upper surface of the head holders 51. Concavities 109A and 109B are formed in the lower surfaces of the pressing plates 58A and 58B. Protruding portions 107*a* of the support shafts 107A and 107B are accommodated in the concavities 109A and 109B. A pressure coil spring 110 and a spring receptacle cap 111 are installed in each protruding portion 107*a* (see FIG. 22). The head holders 51 is urged downward by the force of the pressure coil spring 110. Accordingly, the lower surfaces of the head holders 51 are in contact with upper surfaces of the first link members 56A and 56B. On the other hand, the roller members 102A and 102B are in contact with the base surfaces of the concavities 103A and 103B, as shown in FIG. 16. Thus, the heightwise position of the head holders 51 is set with respect to the first link members 56A and 56B precisely. And the nozzles 55 are positioned in the vertical direction.

The description now turns to the position adjustment drive mechanism 113 that drives the movement mechanisms 53A and 53B. The position adjustment drive mechanism 113 is a mechanism for causing the head holders 51B and 51G to move in the sub scanning direction Y, as described previously. And, the position adjustment drive mechanism 113 is disposed on the rearward side of the aperture portion 14*a* within the second-floor maintenance room 16, as shown in FIGS. 2 and 3.

As shown in FIG. 3, the position adjustment drive mechanism 113 is provided with a Y-direction drive mechanism 116 including an air cylinder, an X-direction drive mechanism 117 including an air cylinder, and a servomotor 118. The Y-direction drive mechanism 116 is designed to drive the X-direction drive mechanism 117 to move in the sub scanning direction Y. The X-direction drive mechanism 117 is designed to drive the servomotor 118 to move in the X direction. The servomotor 118 has an output portion 119 that is disposed facing forward. The output portion 119 is designed to transfer the motor drive force to the input portion 114 of the movement mechanisms 53A and 53B. The parallel movement in the sub scanning direction Y of the head holders 51B and 51G by the position adjustment drive mechanism 113 is described below.

First of all, after the Z-axis slide mechanism 6 has been used to set the nozzle head holder 7 in the inspection/adjustment position UP, the servomotor 118 is made to move laterally to adjust the position of the output portion 119 to be concentric with the input portion 114 of the movement mechanisms 53A or 53B. The Y-direction drive mechanism 116 is then used to move the servomotor 118 forward to engage the output portion 119 with the input portion 114. The input portion 114 is rotated by the transfer of motor drive force to the input portion 114 through the output portion 119, to cause the head holders 51B and 51G to move in the sub scanning direction Y in the previously described manner.

Figure 29A:
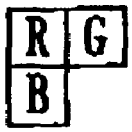
FIG. 29(*a*) is an illustration of an example of the disposition of R, G, and B dots.
Figure 29B:
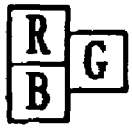
Figure 29C:
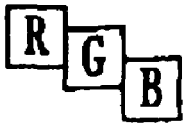

Examples of the dispositions of R, G, and B dots that form one group of pixels in the EL light-emitting layer are shown in FIGS. 29(*a*) to 29(*c*). In one example shown in FIG. 29(*a*), either one of the G dot or the B dot is shifted in the sub scanning direction Y with respect to the R dot. In other examples shown in FIGS. 29(*b*) and 29(*c*), both of the G dot and the B dot are shifted in the sub scanning direction Y with respect to the R dot. These dot dispositions can be obtained by positional adjustment of the head holders 51B and 51G independently in the sub scanning direction Y, as described above.

The description now turns to the second-floor maintenance room 16 and the devices in the interior thereof. In the maintenance room 16, the discharge state of the plurality of nozzles 55 of the nozzle heads 8R, 8G, and 8B are inspected by a discharge inspection mechanism 121. Maintenance of the nozzle head holder 7 itself is done.

The maintenance room 16 has dimensions such as 1500×1500×700 mm. In the maintenance room 16, most of the Z-axis slide mechanism 6, the position adjustment drive mechanism 113, part of the automatic alignment adjustment mechanism 36, and the inspection/adjustment device 9 are disposed. The inspection/adjustment device 9 is a device for inspecting and maintaining the nozzle heads 8 of the head holders 51. The inspection/adjustment device 9 is provided with a head maintenance mechanism 123 and the discharge inspection mechanism 121, as shown in FIG. 2.

The head maintenance mechanism 123 is provided slightly forward of the aperture portion 14*a* in the maintenance room 16.

Figure 34:
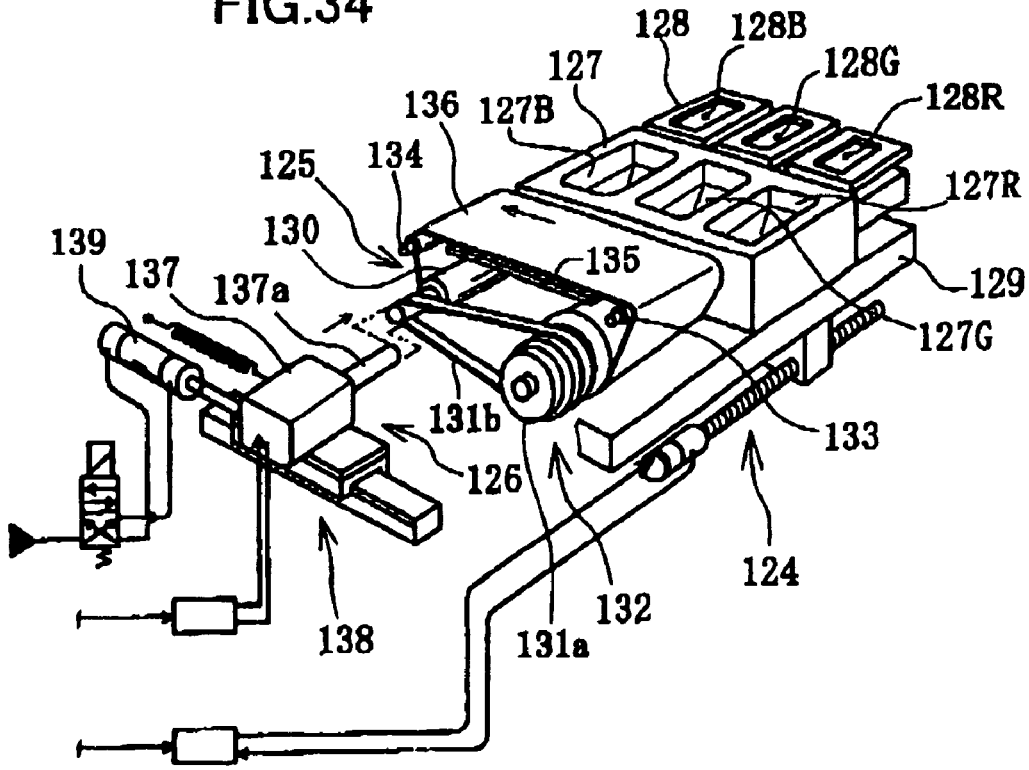
FIG. 34 is a perspective view of the head maintenance mechanism.

The head maintenance mechanism 123 has an electric cylinder 124, a blotting paper feed mechanism 125, a paper feed drive mechanism 126, a pressurized purge tray 127, a rubber pad 128 for capping, and a movable table 129, as shown in FIG. 34

The blotting paper feed mechanism 125, the tray 127, and the rubber pad 128 are supported integrally on the movable table 129. The electric cylinder 124 causes the movable table 129 to be driven to move in the sub scanning direction Y, thereby disposing the blotting paper feed mechanism 125, the tray 127, or the rubber pad 128 selectively under the nozzle heads 8 at the inspection/adjustment position UP.

The blotting paper feed mechanism 125 is designed to perform a wiping processing provided in printing, for blotting up droplets remaining on the nozzle surfaces of the nozzle heads 8 with blotting paper 136 to return the meniscuses of the nozzles 55 into a normal condition after a pressurized purge, which will be described later. The blotting paper feed mechanism 125 is provided with a drive roller 130, a back-tension mechanism 132, follower rollers 133 and 134, and a support plate 135. The drive roller 130 is a drive roller of a one-way clutch type that is driven by the paper feed drive mechanism 126. The back-tension mechanism 132 is provided with a follower roller 131*a* and a belt 131*b*. The belt 131*b* is mounted between the drive roller 130 and the follower roller 131*a*. The blotting paper 136 is provided on the follower roller 131*a*. The blotting paper 136 is wound around the drive roller 130 via the follower rollers 133 and 134 by rotating the drive roller 130. At this time, a constant tension is applied to the blotting paper 136 in the direction opposite to the winding direction, by the back-tension mechanism 132.

The paper feed drive mechanism 126 is provided with a servomotor 137, an X-direction slide mechanism 138, and an air cylinder 139 for slide driving. A rubber piece (not shown in the figure) having a high coefficient of friction is fixed around an output shaft 137*a* of the servomotor 137. The X-direction slide mechanism 138 supports the servomotor 137 in a freely sliding manner in the main scanning direction X. The air cylinder 139 for slide driving is designed to drive the output shaft 137*a* of the servomotor 137 to move between a predetermined drive force transfer position and a non-transfer position.

The electric cylinder 124 drives the movable table 129 to a predetermined blotting paper winding position. Simultaneously, the air cylinder 139 for slide driving switches the output shaft 137*a* of the servomotor 137 to the drive force transfer position. The rotational drive force of the servomotor 137 is transferred to the input shaft of the drive roller 130 to feed the blotting paper 136 in the direction indicated by the arrow in FIG. 34.

The pressurized purge tray 127 is provided with three concavities 127B, 127G, and 127R. The nozzle heads 8 are moved with respect to the pressurized purge tray 127 to face these concavities 127B, 127G, and 127R from above. The nozzles 55 are cleaned by supplying a flushing liquid 11 to each of the nozzle heads 8B, 8G, and 8R and discharging the liquid from the nozzles to the concavities 127B, 127G, and 127R. During discharge inspection, discharge from the nozzles 55 is done for each nozzle head 8. This configuration makes it possible to recover the droplets that are discharged from the nozzle heads 8 into the concavities 127B, 127G, and 127R without spattering of the surroundings, during the discharge inspection by the discharge inspection mechanism 121.

The rubber pad 128 for capping has three rubber pads 128B, 128G, and 128R. The nozzle heads 8B, 8G, and 8R are capped by the corresponding rubber pads 128B, 128G, and 128R, to prevent the nozzles 55 from drying out while the droplet jet patterning device 1 is suspended.

The description now turns to the discharge inspection mechanism 121. As shown in FIG. 2, the discharge inspection mechanism 121 is disposed within the second-floor maintenance room 16 at symmetrical positions on the left and right sides of the aperture portion 14*a* in the vicinity of the head maintenance mechanism 123.

Figure 30:
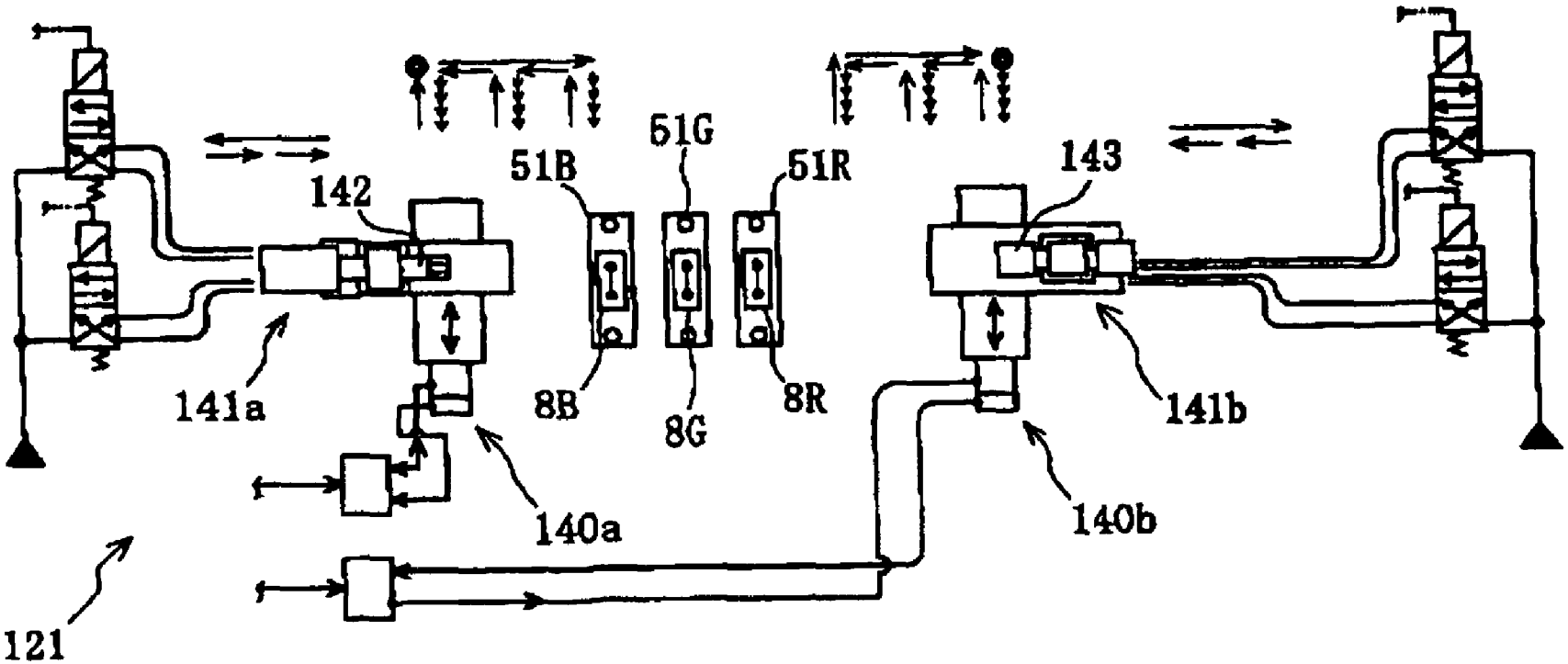
FIG. 30 is a block diagram of the configuration of the discharge inspection mechanism.

As shown in FIGS. 3 and 30, the discharge inspection mechanism 121 has imaging position switching mechanisms 141*a* and 141*b*, a CCD camera 142 for imaging the discharge state of the droplets, and a strobe floodlight 143 for lighting the CCD camera 142.

The CCD camera 142 is disposed on the left side and the strobe floodlight 143 is disposed on the right side. The imaging position switching mechanism 141*a* is provided with a Y-direction drive mechanism 140*a* for moving the CCD camera 142 in the sub scanning direction Y and upper and lower two-stage air cylinders 144 for moving the CCD camera 142 in two stages in the main scanning direction X. The imaging position switching mechanism 141*b* is provided with a Y-direction drive mechanism 140*b* for moving the strobe floodlight 143 in the sub scanning direction Y and upper and lower two-stage air cylinders 144 similar to the cylinders 144 described above.

The description now turns to details of the discharge inspection method. The inspection of the discharge status of the three nozzle heads 8B, 8G, and 8R is done for each of the nozzle heads 8. Since 64 nozzles 55 are formed in each of the nozzle heads 8, the discharge inspection is done for each group of nozzles, such as one group having 16 nozzles, one group having as nozzles No. 1 to No. 16, another group having nozzles No. 17 to No. 32. In other words, the CCD camera 142 and the strobe floodlight 143 are set at initial positions in the sub scanning direction Y. And the discharge status of the first group of nozzles No. 1 to No. 16 is then examined. Subsequently, the CCD camera 142 and the strobe floodlight 143 are moved forward by the Y-direction drive mechanisms 140*a* and 140*b* by the distance of 16 nozzles, to inspect the discharge status of the second group of nozzles No. 17 to No. 32. The discharge of the third and fourth groups of nozzles is then tested in a similar manner.

To ensure that the discharge inspection of the nozzles 55 of the nozzle heads 8R, 8G, and 8B is done under the same conditions during this time, the distance between the CCD camera 142 and the strobe floodlight 143 is always kept constant and also the droplets are discharged and imaged at an intermediate position between the CCD camera 142 and the strobe floodlight 143. For that reason, the positions of the CCD camera 142 and the strobe floodlight 143 can be switched in three stages in the main scanning direction X dependently on the one of the three nozzle heads 8R, 8G, and 8B that is being inspected. This position switching is described below.

That is to say, when the nozzle head 8R is inspected, the two-stage air cylinders 144 of the left-side imaging position switching mechanism 141*a* are extended to the maximum limit, and the two-stage air cylinders 144 of the right-side imaging position switching mechanism 141*b* are at the most compressed. When the nozzle head 8G is inspected, one of the two-stage air cylinders 144 of the left-side imaging position switching mechanism 141*a* is contracted, and one of the two-stage air cylinders 144 of the right-side imaging position switching mechanism 141*b* is extended. In addition, when the nozzle head 8B is inspected, the two-stage air cylinders 144 of the left-side imaging position switching mechanism 141*a* are most contracted, and the two-stage air cylinders 144 of the right-hand imaging position switching mechanism 141*b* are extended to the maximum limit.

Since the Y-direction drive mechanisms 140*a* and 140*b* and the imaging position switching mechanisms 141*a* and 141*b* are provided, and the CCD camera 142 and the strobe floodlight 143 can move in each of the main scanning direction X and the sub scanning direction Y in this manner, discharge from a plurality of the nozzles 55 of the plurality of nozzle heads 8 can be implemented sequentially and reliably. Since the imaging can be done in a state in which the relative positions of the CCD camera 142 and the strobe floodlight 143 with respect to the nozzle heads 8 to be inspected are always kept constant, the reliability of the discharge detection can be increased.

Figure 31:
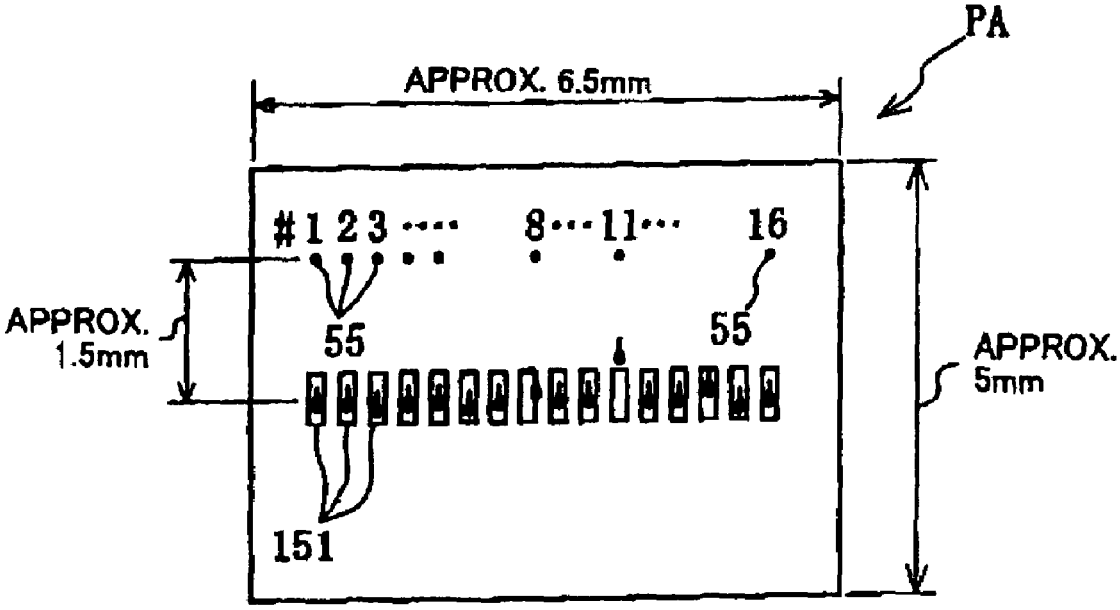
FIG. 31 is an illustration of the CCD imaging area in the CCD camera used for discharge inspection.
Figure 32:
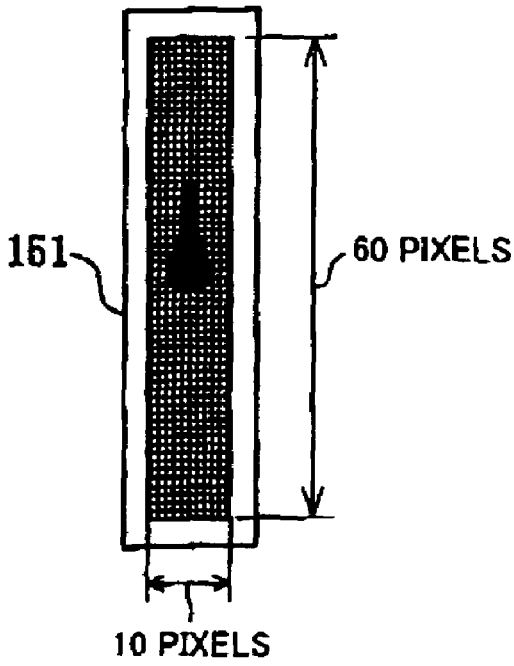
FIG. 32 is an illustration of an image of droplets and an observation window of FIG. 31.

The description now turns to the discharge inspection technique that determines the quality of the discharge of the nozzles 55. As shown in FIG. 31, 16 observation windows 151 corresponding to 16 nozzles 55 are set at a constant spacing in the sub scanning direction Y within a picture area PA (of approximately 6.5 mm×5 mm) of the CCD camera 142. Each of the observation windows 151 is set to a position approximately 1.5 mm downward from the lower end of the corresponding nozzle 55. The observation window 151 has a rectangular shape of 60 pixels long and 10 pixels wide, as shown in FIG. 32.

Droplets are discharged at a speed of approximately 7 m/s, by way of example, from each of the 16 nozzles 55 of the nozzle group being inspected, and the droplets are imaged through the observation windows 151. Assume that the shutter speed of the CCD camera 142 is approximately 1/10,000 second. The strobe emission time is approximately 1 μsec. The captured image signals are supplied to the control device 13 and are then processed by a predetermined image processing program. In this image processing, the status is determined to be normal if most of the droplets from the nozzle heads 8 are within the observation windows 151, and abnormal if not, by way of example. In the example shown in FIG. 31, the droplets from nozzles No. 1 to No. 7, No. 9, No. 10, and No. 12 to No. 16 are within the observation windows 151. The droplets from nozzles No. 8 and No. 11, on the other hand, are outside the observation windows 151. Factors such as abnormal discharge speed, failed discharge, or accumulation of foreign bodies (mainly temporary adhesion of EL polymers) are considered as causes of discharge abnormality.

In this manner, the droplets discharged from a plurality of the nozzles 55 are imaged by the CCD camera 142, and the quality of discharged can be determined in a simple manner by processing and determining the image data. Since this determination can be done automatically by the control device 13 acting as an image processing means for inspection, the discharge inspection can be performed efficiently.

Since this discharge inspection can be done with the nozzle head holder 7 being raising it to the inspection/adjustment position UP, remaining installed on the output member 40 of the Z-axis slide mechanism 6, the discharge inspection can be implemented during suspended period within the process of discharge recording on the glass substrate 4. For that reason, the operating efficiency of the droplet jet patterning device 1 can be increased even further.

The description now turns to control over the discharge recording of the R, G, and B dot patterns on the glass substrate 4 at various recording resolutions. Note that this control is done by a host control unit 173 of the control device 13 (see FIG. 38).

Figure 36:
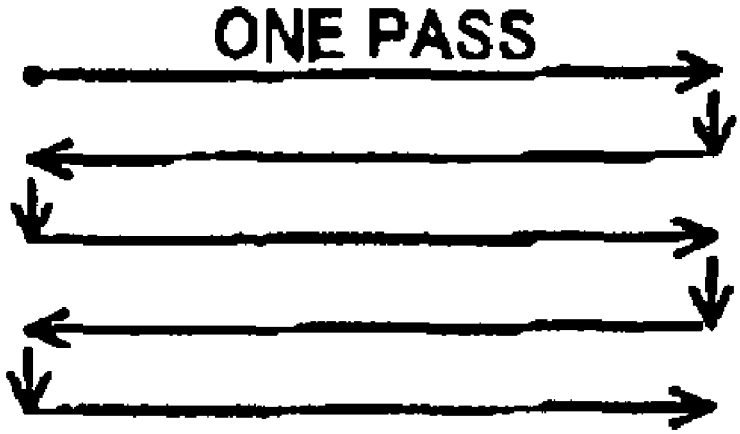
FIG. 36 is an illustration of movement paths for forming a pattern by causing the nozzle heads to move one pass at a time.
Figure 37:
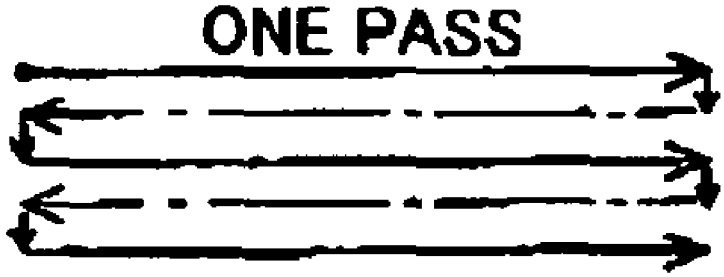
FIG. 37 is an illustration of movement paths for forming a pattern by moving the nozzle heads in an interlaced manner.

Since the nozzle pitch of the nozzle heads 8 is 75 dpi, as mentioned previously, the nozzle pitch (distance between nozzles) P is given by: $P=(25.4/75)$ mm. If the three head holders 51 are rotated by the angle θ together with the second link members 57A and 57B, the nozzle pitch Pθ in the sub scanning direction Y is given by: $P\theta=P\times\cos\theta$. If the angle θ is varied within the range of 0 to 60 degrees, it is possible to decrease the nozzle pitch continuously within the range of $P\times(1.0)$ to $P\times(0.5)$. Specific examples of resolution setting are described below.

a) For Resolutions from 75 to 150 dpi (see FIGS. 35 and 36):

The rotation angle θ of the nozzle heads 8 to an angle that gives the desired dpi in the sub scanning direction Y, within the range of 0 to 60 degrees is set. And the glass substrate 4 is moved backward (in the direction opposite to the sub scanning direction Y) by a distance of just {64×P×cos θ} for each pass of discharge recording in the main scanning direction X. For 75 dpi, θ is 0 degrees, and for 150 dpi, 0 is 60 degrees, by way of example.

b) For Resolutions from 150 to 300 dpi (see FIG. 37):

Discharge recording at a resolution of 150 dpi can be achieved by interlaced discharge recording by which the head holder 51 is displaced by just half the pitch after discharge recording at a resolution of 75 dpi, as shown by the broken lines in the figure. The rotation angle θ of the nozzle heads 8 is set to an angle that achieves a dpi that is half the desired dpi in the sub scanning direction Y, within the range of 0 to 60 degrees, in the same way as described above. After one pass of discharge recording in the main scanning direction X, the glass substrate 4 is moved minutely by 0.5×P×cos θ rearward and another one pass of discharge recording is done. And then the glass substrate 4 is moved rearward by just 63.5×P×cos θ. For 150 dpi, for example, θ=0°, and for 300 dpi, θ=60°.

c) For Resolutions from 37.5 to 75 dpi:

The rotation angle θ of the nozzle heads 8 is set to an angle that gives a dpi that is twice the desired dpi in the sub scanning direction Y, within the range of 0 to 60 degrees. And the odd-numbered nozzles No. 1, No. 3, No. 5, . . . are used for one pass of discharge recording in the main scanning direction X, and then the substrate is stepped rearward by 64×P×cos θ. For 37.5 dpi, for example, θ=0°, and for 75 dpi, θ=60°.

In this manner, the rotation angle θ of the nozzle heads 8 is controlled within the range of 0 to 60 degrees by the rotational drive mechanism 80, based on an arbitrary discharge resolution. Note that more detailed application of interlacing makes it possible to perform discharge recording at 225 to 450 dpi, or 300 to 600 dpi, or any other resolution.

The description now turns to correction control for correcting differences in nozzle pitch of the nozzle heads 8 by the rotation angle θ. This control is implemented by the host control unit 173 of the control device 13. Correction control is done on the basis of the ranking of the nozzle heads 8, so the description first concerns the ranks of the nozzle heads 8.

As shown in FIG. 24, if the actual dimension between the nozzles at the front and rear ends of the nozzle heads 8 is L1 and the theoretical dimension between nozzles is L0, the error therebetween ΔL is given by: ΔL=(L1−L0). Thus, if the number of nozzles is n, the nozzle pitch error ΔP is given by: ΔP=ΔL(n−1). In general, it is rare to have a plurality of nozzle heads 8 with nozzle pitch errors ΔP that are all the same. In the manufacturing process of the droplet jet patterning device 1, the actual inter-nozzle dimension L1 is measured for a large number of nozzle heads 8 that have been prepared previously, and five-stage rankings such as rank 1, 2, . . . 5 are assigned to the nozzle heads 8 on that basis of the measured dimension, as shown in FIG. 25. When the three nozzle heads 8R, 8G, and 8B installed in one nozzle head holder 7 are configured of nozzle heads 8 of the same rank, the nozzle pitch errors ΔP in the plurality of nozzle heads 8 are approximated. In addition, assigning such rankings to the nozzle heads 8 also facilitates management of a large number of nozzle heads 8.

The description now turns to specific details of the correction control for correcting the rotational angle θ in accordance with the ranking of the nozzle heads 8. If the nozzle pitch between adjacent nozzles (set theoretical value) is P0 and the number of nozzles is n, L0 is expressed by: L0=P0×(n−1). The nozzle pitch (actual measured value) P1 can be expressed as follows, using the actual inter-nozzle dimension L1, the theoretical inter-nozzle dimension L0, and the number n of nozzles:

$$\begin{aligned} P1 &= L1/(n-1) = (\Delta L + L0)/(n-1) \\ &= \{\Delta L + P0 \times (n-1)\}/(n-1) \\ &= \Delta L/(n-1) + P0 \end{aligned}$$

If the resolution in the sub scanning direction Y of the recording pattern is R and the rotational angle θ is used, the apparent nozzle pitch PY as seen in the sub scanning direction Y is given by: PY=P1×cos θ. Thus following relationship holds:

$$\begin{aligned} PY &= 25.4/R \\ &= P1 \times \cos\theta \\ &= [\Delta L/(n-1) + P0] \times \cos\theta \end{aligned}$$

$$\theta = \cos^{-1}(25.4/R)/[\Delta L/(n-1) + P0]$$

In other words, it is theoretically possible to calculate the rotational angle θ based on the resolution R. However, a desired resolution R cannot be obtained from the above equations because of the nozzle pitch error ΔP. In this case, an addition rotation by the angle Δθ corresponding to the nozzle pitch error ΔP makes it possible to substantially remove errors in the discharge recording caused by the nozzle pitch error ΔP, and increase the precision with which the pattern is formed. In other words, the nozzle pitch error ΔP can be corrected to achieve the desired resolution R by increasing the rotational angle θ if the nozzle pitch error ΔP has a positive value, or decreasing the rotational angle θ if the nozzle pitch error ΔP has a negative value.

Thus, if the resolution R and the nozzle pitch error ΔP are obtained, it is possible to calculate the actual rotational angle θ'(θ+Δθ). The angle Δθ of this embodiment is obtained by using the central error (+10, +5, 0, −5, or −10 μm) for each rank, as shown in FIG. 25. Obtaining the central error from the angle Δθ generally enables accurate correction. Since nozzle heads 8 having the same ranking are used in this embodiment, it is possible to increase the correction precision of the rotational angle θ. Note that the central error is the value between the upper limit and the lower limit of the inter-nozzle dimension error ΔL for each rank. If the nozzle pitch errors ΔP of the plurality of nozzle heads 8 are all the same, the nozzle pitch errors ΔP itself can be used directly instead of the central value, in the method of calculating the angle Δθ.

Note that when the rotational angle θ is calculated, a correction processing program that uses the corresponding central error from the central errors for ranks 1 to 5 for correcting the rotational angle θ can be stored in the control device 13 beforehand. It should be noted that the nozzle pitch error between adjacent nozzles (in other words, the value of the inter-nozzle dimension error ΔL divided by the number of spaces between the nozzles) may be used instead of the inter-nozzle dimension error ΔL.

The above equations enable the nozzle pitch error ΔP to be cancelled by rotating the rotational angle θ, within a range that satisfies the condition 0≦θ≦60°, in other words, 0.5≦cos θ≦1. It should be noted, however, that the original θ=0° ought to be valid when P1×cos θ=25.4/R=P0. However, if the actual inter-nozzle dimension L1 is shorter, P1≦P0 and cos θ≧1, so that P1×cos θ=25.4/R=P0 cannot be satisfied. In addition, the original θ=60° ought to be valid when 25.4/R=P0/2. However, if the actual inter-nozzle dimension L1 is longer, P0≦P1 and cos θ≦0.5, so that 25.4/R=P0/2=P1×cos θ cannot be satisfied. In such a case, the discharge recording can be done by returning the rotational angle θ to 0° and inserting an interlace stage (pass).

Figure 26:
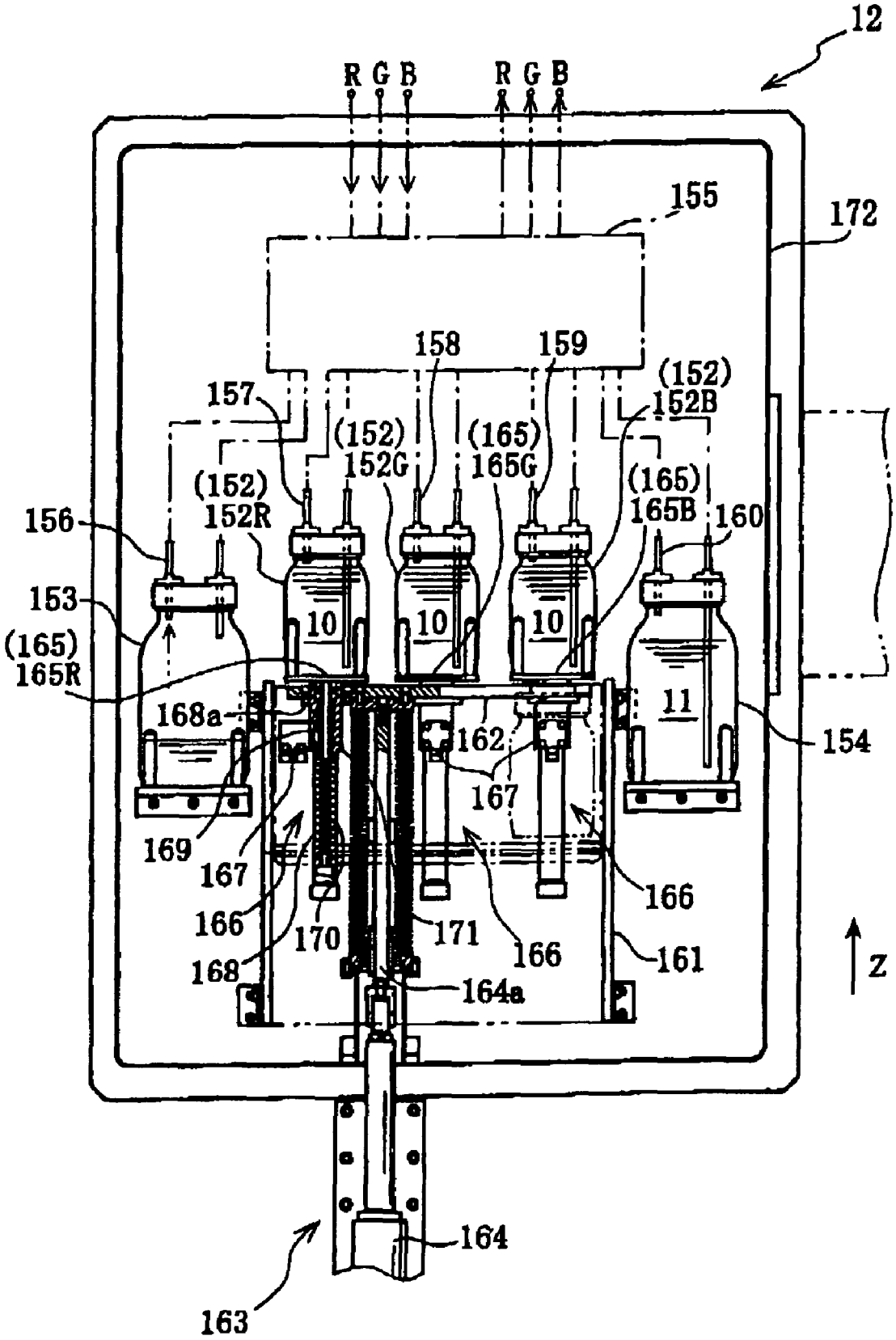
FIG. 26 is a side view of the liquid supply mechanism.

The description now turns to the liquid supply mechanism 12. As shown in FIG. 2, the liquid supply mechanism 12 is provided on a side surface of the casing 3. As shown in FIG. 26, the liquid supply mechanism 12 is provided with three liquid containers 152R, 152G, and 152B, a waste liquid recovery container 153, and a washing solvent container 154. All of these are accommodated in a glove box 172 and can be replaced through a hatch (not shown in the figure).

Discharge liquids 10 in R, G, or B for forming EL light-emitting layers in three colors are accommodated in the liquid containers 152R, 152G, and 152B, respectively. The discharge liquids 10 within the liquid containers 152R, 152G, and 152B are supplied to each of the nozzle heads 8R, 8G, and 8B through a valve unit 155 and is then discharged as droplets from the plurality of nozzles 55. Note that the liquid containers 152R, 152G, and 152B are raised and lowered in linkage with the raising and lowering of the Z-axis slide mechanism 6, as will be described later.

A washing solvent (flushing liquid) 11 that is used for washing the nozzle heads 8 is accommodated in the washing solvent container 154. When the nozzle heads 8 are washed, the flushing liquid 11 is supplied from the washing solvent container 154 through the valve unit 155 to the nozzle heads 8R, 8G, and 8B, to perform a pressurized purge from the plurality of nozzles 55. This pressurized purge is performed by the previously described head maintenance mechanism 123. In other words, tubes (not shown in the figures) are connected to the concavities 127B, 127G, and 127R of the pressurized purge tray 127 shown in FIG. 34, and waste liquid is sucked through the tubes by negative pressure. The thus-recovered waste liquid is recovered into the waste liquid recovery container 153 through the valve unit 155 shown in FIG. 26. Note that this negative pressure is generated by using a vacuum pump or ejector (not shown in the figures) and the exhaust thereof is released into an organic exhaust duct of the equipment.

A tube 156 is connected to the waste liquid recovery container 153, and the waste liquid recovery container 153 is connected to a mist separation tank outside the figure through the tube 156. The liquid containers 152R, 152G, and 152B and the washing solvent container 154 are connected through tubes 157, 158, 159, and 160 and the valve unit 155 to a compressed nitrogen gas line, respectively.

The description now turns to the mechanism by which the liquid containers 152R, 152G, and 152B are raised and lowered in linkage with the raising and lowering of the Z-axis slide mechanism 6. As shown in FIG. 26, the liquid supply mechanism 12 is further provided with a support frame 161, a movable frame (support stand) 162, a liquid container elevator mechanism 163, and three liquid surface position maintenance mechanisms 166. The movable frame 162 is attached to the support frame 161 in a vertically movable manner. The liquid container elevator mechanism 163 has an electric cylinder 164 with a metal bellows. A tip end of the rod 164*a* of the electric cylinder 164 is connected to the movable frame 162. The raising and lowering of the electric cylinder 164 is linked to the raising and lowering of the Z-axis slide mechanism 6, with the movable frame 162 moving up and down along the support frame 161. This keeps the height relationship between the movable frame 162 and the nozzle heads 8R, 8G, and 8B constant.

The liquid surface position maintenance mechanisms 166 follow the consumption of liquid in the liquid containers 152R, 152G, and 152B and are designed to ensure that the height of the liquid surface within each of the liquid containers 152R, 152G, and 152B is kept at a reference height that is a predetermined distance (such as 50 mm) lower than the position of the nozzles 55. As shown in FIG. 26, each of the liquid surface position maintenance mechanisms 166 is provided with a cylindrical casing 168 that is disposed vertically, a shaft-shaped member 169, a compression coil spring 170 that acts as a resilient member, a sleeve 171, and a holder 165R, 165G, and 165B for holding the corresponding liquid container 152R, 152G, and 152B.

A flange 168*a* is formed at an upper end portion of the casing 168, so that the flange 168*a* is linked removably to the movable frame 162. The shaft-shaped member 169 is attached integrally to the interior of the casing 168 and an upper end portion thereof is linked to the corresponding holder 165. The sleeve 171 is formed of a ball-spline and is forced into the casing 168. The compression coil spring 170 is inserted in an annular space surrounded by the casing 168, the shaft-shaped member 169, and the sleeve 171 to support the liquid container 152 and the holder 165 resiliently. According to this configuration, when the liquid level drops due to the liquid consumption, the weight of the liquid in the liquid container 152 falls by an equivalent amount, the corresponding liquid holder 165 and liquid container 152 are raised upward by the resilient force of the compression coil spring 170 by an amount corresponding to that lightening, and the liquid level is corrected to a constant heightwise position with respect to the nozzle heads 8.

Configuring the liquid container elevator mechanism 163 in that manner stabilizes the liquid pressure in the nozzle heads 8, even when the head portion 43 is raised or lowered. This configuration can reliably prevent leakage of liquid from the nozzle heads 8 and reverse-flow of the liquid within the nozzle heads 8, and also stabilize the discharge of droplets. Furthermore, since it isn't necessary to provide liquid-level sensors, a simple construction can be simplified.

A locking mechanism 167 is also provided for each of the liquid surface position maintenance mechanisms 166. The locking mechanism 167 is a mechanism for ensuring there is no vertical motion in the liquid container 152 and the holder 165 due to the resilience of the compression coil spring 170 during the vertical motion of the movable frame 162. Each of the liquid surface position maintenance mechanisms 166 has a small air cylinder having a rod (not shown in the figures) and a locking pad fixed to the tip end portion of the rod, with the main body of the air cylinder being fixed laterally to a side wall in the upper half of the casing 168. The tip end portion of the rod penetrates into the interior of the casing 168 so that the shaft-shaped member 169 can be pressed by the locking pad in order to be locked.

Figure 39:
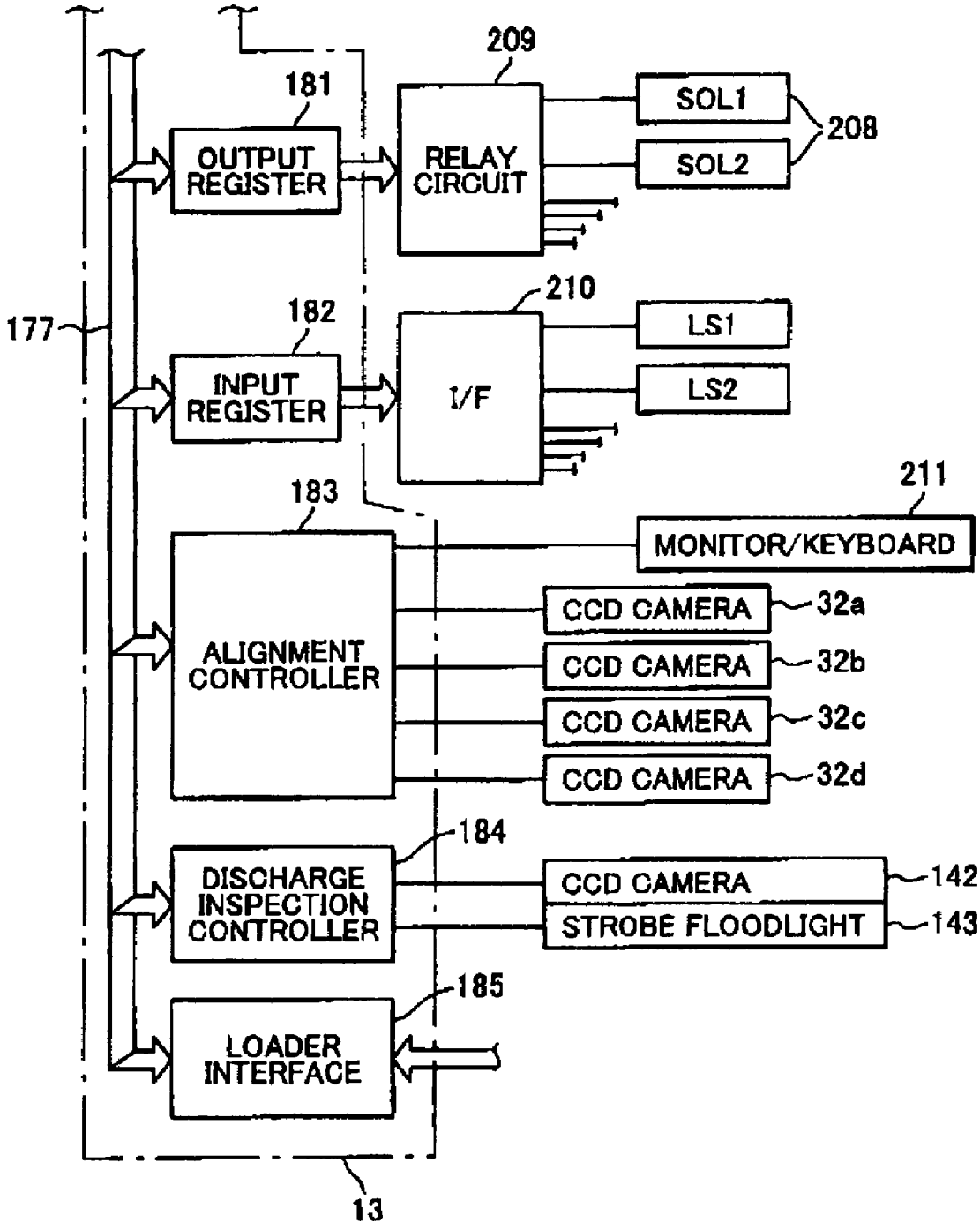
FIG. 39 is the remainder of the block diagram of FIG. 38.

The description now turns to the control system that comprises the control device 13 of the droplet jet patterning device 1, with reference to FIGS. 38 and 39. Note that the control device 13 is designed to control different devices and mechanisms provided for the droplet jet patterning device 1.

The host control unit 173 of the control device 13 has a computer including a CPU, ROM, and RAM (not shown in the figures). Various control programs for controlling several motors, the imaging devices, the strobe floodlights, and other various components of the droplet jet patterning device 1 are stored in the ROM. An operating panel 174, an external storage device 175, and power supply 176 are connected to the host control unit 173. Dot pattern image data to be formed on the glass substrate 4, system constants for the droplet jet patterning device 1, and production management information are stored in the external storage device 175.

The host control unit 173 is further connected to a digital signal processor (DSP) 178, a multi-shaft feed pulse generator circuit 179, a multi-shaft feed pulse generator circuit 180, an output register 181, an input register 182, an alignment roller 183, a discharge inspection controller 184, and a loader interface 185, through an input-output line 177. The DSP 178 is connected to the nozzle heads 8R, 8G, and 8B by a signal output circuit 186 and a drive circuit 187. The DSP 178 has a CPU, ROM, and RAM. A discharge recording control program for driving the nozzle heads 8 to perform discharge recording is stored in the ROM.

The drive circuit 187 has a pulse generation circuit which generates drive pulses for driving a large number of nozzle drive piezoelectric elements, and is connected to a waveform monitor 188 for displaying the drive pulses. The waveforms of the drive pulses can be set in common for the nozzle heads 8R, 8G, and 8B, or they could be set independently for each of the nozzle heads 8R, 8G, and 8B.

The DSP 178 is further connected to the multi-shaft feed pulse generator circuit 179, the X-axis linear scale 189, and a data storage device 190. The X-axis linear scale 189 is designed to precisely detect the amount of movement of the X-axis slide mechanism 20 that is driven by the X-axis servomotor 28. A detection signal of The X-axis linear scale 189 is supplied to the DSP 178 through an amplifier AMP.

The data storage device 190 is designed to store discharge recording data and phase data (data that sets the timing for discharge). The data storage device 190 stores data that has been supplied from the host control unit 173, and outputs that data to the DSP 178 during the discharge recording.

Drive circuits 191 to 195 and 197 are connected to the multi-shaft feed pulse generator circuit 179. The drive circuit 191 controls the driving of the X-axis servomotor 28, based on detection signals from the encoder 27 incorporated in the X-axis servomotor 28 and detection signals from the X-axis linear scale 189. The drive circuit 192 is connected to the Y-axis linear scale 198 for precisely detecting the amount of movement in the Y direction of the Y-axis slide mechanism 19. The drive circuit 192 controls the driving of the Y-axis servomotor 31, based on detection signals from the encoder 30 incorporated into the Y-axis servomotor 31 and detection signals from the Y-axis linear scale 198. According to this configuration, the X-axis and Y-axis slide mechanism 20 and 19 are used to move the glass substrate 4 precisely in each of the main scanning direction X and the sub scanning direction Y, to control the position of the glass substrate 4 precisely in the main scanning direction X and the sub scanning direction Y.

The drive circuit 193 is designed to drive the rotation servomotor 82, and is connected to an amplifier for amplifying detection signals of the encoder 81 that detects the rotational angle θ. The drive circuit 194 is designed to drive the position adjustment servomotor 118 that adjusts the position in the sub scanning direction Y of the head holders 51G and 51B. The drive circuit 195 is designed to drive a Z-axis slide servomotor 410 that causes the nozzle head holder 7 to rise and lower. The drive circuit 197 is designed to drive a Z1-axis slide servomotor 196 of the electric cylinder 164 that causes the movable frame 162 to rise and lower.

The multi-shaft feed pulse generator circuit 180 is connected to drive circuits 200, 202, 204, 206, and 207. The drive circuit 200 is designed to control the driving of an alignment adjustment servomotor 199 to rotate the glass substrate 4, thereby adjusting the alignment of the glass substrate 4 at the initial setting position. The drive circuits 202 and 204 are designed to control the driving of a servomotor 201 for moving the discharge inspection CCD camera and a servomotor 203 for moving the discharge inspection strobe, respectively. The drive circuit 206 is designed to control the driving of a servomotor 205 of the electric cylinder 124 for moving the maintenance mechanism. The drive circuit 207 is designed to control the driving of the servomotor 137 for the blotting paper winding of the head maintenance mechanism 123.

As shown in FIG. 39, the output register 181 is connected to a relay circuit 209. The relay circuit 209 controls a plurality of solenoid valves 208 that are provided in the valve unit 155 of the liquid supply mechanism 12. The input register 182 is connected to a plurality of detection switches through an interface (I/F) 210. The alignment controller 183 is connected to the four CCD cameras 32*a* to 32*d*, a keyboard, and a monitor 211. The discharge inspection controller 184 is designed to control the driving of the CCD camera 142 and the strobe floodlight 143 for discharge inspection. The loader interface 185 is designed to transfer signals to and from the external loader H for transferring the substrate.

The description now turns to the control of the continuous recording to discharge droplets from the three nozzle heads 8R, 8G, and 8B to discharge a dot pattern onto the glass substrate 4, thereby creating a pattern such as light-emitting layers on an EL substrate, with reference to FIGS. 40 to 47. This control is executed by the host control unit 173. In the figures, reference symbols Si (where i=1, 2, 3, . . . ) denote steps.

Figure 40:
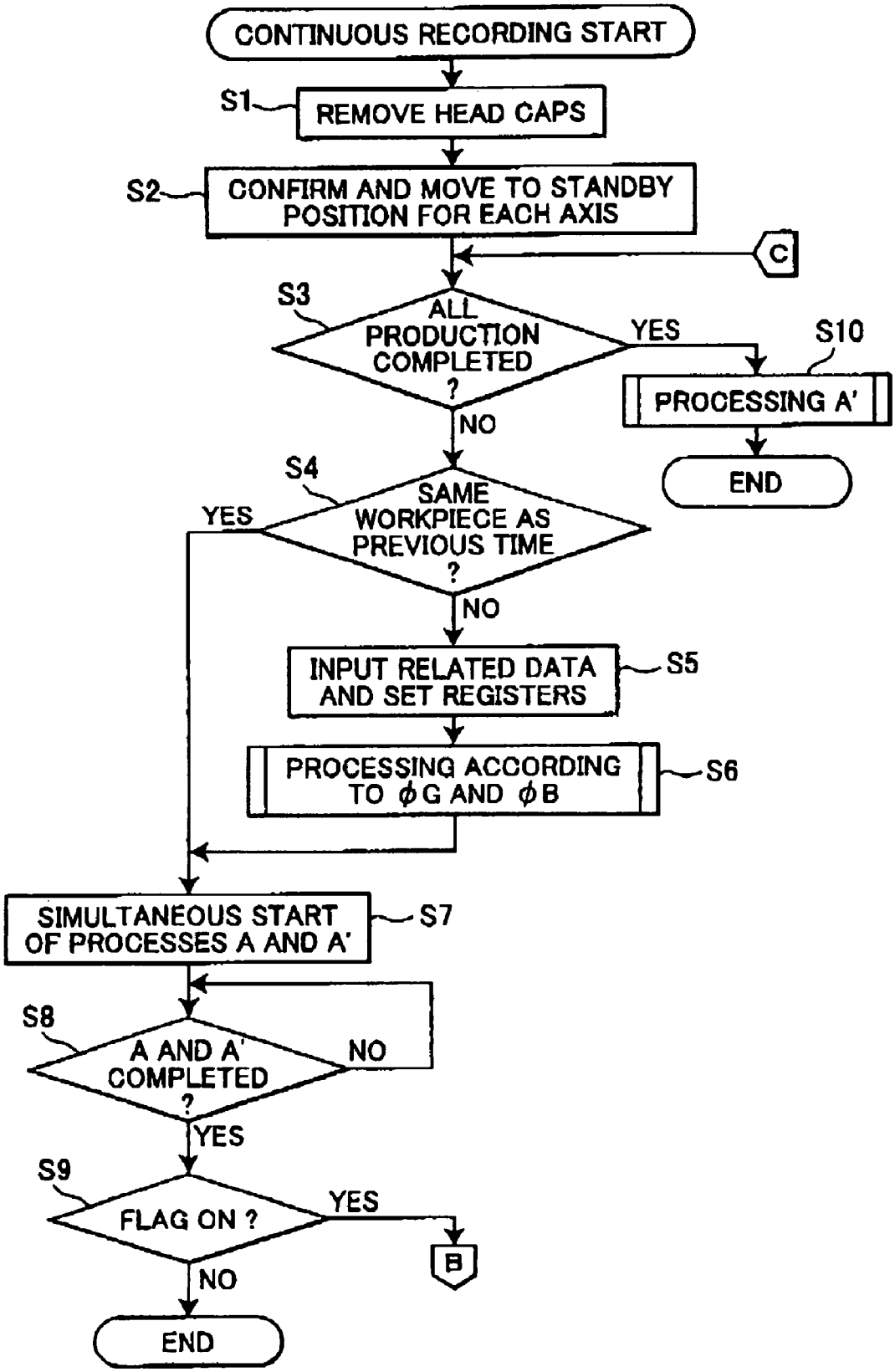
FIG. 40 is a flowchart of continuous recording control for discharge recording on a glass substrate.

As shown in FIG. 40, the continuous recording control is started by operating a manual switch to turn on the main power source of the droplet jet patterning device 1. First of all, the nozzle heads 8 are separated from the rubber pads (caps) 128R, 128G, and 128B of the head maintenance mechanism 123 to expose the nozzle heads 8 (S1). The host control unit 173 then checks angle θ and the position of the Z axis of the nozzle head holder 7, the position of the substrate receptacle 21 along the X and Y axes, and the rotational angle α about the pin 22 as the axis; causes the glass substrate 4 to move the nozzle heads 8 to θ=0°, the home position (HP) on the Z axis, and the wait position WP on the X and Y axes. A rotational angle α about the pin 22 is set to be 0° (S2).

In S3, the host control unit 173 determines whether or not the discharge recording for all the glass substrates 4 (total production) has been completed (S3). If it determines that it has been completed (YES at S3), inspection processing A' is executed in S10, then the processing ends. This inspection processing A' will be described later. If it is determined to not be completed (NO at S3), the host control unit 173 determines whether or not the workpiece is the same as the previous one (S4). In this context, "same workpiece" means that the type of the glass substrate 4 that is used is the same (all of the dimensions, shape, and alignment marks are the same) and also the dot pattern to be recorded thereon is the same.

If it is determined to be the same (YES at S4), the flow proceeds to S7. If it is determined to not be the same (NO at S4), the flow proceeds to S5, and all of the data relating to discharge recording (discharge-related data) that has been created in the host control unit 173 is set in the RAM, the data storage device 190, and other registers of the host control unit 173 (S5). Adjustment processing is done in accordance with φG and φB that are included within the discharge-related data. In this case, φG and φB are rotational angles of the position adjustment drive mechanism 113. This causes changes of position of the head holders 51G and 51B by extremely small distances in the sub scanning direction Y. In other words, if the position of the G dots and the B dots with respect to the R dots in the sub scanning direction Y are changed by a small amount, as shown in FIG. 29(*c*), the head holder 51G or 51B can be moved in the sub scanning direction Y. This movement in the sub scanning direction Y can be done by rotating the position adjustment drive mechanism 113 by just a predetermined angle. When the adjustment processing of S6 ends, the flow proceeds to S7.

In S7, the recording preparation processing A and the inspection processing A' start simultaneously. In this document, the description deals with the recording preparation processing A and the inspection processing A' in sequence.

Figure 41:
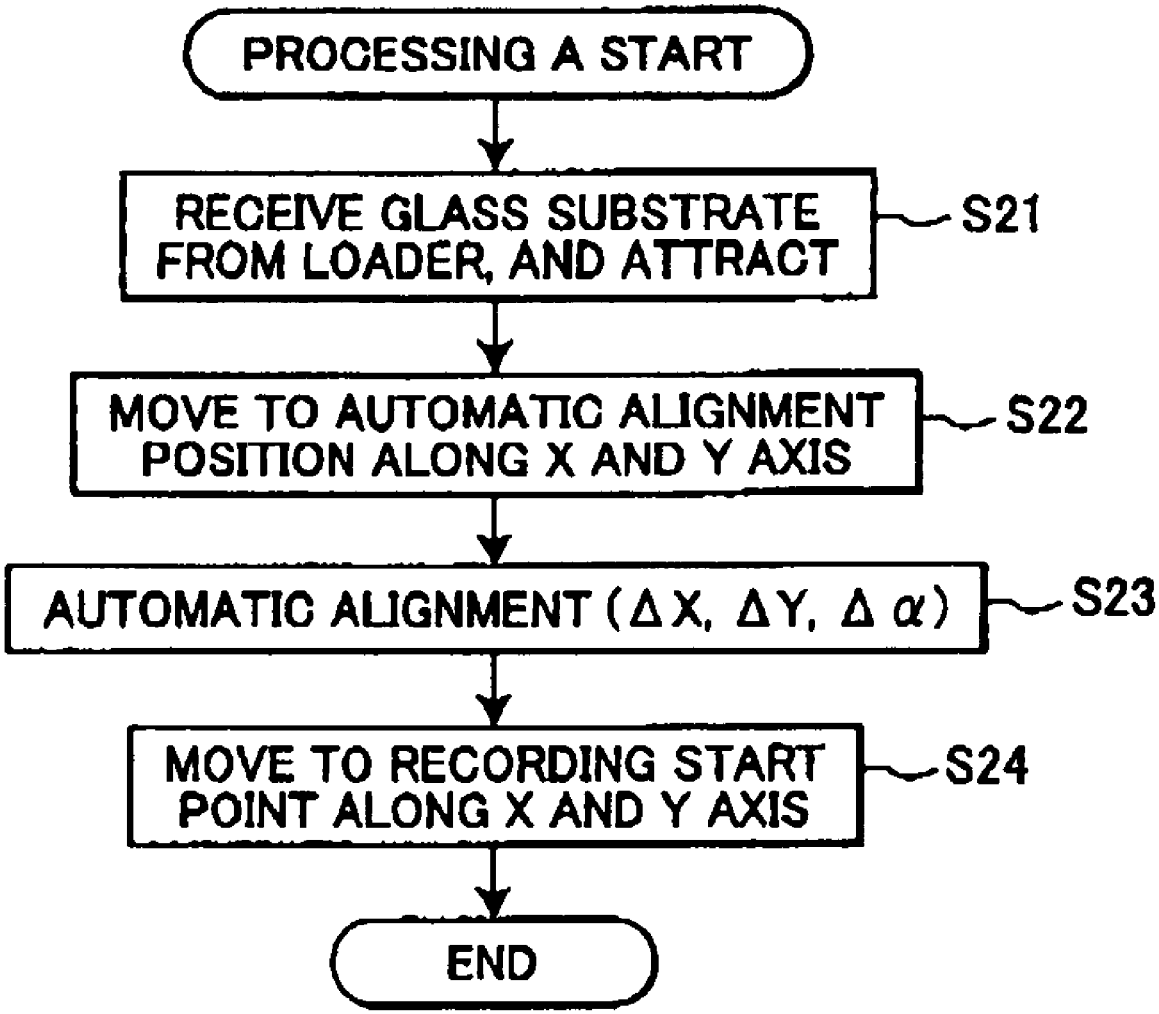
FIG. 41 is a flowchart of the recording preparation processing executed by the continuous recording control.
Figure 42:
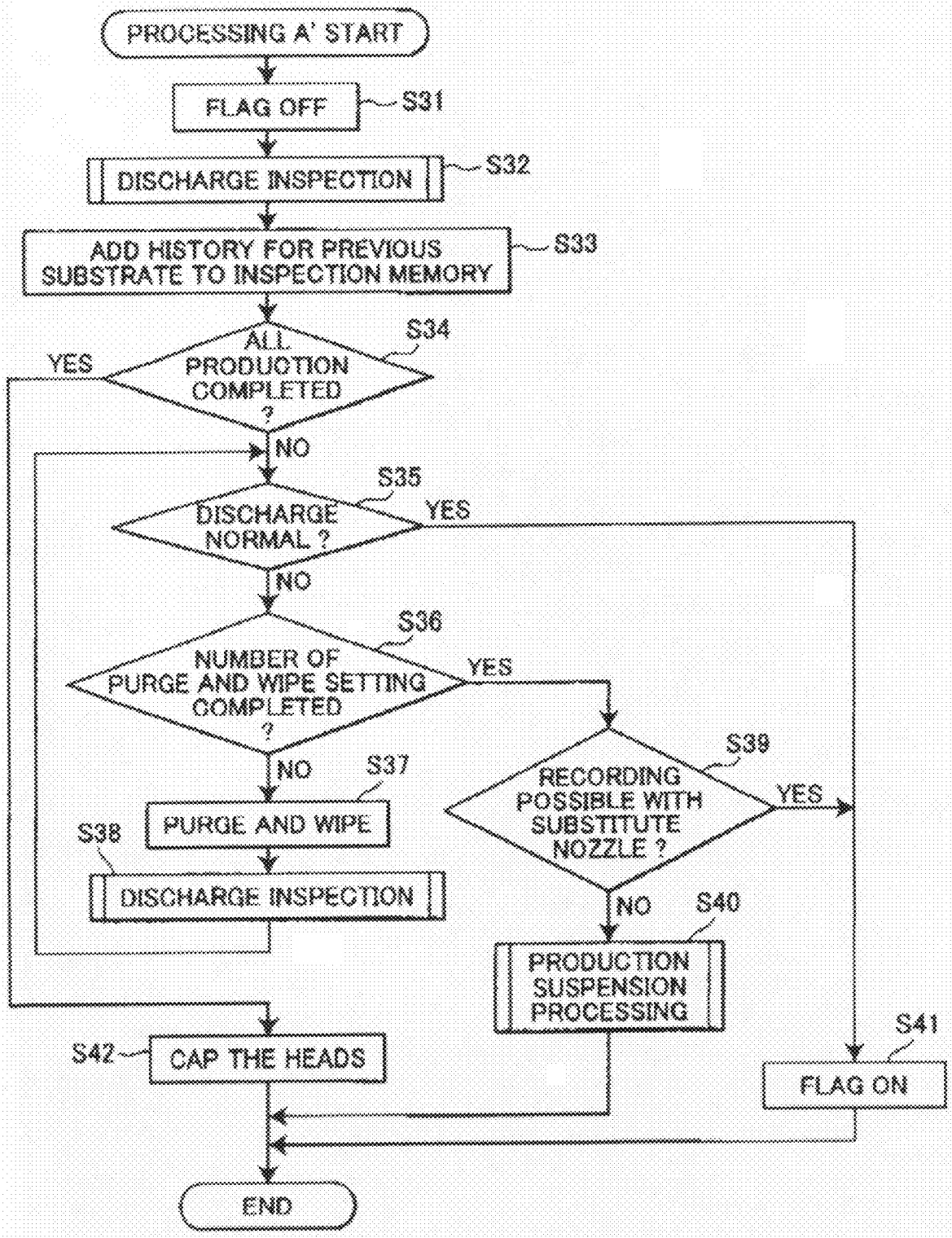
FIG. 42 is a flowchart of the inspection processing executed by the continuous recording control.

As shown in FIG. 41, when the recording preparation processing A starts, the feed loader H is used to mount the glass substrate 4 on the substrate receptacle 21 at the wait position WP. Then, the glass substrate 4 is attracted to the substrate receptacle 21 (S21). The substrate receptacle 21 with the glass substrate 4 mounted thereon is then moved to an automatic alignment start position by the X-axis and Y-axis slide mechanisms 20 and 19 (S22). Correction movement amounts ΔX, ΔY, and Δα are obtained by the Z-axis slide mechanism 6, and position adjustment by those correction movement amounts is done to set the glass substrate 4 at the initial setting position (S23). The glass substrate 4 is moved by the X-axis and Y-axis slide mechanisms 20 and 19 so that the reference nozzle is positioned at the recording start point (S24), and processing ends.

When the inspection processing A' starts, a flag is first turned off (S31) and the discharge inspection processing is done (S32). Details of this discharge inspection processing will be given later. History information for the previous glass substrate is added to the memory of the host control unit 173 (S33), and the host control unit 173 determines whether or not the discharge recording for all the glass substrates 4 (total production) has been completed (S34). If it determines that it has been completed (YES at S34), the flow proceeds to S42. In S42, the nozzle heads 8R, 8G, and 8B are brought into contact with the rubber pads 128R, 128G, and 128B to be capped (S42), and the inspection processing A' ends.

If it is determined that the discharge recording has not been completed for all the glass substrates 4 (NO at S34), the host control unit 173 determines whether or not the discharge status is normal, based on the previously executed discharge inspection (S35). If it is determined to be normal (YES at S35), the flag is set to on (S41) and the inspection processing A' ends. If it is determined that it was not normal (NO at S35), the host control unit 173 determines whether or not purge processing has been executed a predetermined number of times (S36). If it is determined that the purge processing has not been executed the predetermined number of times (NO at S36), the purge processing and the wiping processing are executed (S37), discharge inspection processing similar to that of S32 is then executed (S38), and the flow proceeds to S35.

If it is determined that the purge processing has been executed the predetermined number of times (YES at S36), it is determined that recording is not possible with the current nozzles 55. And the host control unit 173 then determines whether or not discharge recording can be possible with substitute nozzles (S39). If it is determined to be possible (YES at S39), the flag is set to on (S41), and the inspection processing A' is over. If it is determined to be not possible (NO at S39), continuous recording suspension processing is executed (S40), and the inspection processing A' ends. In this case, the flag remains set to off.

As shown in FIG. 40, after S7, the host control unit 173 determines whether or not the recording preparation processing A and the inspection processing A' have been completed (S8). If it is determined that one or both of the processes A and A' has not ended (NO at S8), the host control unit 173 waits until both of them have ended. If both of them have ended (YES at S8), the host control unit 173 determines whether or not the flag is on (S9). If it determines that the flag is not on (NO at S9), the processing ends. If it determines that the flag is on, on the other hand (YES at S9), the flow proceeds to S51 of FIG. 43.

At S51, the Z-axis slide mechanism 6 is used to lower the head portion 43 to the discharge position DP (S51). The four-bar linkage 49 is then rotated aslant if necessary, based on the rotational angle θ that has been input and set (S52). If the results of the previous discharge inspection are normal (YES at S53), the regular recording, that is, the formation of a pattern while the glass substrate 4 is moved relative to the head portion 43 in the main scanning direction X and the sub scanning direction Y, is performed (S54) and the flow proceeds to S55.

If the results of the discharge inspection determine that the discharge is abnormal, on the other hand (NO at S53), skipped nozzle recording is performed (S56). This skipped nozzle recording is recording in a state in which some of the nozzles 55 are suspended. One example of the skipped nozzle recording is one stage of interlace recording in which only the odd-numbered nozzles operate in one pass of recording. Data for substitute nozzle recording is then created and stored in a page memory of the data storage device 190 or other types of registers (S57). The substitute nozzle recording is then executed (S58) and the flow proceeds to S55. The substitute nozzle recording is that when No. 1 and No. 2 nozzles are not available, No. 3 and No. 4 nozzles are used again to record on the glass substrate 4 that has already been recorded upon, without using nozzles No. 1 and No. 2.

Figure 44:
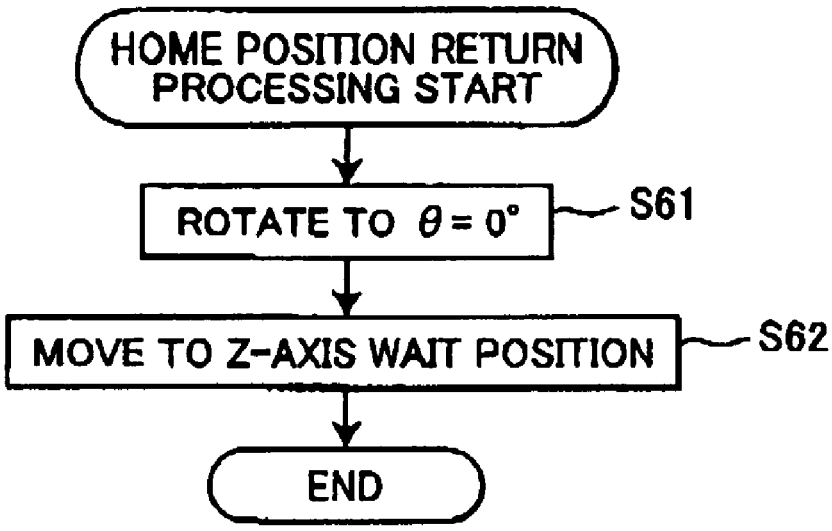
FIG. 44 is a flowchart of the home-position return processing executed by the continuous recording control.
Figure 45:
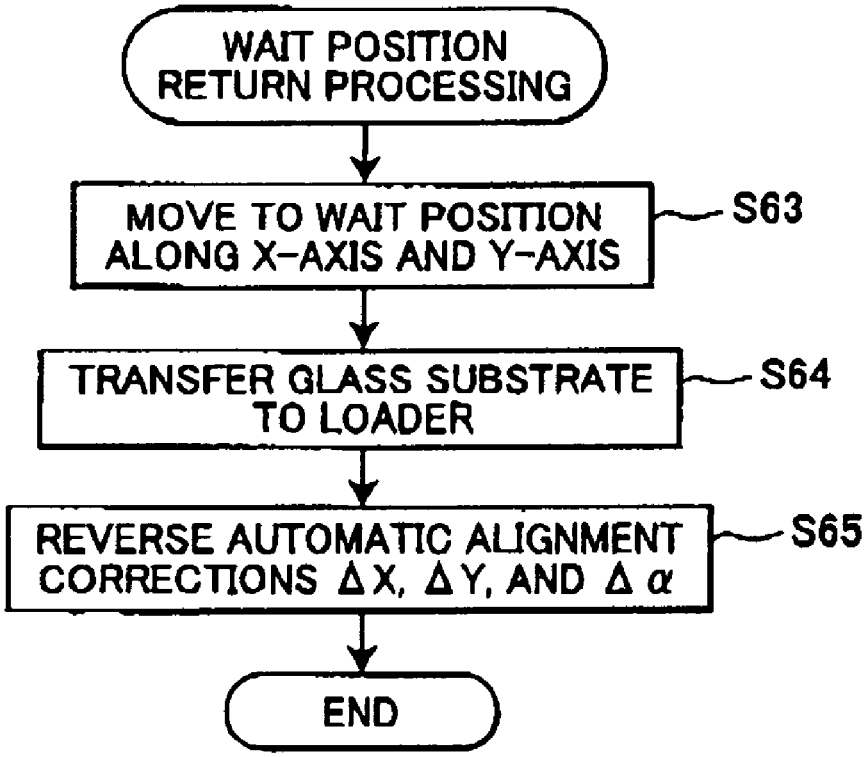
FIG. 45 is a flowchart of the waiting-position return processing executed by the continuous recording control.

At S55, history information for that glass substrate 4 is stored in memory of the host control unit 173 (S55), and the home position return processing and the wait position return processing start simultaneously (S59). As shown in FIG. 44, the home position return processing first returns the rotational angle θ of the four-bar linkage 49 to 0 degrees (S61), then raising the nozzle head holder 7 to the home position HP (S62), whereupon the processing ends. The wait position return processing causes the substrate receptacle 21 and the glass substrate 4 to move to the wait position WP (S63), then uses the substrate lift mechanism 23 to raise the glass substrate 4 by a predetermined small distance from the substrate receptacle 21 and transfer the raised substrate 4 to the feed loader H (S64). The values of ΔX, ΔY, and Δα that were adjusted in S23 are returned to their original values (S65) and processing ends.

Figure 43:
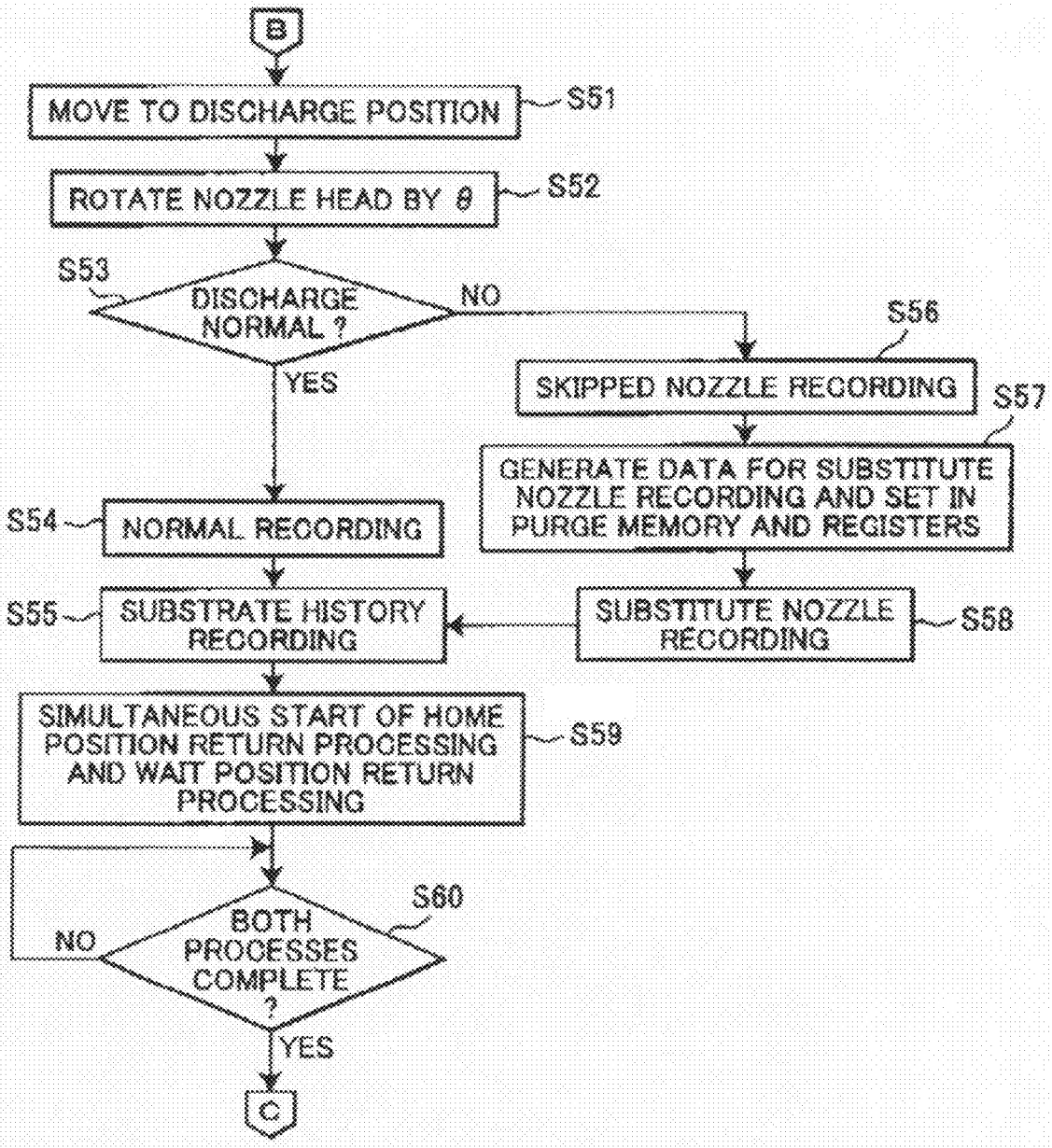
FIG. 43 is a continuation of the flowchart of FIG. 41.

In FIG. 43, after S59, the host control unit 173 determines in S60 whether or not the home position return processing and the wait position return processing have ended. If at least one of them has not ended (NO at S60), the host control unit 173 waits until the processing has ended. If both have ended (YES at S60), the flow returns to S3 of FIG. 40.

Figure 46:
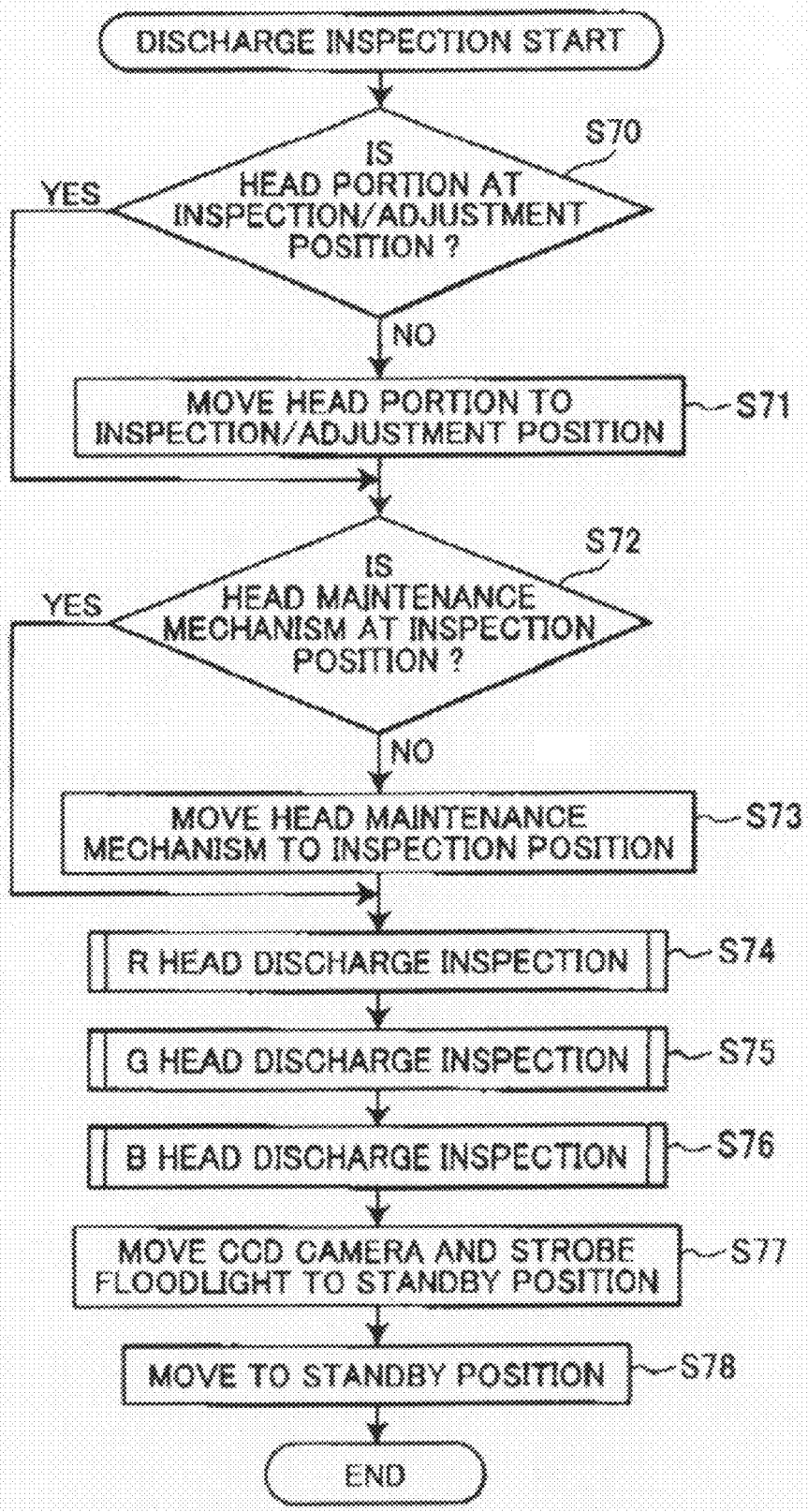
FIG. 46 is a flowchart of the discharge inspection processing executed by the continuous recording control.

The description now turns to the discharge inspection processing executed in S32 and S38, with reference to the flowchart of FIG. 46. When this processing starts, the host control unit 173 first determines whether or not the nozzle head holder 7 is at the inspection/adjustment position UP (S70). If the nozzle head holder 7 is not at the inspection/adjustment position UP (NO at S70), the nozzle head holder 7 is moved by the Z-axis slide mechanism 6 to the inspection/adjustment position UP (S71), and the flow proceeds to S72. If the nozzle head holder 7 is at the inspection/adjustment position UP (YES at S70), the flow proceeds to S72 without executing S71. At S72, the host control unit 173 determines whether or not the head maintenance mechanism 123 is at the inspection position (S72). If it is not at the inspection position, (NO at S72), the head maintenance mechanism 123 is moved to the inspection position (S73) and the flow proceeds to S74. If the head maintenance mechanism 123 is at the inspection position (YES at S72), the flow proceeds directly to S74.

At S74, discharge inspection of the nozzle head 8R is performed and in the subsequent S75 and S76 discharge inspection is performed for each of the nozzle heads 8G and 8B (S75 and S76). The CCD camera 142 and the strobe floodlight 143 are then moved to their predetermined standby positions (S77), and the head maintenance mechanism 123 is moved to its predetermined standby position (S78). This completes the discharge inspection processing.

The description now turns to the discharge inspection of the nozzle head 8R that is performed in S74. Note that the discharge inspection is the same for all of the nozzle heads 8R, 8G, and 8B, therefore, only the discharge inspection of the nozzle head 8B is described here, based on the flowchart of FIG. 47, and description of the discharge inspection of the nozzle heads 8G and 8B performed in S75 and S76 is omitted.

Figure 47:
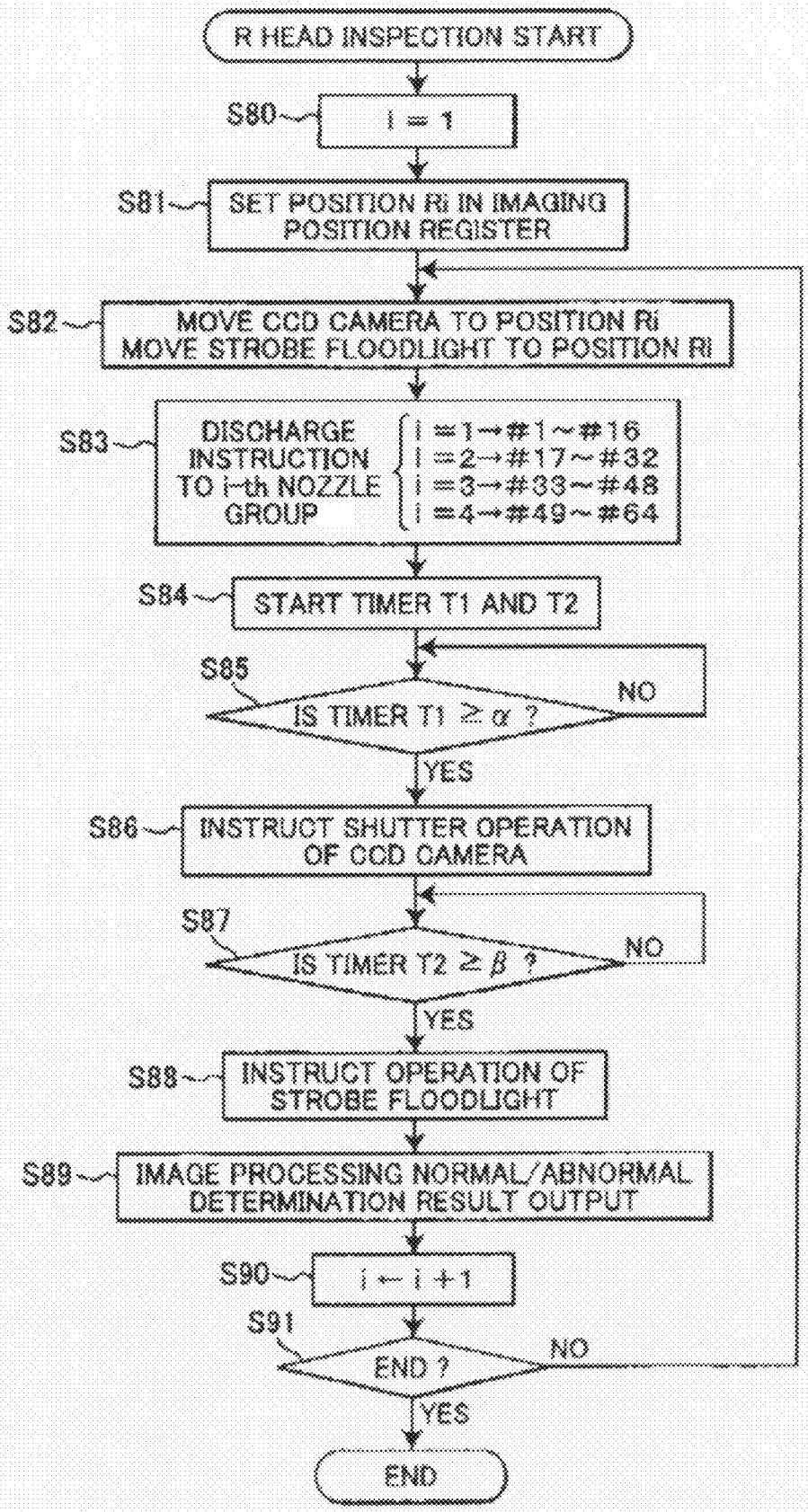
FIG. 47 is a flowchart of R-head inspection processing executed by the discharge inspection processing of FIG. 46.

In FIG. 47, when the processing starts, first a counter i is set to 1 (S80) and a position Ri is set in an imaging position register (S81). The CCD camera 142 is then moved to the position Ri and the strobe floodlight 143 is also moved to the position Ri (S82). A discharge instruction is then output to the i-th group of 16 nozzles 55 of the nozzle head 8R (S83). Accordingly, 16 target nozzles 15 discharge a droplet, respectively. Note that the position Ri is the position corresponding to the i-th group of nozzles.

A timer T1 and a timer T2 are then started (S84). At S85, the host control unit 173 determines whether or not the timer T1 has measured a predetermined time $\alpha$, if the timer T1 has not yet measured that time (NO at S85), the host control unit 173 waits until the timer T1 measures the time $\alpha$. If the timer T1 has measured that time (YES at S85), the host control unit 173 instructs the shutter operation of the CCD camera 142 (S86). The host control unit 173 then determines whether or not the timer T2 has measured a predetermined time $\beta$ (S87). If timer T2 has not yet measured that time (NO at S87), the host control unit 173 waits until the timer T2 measures the time A. If the timer T2 has measured that time (YES at S87), the host control unit 173 instructs the operation of the strobe floodlight 143 (S88). Thus the droplets that have been discharged from the 16 nozzles 55 are imaged. Note that the predetermined times $\alpha$ and $\beta$ times are very short times that are substantially equal, so that the strobe lighting and the shutter operation are substantially simultaneous.

The host control unit 173 then executes image processing on image data of the image of the captured droplets, to determine whether the discharge is normal or abnormal, and posts the result on a display of the operating panel 174 (S89). At this time, each of the nozzles 55 is determined to be normal if the image of the droplets is within the observation window 151 of the CCD camera 142. The nozzles 55 are determined abnormal if the image is outside of the windows (see FIGS. 31 and 32). The host control unit 173 then increments the counter i by 1 (S90) and determines whether or not the imaging of the fourth group of nozzles has been completed (S91). If it has not been completed (NO at S91), the flow returns to S82 and the same processing is executed in sequence up until the fourth group. If the fourth group has been completed (YES at S91), the processing ends.

In this manner, since the inspection processing A' can be executed by the discharge inspection mechanism 121 during the execution of the recording preparation processing A that moves the glass substrate 4 (S22) and performs automatic alignment (S23), it is possible to increase the operating efficiency of the droplet jet patterning device 1 and also reduce the occurrence of defective products (defective EL substrates) due to discharge errors.

As described above, the present invention relates to the nozzle head holder 7 which is provided with the four-bar linkage 49, the pair of rotational pivots 50A and 50B, and the head holders 51 each having two ends that are connected in a rotatable manner to the pair of first link members 56A and 56B. Accordingly, the nozzle head holder 7 can be readily attached to and removed from the external head assembly attachment stand 25 that supports the nozzle head holder 7. It is therefore possible to simplify the configuration for attaching and removing the nozzle heads 8 for repair and replacement, thus ensuring maintainability.

Since the rotational pivot 50A is provided at an intermediate portion of the second link members 57A and 57B, the reference nozzles (such as the No. 1 nozzle) of the nozzle heads 8 can be positioned on the line BF that links the centers of the rotational pivots 50A and 50B. Even if the nozzle heads 8 are rotated, the position of the reference nozzle is not changed, or even if the positions of the nozzles are changed, the amount of the change is so small. Accordingly, it is possible not only to simplify the data processing for calculating the drive data and rotational angle for causing relative movements between the glass substrate 4 and the nozzle heads 8, but also to increase the precision of the pattern formation.

In addition, since the plurality of nozzle heads 8R, 8G, and 8B are disposed at a predetermined spacing in the main scanning direction X, these nozzle heads 8R, 8G, and 8B can be inclined with respect to the sub scanning direction Y to set the discharge pitch in the sub scanning direction Y to a desired value for recording the pattern, so that the nozzle heads 8R, 8G, and 8B are applicable to the manufacture of color filters or EL substrates for organic color EL displays. Moreover, since these nozzle heads 8 includes nozzle heads that discharge droplets of a plurality of different colors for forming an EL light-emitting layer, the throughput can be increased and it becomes possible to manufacture EL substrates for full-color use. In addition, use of the nozzle head holder 7 also makes it possible to discharge and record a hole transport layer from these nozzle heads 8.

Note that if advances in technology make it possible to mix a hole transport component and an EL light-emitting component within a single droplet, and thus obtain light emission from a single layer, it is not necessary to form a hole transport layer.

The nozzle heads 8G and 8B move only in the sub scanning direction Y but do not move in the main scanning direction X, even when the nozzle heads 8G and 8B are rotated aslant with respect to the sub scanning direction Y. Accordingly, the nozzle heads 8G and 8B can be moved by small amounts in the sub scanning direction Y alone via the paired roller members 102 and guide surfaces 104, making it possible to adjust the position of the nozzle heads 8 finely in the sub scanning direction Y accurately, efficiently, and automatically. In addition, since the pair of roller members 102 are each positioned at predetermined positions with respect to the pair of first link members 56A and 56B, irrespective of the rotation angle of the nozzle heads 8. Accordingly, the movement mechanisms 53A and 53B can be mounted at predetermined positions of the first link members 56A and 56B. And actuators for moving these movement mechanisms 53A and 53B can be provided externally, so that fine adjustment of the nozzle heads 8 in the sub scanning direction Y can be automated.

The pattern processing stage 120 is disposed in the first-floor (lower side) patterning room 15, the inspection/adjustment stage 44 is disposed in the second-floor (upper side) maintenance room 16, and the head portion 43 can be raised and lowered between these two stages through the aperture portion 14*a*. Accordingly, the head portion 43 can be moved to the inspection/adjustment position UP where discharge inspection can be performed on the nozzles 55, during an idle period such as when the discharge formation processing is halted. After the discharge inspection, the head portion 43 can be moved immediately back to the discharge position DP and the discharge formation processing can be resumed. Since discharge inspection during a processing halt in the discharge formation processing step can be performed, it is possible to reduce the occurrence of defective products and improve the operating efficiency of the droplet jet patterning device 1. Since the two stages are disposed in a vertical spatial arrangement, the usage efficiency of the space within the droplet jet patterning device 1 can be increased and the device can be made more compact, which is beneficial from the installation cost point of view. Moreover, since the horizontal partitioning plate 14 substantially separates the upper and lower parts of the device 1, foreign bodies such as dust and debris do not fall onto the glass substrate 4 held on the substrate receptacle 21, even when a movable member is moved higher than the horizontal partitioning plate 14, making it possible to prevent the occurrence of defective products.

The pattern formation can be done by mounting and holding the glass substrate 4 on the substrate receptacle 21 and moving the glass substrate 4 relative to the nozzle heads 8 in both the main scanning direction X and the sub scanning direction Y.

In other words, since the medium transfer mechanism 24 is provided for moving the glass substrate 4 in each of the main scanning direction X and the sub scanning direction Y, it is not necessary to move the head portion 43 in either the main scanning direction X or the sub scanning direction Y to form the pattern. For that reason, the configuration for raising and lowering the head portion 43 by the Z-axis slide mechanism 6 be simplified. Accordingly, switching of the position of the head portion 43 by the Z-axis slide mechanism 6 can be performed between the space below the horizontal partitioning plate 14 and the space thereabove. It is possible to perform pattern formation and discharge inspection efficiently by providing the discharge inspection mechanism 121 for inspecting the discharge status of the plurality of nozzles 55 on the inspection/adjustment stage 44 and raising and lowering the head portion 43 by the Z-axis slide mechanism 6.

The nozzle heads 8 are fixed to the head holder 51. The two ends of the head holder 51 and the pair of first link members 56A and 56B are connected together in a rotatable and also removable manner by the roller members 102 acting as pins, and these roller members 102 extend in a direction perpendicular to the head surface of the nozzle heads 8. According to the above configuration, the head body 500 can be simplified. Use of the rotatable roller members 102 as connecting pins is preferable, from the point of view of smoothing the rotation and the movement in the sub scanning direction Y of the head body 500. However, the connecting pins need not be restricted to the roller members 102.

The head body 500 provided with a plurality of nozzle heads 8 is attached rotatably and also removably to the first link members 56A and 56B of the four-bar linkage 49. Accordingly, this four-bar linkage 49 is attached to the head assembly attachment stand 25. Thus, the distance between the discharge-target medium and the head body 500 can be maintained extremely precisely. For that reason, the RGB light-emitting layers can be arrayed on the substrate to an extremely high precision. Since no play occurs in the movable portions between the head body 500 and the first link members 56A and 56B, it is possible to create an EL display in a simpler manner, in a shorter time, and at a lower cost than with a conventional screen-printing method.

The embodiment of the present invention is described above, however, various modifications and variations are included within the scope of the present invention. Thus the scope of the present invention must be comprehended by the claims herein, in addition to the above embodiment.

For example, the embodiment above was described as relating to a droplet jet patterning device that forms a dot pattern on a glass substrate for a color EL display. However, the present invention can also be applied to other applications. For instance, the present invention can be applied to the formation of a dot pattern during the manufacture of a color filter for a color LCD, or a large-scale inkjet printer, or a droplet jet patterning device for another application.

In addition, the output shaft of the motor 82 that causes the four-bar linkage 49 to pivot can be connected directly to the pin member 75 of the rotational pivot 50B, to pivot the four-bar linkage 49. Furthermore, means for moving and driving the front-side first link member 56A precisely to the left or means for moving and driving the rear-side first link member 56B to the right can be utilized as the means for pivoting the four-bar linkage 49. An electric cylinder or a solenoid actuator can be used as the above means.

The means for detecting the rotational angle of the four-bar linkage 49 is not limited to the previously-described encoder 81. For example, an encoder may be provided in a coaxial with and above the left-side rotational pivot 50A to detect the rotational angle of the second link member 57A. Similarly, a highly precise servomotor may be used as the motor 82 for rotation of the nozzle holder. Accordingly, the detection of the inclination rotational angle of the four-bar linkage 49 is based on signals from an encoder of that servomotor.

It is necessary to provide the pair of rotational pivots 50A and 50B of the four-bar linkage 49 at intermediate positions of the pair of second link members 57A and 57B (intermediate positions between the pair of first link members 56A and 56B). However, it is also possible to provide the pair of rotational pivots 50A and 50B at substantially central portions in the sub scanning direction Y of the pair of second link members 57A and 57B, and to position a predetermined numbered nozzle at substantially the central position of the nozzle array of the reference nozzle head 8R on a surface that links the pair of rotational pivots 50A and 50B.

The pair of rotational pivots 50A and 50B of the four-bar linkage 49 are provided mainly on the pin members 75 that are fixed to the second link members 57A and 57B. However, a pair of pin members fixed to the frame member 46 side can be fitted in a freely sliding manner in a pair of holes formed in the second link members 57A and 57B. In this case, the pair of holes formed the second link members 57A and 57B act as the pair of rotational pivots.

The relative movement generation means is not limited to the medium transfer mechanism 24. Any suitable means of generating relative movement between the nozzle heads and the discharge-target medium in the X and Y directions (the main scanning direction X and the sub scanning direction Y) can be used as the relative movement generation means. For example, the nozzle heads 8 may be moved in the main scanning direction X, and the substrate receptacle 21 may be moved in the sub scanning direction Y.

Furthermore, the head holder 51R may be supported to be freely movable in the sub scanning direction Y, in the same manner as the other head holders 51G and 51B.

The nozzle head holder 7 need not be removable. The nozzle head holder 7 can also be provided integrally with the droplet jet patterning device 1.

The invention claimed is:

1. A nozzle head holder (7) for holding a plurality of nozzle heads (500) having a plurality of nozzles (55) formed therein, the plurality of nozzle heads being disposed at a predetermined spacing in a main scanning direction (X), the nozzle head holder (7) comprising:

a four-bar linkage (49) having a pair of first link members (56A and 56B) that extend parallel to the main scanning direction (X) and a pair of second link members (57A and 57B) that connect together said pair of first link members (56A and 56B); and movement means (53A and 53B) for moving at least one nozzle head of said plurality of nozzle heads (500) parallel to a sub scanning direction (Y) that is perpendicular to the main scanning direction (X); wherein:

each of said nozzle heads (500) has two end portions connected to said pair of first link members (56A and 56B); and said movement means (53A and 53B) moves said at least one of said nozzle heads parallel in the sub scanning direction (Y), relative to the pair of first link members (56A and 56B).

2. The nozzle head holder (7) as defined by claim 1, wherein:

concavities (103A and 103B) having guide surfaces (104A and 104B) are formed in said pair of first link members (56A and 56B), respectively;

said movement means (53A and 53B) includes a pair of roller members (102A and 102B) that are provided rotatably on the two end portions of said at least one of said nozzle heads, and pressure members (105A and 105B) that press the roller members (102A and 102B) against said guide surfaces (104A and 104B); and said pressure members (105A and 105B) are moved parallel to the sub scanning direction (Y) along the guide surfaces (104A and 104B), while pressing the roller members (102A and 102B) against the guide surfaces (104A and 104B).

3. The nozzle head holder (7) as defined by claim 1, wherein said plurality of nozzle heads (500) are installed removably on said pair of first link members (56A and 56B).

4. The nozzle head holder (7) as defined by claim 1, wherein the two end portions of each of said nozzle heads (500) are urged by a resilient member (110) so as to be in surface-contact with upper surfaces of the first link members (56A and 56B).

5. The nozzle head holder (7) as defined by claim 1, wherein each of said nozzle heads (500) includes a nozzle portion (8) having a plurality of nozzles (55) formed therein, and a head holder (51) for supporting said nozzle portion (8), and the two end portions of said head holder (51) are connected to said pair of first link members (56A and 56B).

6. A nozzle head (500) characterized in being used in the nozzle head holder (7) as defined by claim 1.

7. A droplet jet patterning device (1) comprising:

the nozzle head holder (7) as defined by claim 1;

a head assembly attachment stand (25) for installing said nozzle head holder (7) in a removable manner;

a medium holder means (21) for holding a discharge-target medium (4);

a relative movement generation means for moving said discharge-target medium (4) in a main scanning direction (X) and in a sub scanning direction (Y) relative to said nozzle head (500);

pivoting means (80) for pivoting said four-bar linkage (49); and rotational pivots (50A and 50B) provided at an intermediate points of said pair of second link members (57A and 57B), respectively; wherein:

said pair of second link members (57A and 57B) are capable of rotating about said rotational pivots (50A and 50B);

said nozzle head (500) are connected rotatably to said pair of first link members (56A and 56B); and said pivoting means (80) rotates said pair of second link members (57A and 57B) about said rotational pivots (50A and 50B) to pivot said four-bar linkage (49).

8. The droplet jet patterning device (1) as defined by claim 7, further comprising a movement drive means (113) connected removably to said movement means (53A and 53B) for driving said movement means (53A and 53B) to move at least one nozzle head parallel to the sub scanning direction (Y).

9. The droplet jet patterning device (1) as defined by claim 7, further comprising pivoting amount detection means (81) for detecting the pivoting amount of the four-bar linkage (49), and pivoting amount control means (13) for controlling said pivoting means (80) based on the detected pivoting amount.

* * * * *

UNITED STATES PATENT AND TRADEMARK OFFICE

CERTIFICATE OF CORRECTION

PATENT NO. : 7,556,690 B2
APPLICATION NO. : 11/300800
DATED : July 7, 2009
INVENTOR(S) : Makoto Goto It is certified that error appears in the above-identified patent and that said Letters Patent is hereby corrected as shown below:

Title page, item [62] under Related U.S. Application Data should be stated as "Pat. No. 7,008,482"

Signed and Sealed this

Ninth Day of March, 2010

David J. Kappos

David J. Kappos
*Director of the United States Patent and Trademark Office*